US005668581A

United States Patent [19]

Tsuji et al.

[11] Patent Number: 5,668,581

[45] Date of Patent: Sep. 16, 1997

[54] INK JET PRINTING APPARATUS

[75] Inventors: Kikunosuke Tsuji; Takeshi Watanabe; Kohichi Baba; Kenichi Satake; Yoshiko Kawachi; Setsuo Hori; Shigeo Koyama, all of Osaka, Japan

[73] Assignee: Mita Industrial Co., Ltd., Osaka-fu, Japan

[21] Appl. No.: 327,833

[22] Filed: Oct. 24, 1994

[30] Foreign Application Priority Data

| | | | |
|---|---|---|---|
| Oct. 27, 1993 | [JP] | Japan | 5-268819 |
| Nov. 15, 1993 | [JP] | Japan | 5-285162 |
| Nov. 22, 1993 | [JP] | Japan | 5-292042 |

[51] Int. Cl.[6] ..... B41J 2/215

[52] U.S. Cl. ..... 347/37; 347/104; 347/40

[58] Field of Search ..... 347/104, 40, 42, 347/37

[56] References Cited

U.S. PATENT DOCUMENTS

| | | | |
|---|---|---|---|
| 4,207,579 | 6/1980 | Gamblin et al. | 347/104 |
| 5,229,791 | 7/1993 | Kuboki | 347/104 |
| 5,297,017 | 3/1994 | Haselby et al. | 347/19 |
| 5,475,412 | 12/1995 | Wong | 347/104 |
| 5,488,397 | 1/1996 | Nguyen et al. | 347/40 |

*Primary Examiner*—Valerie Lund

*Attorney, Agent, or Firm*—Jordan and Hamburg

[57] ABSTRACT

An ink jet printing apparatus includes a printing head operable to emit ink onto a printing sheet, the printing head being movable along a first direction; a sheet transporter operable to transport the printing sheet along a second direction perpendicular to the first direction; a head moving mechanism operable to reciprocally move the printing head along the first direction; and a controller which controls the sheet transporter and the head moving mechanism to execute a first printing mode of moving the printing head while holding the printing sheet in a stationary position and a second printing mode of moving the printing sheet while holding the printing head at a stationary position.

56 Claims, 43 Drawing Sheets

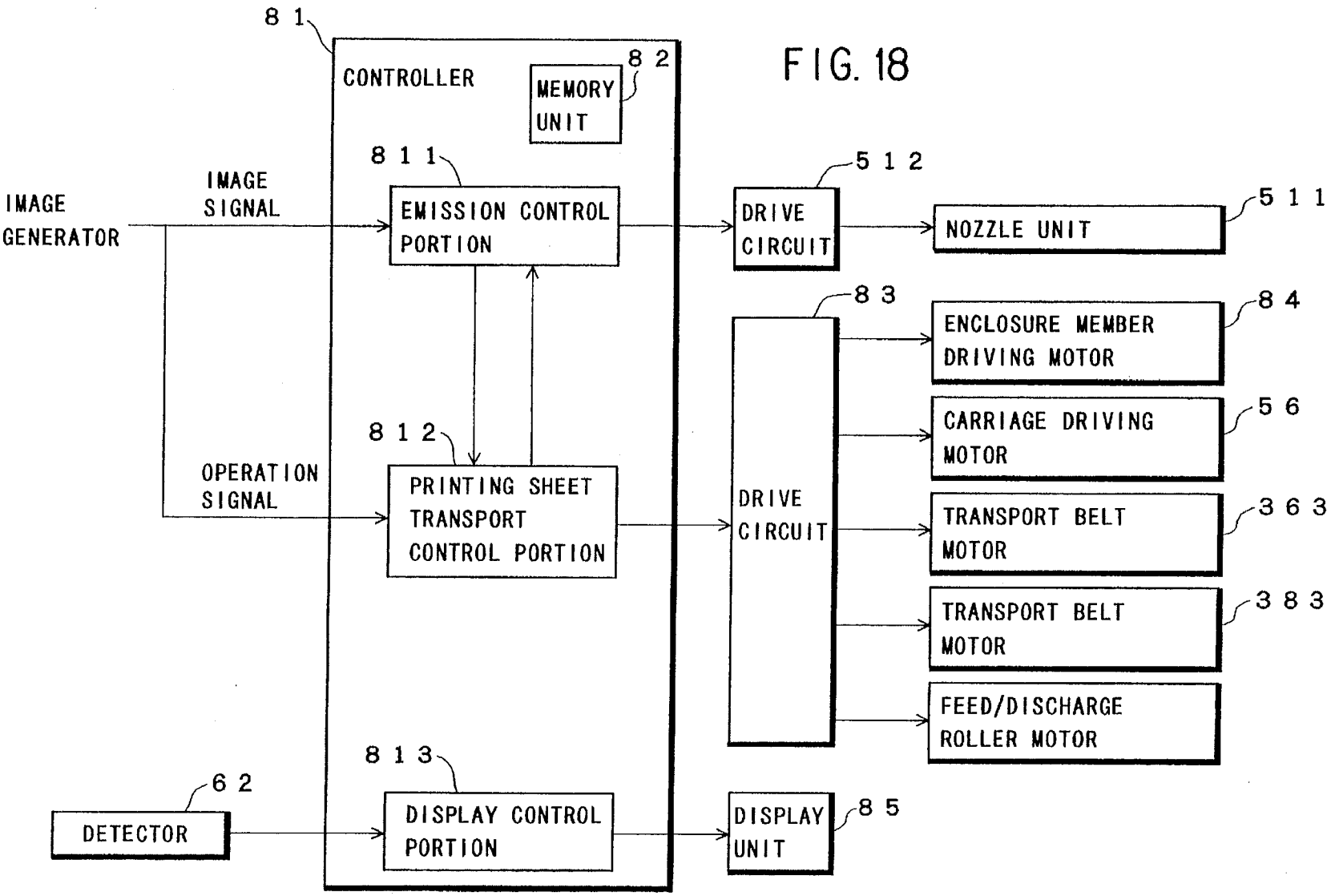
FIG. 18
NOZZLE UNIT
511
ENCLOSURE MEMBER DRIVING MOTOR
84
CARRIAGE DRIVING MOTOR
56
TRANSPORT BELT MOTOR
363
TRANSPORT BELT MOTOR
383
FEED/DISCHARGE ROLLER MOTOR
DRIVE CIRCUIT
512
DRIVE CIRCUIT
83
DISPLAY UNIT
85
CONTROLLER
81
MEMORY UNIT
82
EMISSION CONTROL PORTION
811
PRINTING SHEET TRANSPORT CONTROL PORTION
812
DISPLAY CONTROL PORTION
813
IMAGE SIGNAL
OPERATION SIGNAL
IMAGE GENERATOR
DETECTOR
62

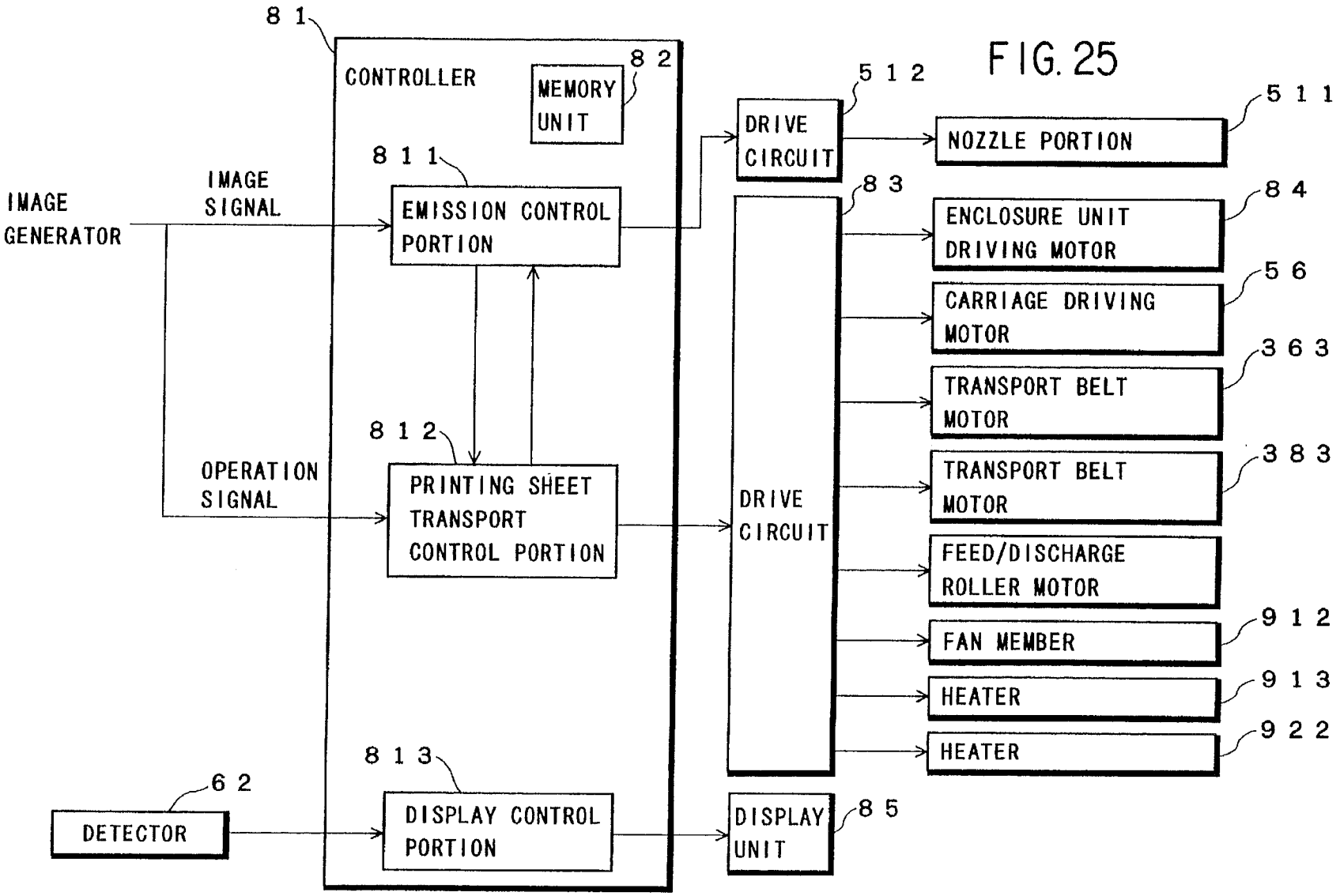
FIG. 25
NOZZLE PORTION
ENCLOSURE UNIT DRIVING MOTOR
CARRIAGE DRIVING MOTOR
TRANSPORT BELT MOTOR
TRANSPORT BELT MOTOR
FEED/DISCHARGE ROLLER MOTOR
FAN MEMBER
HEATER
HEATER
DRIVE CIRCUIT
DRIVE CIRCUIT
DISPLAY UNIT
MEMORY UNIT
CONTROLLER
EMISSION CONTROL PORTION
PRINTING SHEET TRANSPORT CONTROL PORTION
DISPLAY CONTROL PORTION
IMAGE SIGNAL
OPERATION SIGNAL
IMAGE GENERATOR
DETECTOR
511
84
56
363
383
912
913
922
512
83
85
82
811
812
813
81
62

INK JET PRINTING APPARATUS

BACKGROUND OF THE INVENTION

This invention relates to an ink jet printing apparatus for use with a facsimile machine, a copying machine, a printer, a computer output device, and the like.

A printing apparatus using an ink jet emission is disclosed in Japanese Unexamined Patent Publication No. 3-27949 in which ink is emitted from nozzles of a printing head to print an image or letter on a sheet of printing paper. Also, Japanese Unexamined Patent Publication No. 1-129667 discloses an image forming apparatus provided with an ink jet printing device.

The ink jet printing apparatus disclosed in Japanese Unexamined Patent Publication No. 3-27949 has a printing head in the form of a long bar which is secured to a main body of the apparatus and extends in a widthwise direction of the printing sheet. The printing sheet is fed in a lengthwise direction at a specified speed. Ink is emitted from the long printing head in synchronism with the lengthwise moving printing sheet to print a specified image on the printing sheet. This ink jet printing apparatus can print images at a high speed, but cannot print an image having a width larger than the long printing head.

Recently, also, there has been proposed an ink jet printing apparatus which enables printing of an image of A0-size. In the ink jet printing apparatus capable of printing a large-sized image, ink jet printing is executed as follows: A printing head having a specified size is reciprocally moved in widthwise direction of a sheet of printing paper. When being moved in a forward direction, the printing head emits ink onto the printing sheet in accordance with a control signal from a controller. In the forward movement, the printing sheet is held in a fixed position. When being moved in a reverse direction, the printing head emits no ink and the printing sheet is fed by a specified distance in a lengthwise direction of the printing sheet. These operations are repeated to print a specified image on the printing sheet.

However, the printing head of this ink jet printing apparatus is likely to suffer minute vibrations in the reciprocal movement and pressure fluctuations in an ink tube connected to the printing head, and consequently causes density variations in the printed image. To prevent such density variation, the printing head is forced to be moved within a limited speed. This has made it difficult to increase the printing speed of ink jet printing apparatus.

SUMMARY OF THE INVENTION

It is an object of the present invention to provide an ink jet printing apparatus which has overcome the problems residing in the prior art.

It is another object of the present invention to provide an ink jet printing apparatus which makes it possible to increase the printing speed.

It is another object of the present invention to provide an ink jet printing apparatus which makes it possible to print a large-sized image.

The present invention is directed to an ink jet printing apparatus comprising: a printing head operable to emit ink onto a printing sheet, the printing head being movable along a first direction; a sheet transporter operable to transport the printing sheet along a second direction perpendicular to the first direction; a head moving mechanism operable to reciprocally move the printing head along the first direction; and a controller which controls the sheet transporter and the head moving mechanism to execute a first printing mode of moving the printing head and the printing sheet one after another and a second printing mode of moving the printing sheet while holding the printing head at a stationary position.

The printing head may be provided with an ink emission nozzle array and be rotatable about a pivot axis perpendicularly intersecting a plane on which the ink emission nozzle array is. There may be provided a head rotating mechanism operable to rotate the printing head to a first position of the ink emission nozzle array being in parallel with the second direction in the first printing mode and to a second position of the ink emission nozzle array being in parallel with the first direction in the second printing mode.

The head moving mechanism may be constructed by a carriage carrying the printing head; a support shaft extending along the first direction and operable to support the carriage; and a driver operable to move the carriage along the support shaft. The carriage may be formed with a threaded hole extending along the first direction and the support shaft may be threaded in an outer surface and engaging the threaded hole formed in the carriage.

The head rotating mechanism may be constructed by a stem shaft rotatably supported in the carriage and connected with the printing head, the stem shaft extending along the pivot axis; a wheel disposed in the carriage and coaxially fixedly attached to the stem shaft; and a motor disposed in the carriage and operable to rotate the wheel.

The head rotating mechanism may be constructed by a stem shaft rotatably supported in the carriage and connected with the printing head, the stem shaft extending along the pivot axis; a spring member provided between the carriage and the printing head to urge the ink emission nozzle array to the first position; and a guide member provided at a specified position on the reciprocal movement of the printing head and operable to come into contact with the moving printing head to rotate the printing head from the first position to the second position.

It may be appreciated to provide a spring between the carriage and the printing bead and around the stem shaft to urge the printing head toward a printing sheet. The printing head may be provided with a roller operable to come into contact with a printing sheet to keep a gap between the printing head and the printing sheet.

The carriage may be provided with a retainer operable to retain the printing head at the first position or the second position. The retainer may be constructed by presser member provided in the carriage and movable in parallel with the pivot axis; and a spring operable to push the presser member against the printing head to retain the printing head at the first position or the second position.

The sheet transporter may be constructed by a single endless belt provided below a reciprocal movement path of the printing head, the single endless belt being rotatable along the second direction and operable to transport both a printing sheet for the first printing mode and a printing sheet for the second printing mode; and a motor operable to drive the single endless belt.

Also, the sheet transporter may be constructed by a first endless belt provided below a reciprocal movement path of the printing head in the first printing mode, the first endless belt being rotatable along the second direction and operable to transport a printing sheet for the first printing mode; a second endless belt provided below the stationary position of the printing head, the second endless belt being rotatable along the second direction and operable to transport a printing sheet for the second printing mode; and a motor operable to drive the first and second endless belts.

The apparatus may be further provided with a sheet storage portion, the sheet storage portion including: a first storing unit arranged below a reciprocal movement path of the printing unit and operable to store printing sheets having a short width; a second storing unit arranged at the same level as the first storing unit and operable to store printing sheet having an intermediate width; and a third storing unit arranged below the first and second storing units and operable to store printing sheet having a long width.

The sheet transporter may be constructed by a first endless belt provided below a reciprocal movement path of the printing head in the first printing mode, the first endless belt being rotatable along the second direction and operable to transport a printing sheet for the first printing mode; a second endless belt provided below the stationary position of the printing head, the second endless belt being rotatable along the first direction and operable to transport a printing sheet for the second printing mode; a first motor operable to drive the first endless belt; a second motor operable to drive the second endless belt. The head moving mechanism may be constructed by a carriage fixedly carrying the printing head with the ink emission nozzle array being along the second direction; a support shaft extending along the first direction over the first and second endless belts and operable to support the carriage; and a driver operable to move the carriage along the support shaft.

Furthermore, the printing head may be provided with an ink emission nozzle array consisting of a plurality of nozzles, the ink emission nozzle array being inclined with respect to the second direction; and the head moving mechanism includes; a carriage fixedly carrying the printing head with the ink emission nozzle array being along the second direction; and a support shaft extending along the first direction.

The controller may be provided with a nozzle driver controlling portion to control a nozzle driver to emit ink at a shorter period in the second printing mode than in the first printing mode.

The first printing mode may be executed for a printing sheet having a wide width while the second printing mode may be executed for a printing sheet having a narrow width.

With thus constructed ink jet printing apparatus, in the first printing mode, the printing head and the printing sheet are moved one after another. In the second printing mode, the printing sheet is moved while the printing head being held at a stationary position. Accordingly, a suitable printing can be selectively executed depending on the size of printing sheet. In other words, both high-speed printing and large-size printing can be executed in a single apparatus.

The above and other objects, features and advantages of the present invention will become more apparent upon a reading of the following detailed description and drawings.

BRIEF DESCRIPTION OF THE DRAWINGS

FIG. 18 is a block diagram showing a control system of the fifth apparatus;

FIG. 25 is a block diagram showing a control system of the seventh apparatus;

DETAILED DESCRIPTION OF THE PREFERRED EMBODIMENTS OF THE INVENTION

Figure 1A:
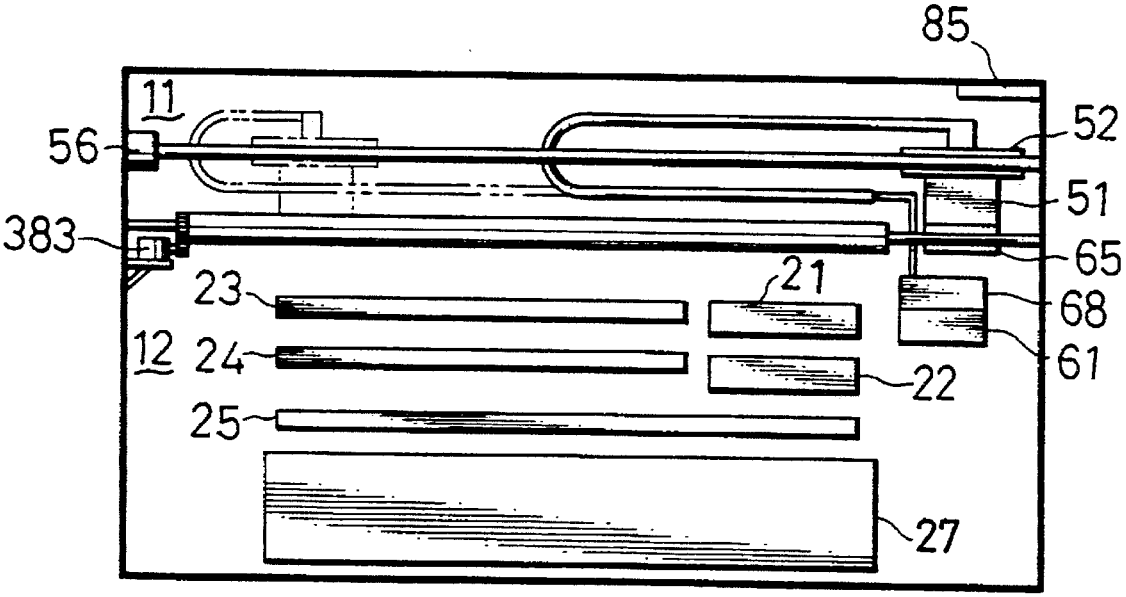
FIG. 1A is a diagram schematically showing a front view of an overall construction of a first ink jet printing apparatus according to the present invention.
Figure 1B:
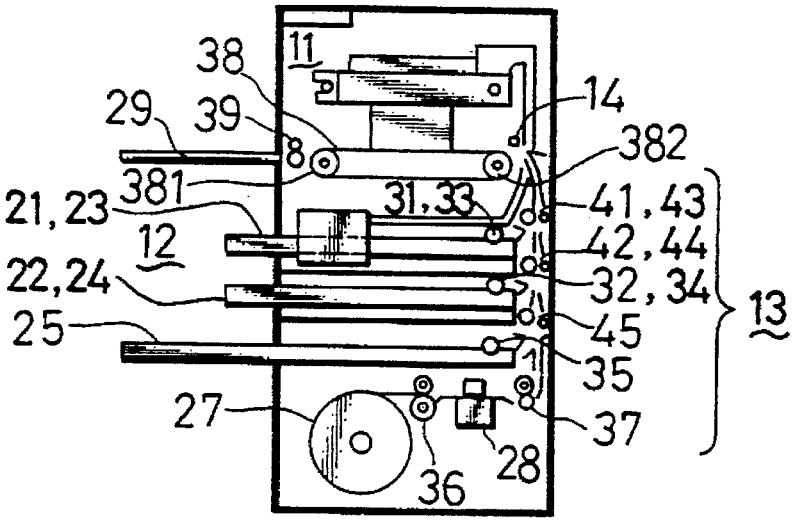
FIG. 1B is a diagram schematically showing a right side view of the overall construction of the first apparatus.

A first ink jet printing apparatus according to the present invention will be described with reference to FIGS. 1 to 5. FIGS. 1A and 1B are schematic diagrams showing an overall construction of the first ink jet printing apparatus: FIG. 1A showing a front view of the apparatus; and FIG. 1B showing a right side view of the apparatus.

The ink jet printing apparatus is connected with an unillustrated image generator such as copying machine or personal computer, and adapted for printing an image generated in the image generator on a sheet P of printing paper. The ink jet printing apparatus includes a printing portion 11 in an upper portion thereof, a printing sheet storage portion 12 in a lower portion thereof, and a printing sheet transport assembly 13 in a middle portion. The printing sheet storage portion 12 includes a plurality of cassettes 21 to 25 for storing different sized printing sheets respectively. The printing sheet transport assembly 13 transports a printing sheet P from the printing sheet storage portion 12 to the printing portion 11. The ink jet printing apparatus is further provided with a display unit 85 at an appropriate position on a top surface thereof. The display unit 85 is adapted for displaying the absence of printing sheet in their respective cassettes 21 to 25 in the printing sheet storage portion 12 and the remaining amount of ink in the printing portion 11.

The plurality of cassettes 21 to 25 are arranged one over another. For example, the cassette 21 contains printing sheets of A4 size; the cassette 22 contains printing sheets of B5 size; the cassette 23 contains printing sheets of B4 size; the cassette 24 contains printing sheets of A3 size; and the cassette 25 contains printing sheets of A1 size.

The printing sheet storage portion 12 is further provided with a roll of paper 27 at a specified position below the cassette 25. The roll paper 27 is cut into a printing sheet having a desired size by a cutter 28. Specifically, the roll paper 27 is cut by the cutter 28 to an A0-sized printing sheet whose longer sides extend along a direction of transport of printing sheet or A1-sized printing sheet whose shorter sides extend along the printing sheet transport direction.

As shown in FIG. 1A, the cassettes 21 and 22 each containing a stack of small sized printing sheets are arranged one over the other, and likewise the cassettes 23 and 24 each containing a stack of medium sized printing sheets are arranged one over the other. Further, the cassettes 21, 23 are disposed on the same horizontal plane, and likewise the cassettes 22, 24 are disposed on the same horizontal plane. The cassette 25 containing a stack of large sized printing sheets is arranged below the cassettes 21, 22, 23, 24. This arrangement provides smaller storage space.

The printing sheet transport assembly 13 comprises: feed rollers 31 to 35 adapted for dispensing printing sheets contained in the corresponding cassettes 21 to 25 one by one; pairs of rollers 42, 44, 45 for transporting the printing sheet dispensed from the cassettes 21 to 25 to the printing portion 11; pairs of registration rollers 41, 43 for transporting the printing sheet in timed relation with ink jet operation; and a transport belt 38. A cut sheet of the roll paper 27 is transported to the printing portion 11 by pairs of transport rollers 36, 37.

Figure 2:
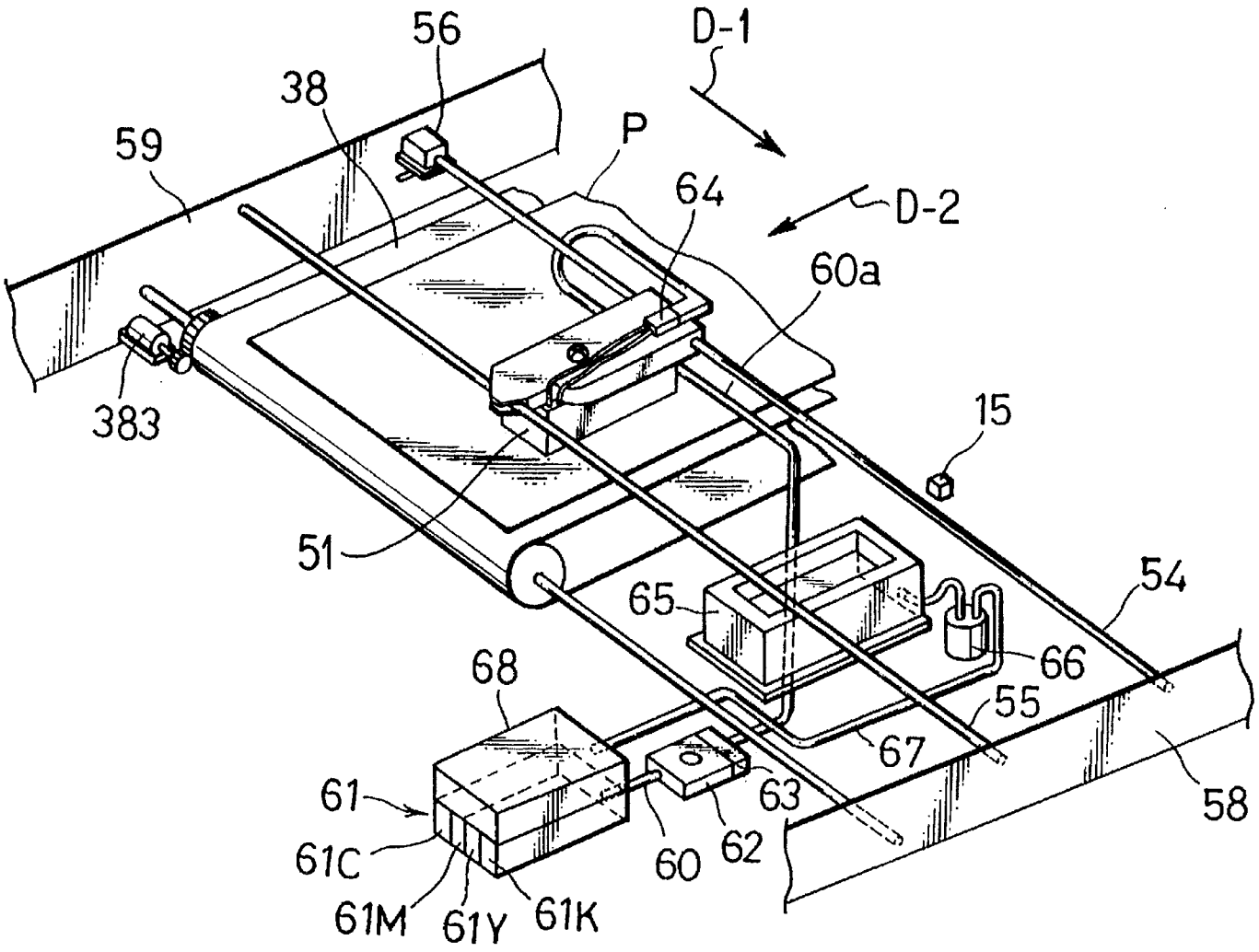
FIG. 2 is a perspective view showing a construction of a printing portion of the first apparatus.

The transport belt 38 is an endless belt stretched around transport rollers 381 and 382. As shown in FIG. 2, the transport belt 38 is driven by a transport belt motor 383, and adapted for advancing the printing sheet P which has been transported into the printing portion 11. The transport belt 38 holds the printing sheet P by an electrostatic or air vacuum attraction to transport the printing sheet P in the forward direction. There is provided a discharge roller 39 downstream of the transport belt 38 to discharge the printing sheet P transported by the transport belt 38 to a discharge tray 29.

At an immediate upstream of the transport belt 38 is disposed a sheet detecting sensor 14, e.g., photo-reflecting type sensor, to detect a leading end of the printing sheet P being transported.

A construction of the printing portion 11 will be described next with reference to FIGS. 1 to 3D. The printing portion 11 includes a printing head 51, a carriage 52 carrying the printing head 51, a driver mechanism for reciprocally moving the carriage 52 in widthwise directions of the transported printing sheet P, an ink supply system for supplying ink to the printing head 51, and an ink pressure stabilizer for stabilizing the ink pressure of the printing head 51.

The printing head 51 has a nozzle portion 511 where a number of nozzle units are arrayed in lines and a support frame 516 holding the nozzle portion 511. Each nozzle unit includes a large number of minute nozzles which are arranged in the form of a matrix. Each nozzle is provided with a piezoelectric conversion element to control ink emission. Minute nozzles may be arranged in a zigzag or in a line other than a matrix.

Figure 3B:
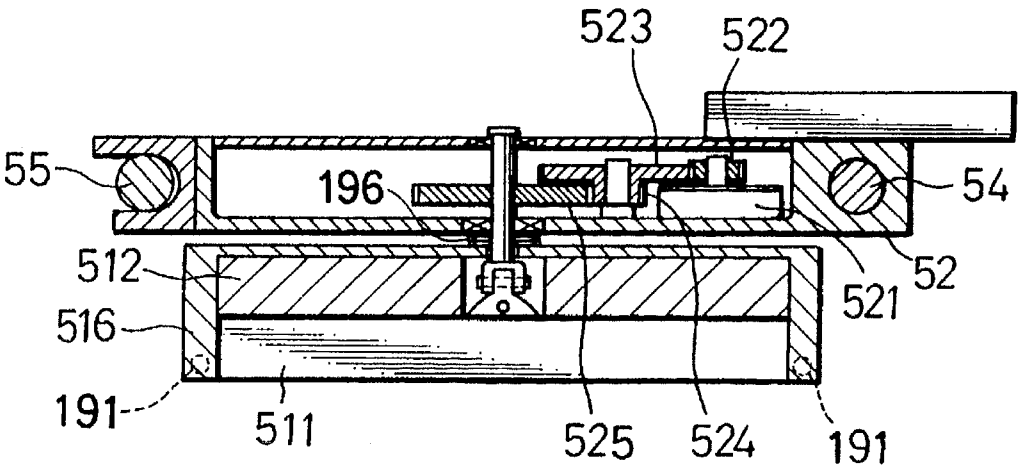
FIG. 3B is a sectional view taken along the line IIIB—IIIB in FIG. 3A.
Figure 3A:
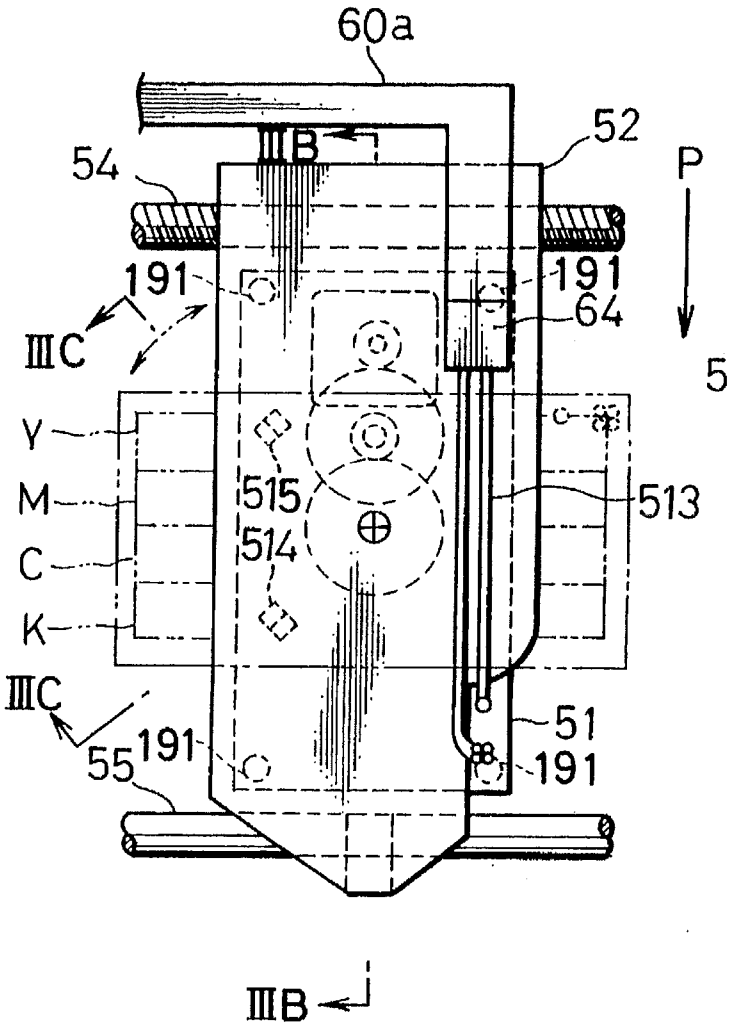
FIG. 3A is a top plan view showing a printing head mounted on a carriage of the printing portion.

In this embodiment, as shown in FIG. 3A, the nozzle portion 511 has four arrays of nozzle units 51C, 51M, 51Y, and 51K adapted for emitting inks having the color of cyan (C), magenta (M), yellow (Y), and black (K), respectively. Also, each nozzle unit array has a length equal to the short side of the A4-sized printing sheet.

These inks are superimposedly emitted onto the printing sheet P to thereby print a colored image on the printing sheet P. The nozzle portion 511 may be provided with an array of nozzle units 51K which emit ink having the color of black (K) to print a black monochromatic image on the printing sheet P. Also, each nozzle unit array has the same length as the shorter side of the A-4 sized printing sheet.

The ink emission of each nozzle is controlled by a driving circuit 512 including a latch portion. The driving circuit 512 receives and temporarily latches an image signal which has been sent through a signal line 513 from the image generator (not shown). The image signal is a serial signal in the form of one bit or a plurality of bits, e.g. eight-bits. The driving circuit 512 then converts the latched serial signal to parallel signals, and sends the parallel signals to the piezoelectric conversion elements provided in the nozzles of the nozzle portion 511 in synchronism with one another.

More specifically, each nozzle has an ink reservoir whose wall is partially defined by the piezoelectric conversion element. The piezoelectric conversion element is strained by applied voltage to increase the internal pressure of ink in the reservoir to emit the ink out of the nozzle. For example, in the case of receiving the image signal in the form of one bit, the driving circuit 512 sends a parallel drive signal having the two states of "on" and "off" to the piezoelectric conversion element of the corresponding nozzle. In the "on" state, the piezoelectric conversion element is applied with a specified level of voltage to increase the pressure of the reservoir, so that a stream of ink forcibly spouts onto the printing sheet P out of the nozzle. In this way, one line of an image is printed each time the image signal corresponding to the line is sent to the driving circuit 512. These one-line printings are successively repeated to complete the whole image printing.

The carriage 52 carries the printing head 51 with a stem shaft 53. The printing head 51 is pivotally rotatable about the axis 53*a* (FIG. 3C) of the stem shaft 53. The carriage 52 is supported on a screw shaft 54 and a slide shaft 55 which extend in a widthwise direction of the transport belt 38. The screw shaft 54 meshes with a threaded hole 520*a* formed in one end of the carriage 52. The slide shaft 55 passes a guide groove 520*b* formed in the other end of the carriage 52. The carriage is reciprocally moved along the shafts 54 and 55.

One end of the screw shaft 54 is operationally connected with a stepping motor 56 at one end thereof while the other end is rotatably supported on a side wall 58 of a main body of the ink jet printing apparatus. The stepping motor 56 is driven by drive pulse signals sent from a control portion. The slide shaft 55 is fixedly supported on the side wall 58 and a side wall 59 of the main body of the ink jet printing apparatus.

The stepping motor 56 drivingly rotates the screw shaft 54 to move or feed the carriage 52. The moving amount and moving speed of the carriage 52 are controlled by changing the pulse number or width of the drive signal sent to the stepping motor 56.

In this embodiment the carriage 52 is made to have a width identical with the width of the printing head 51 to eliminate an unnecessary movement range for the carriage 52. This will assure a small-sized ink jet printing apparatus.

The carriage 52 is further provided with a stepping motor 521. The stepping motor 521 is similarly driven by a drive pulse signal from the control portion. The stepping motor 521 rotates the printing head 51 about the stem shaft 53. Specifically, the rotational force of the stepping motor 521 is transmitted to a gear 523 by way of a gear 522 attached on a drive shaft of the stepping motor 521, and then transmitted to a gear 525 coaxially mounted on the stem shaft 53 by way of a gear 524 which is rotated together with the gear 523.

Figure 3C:
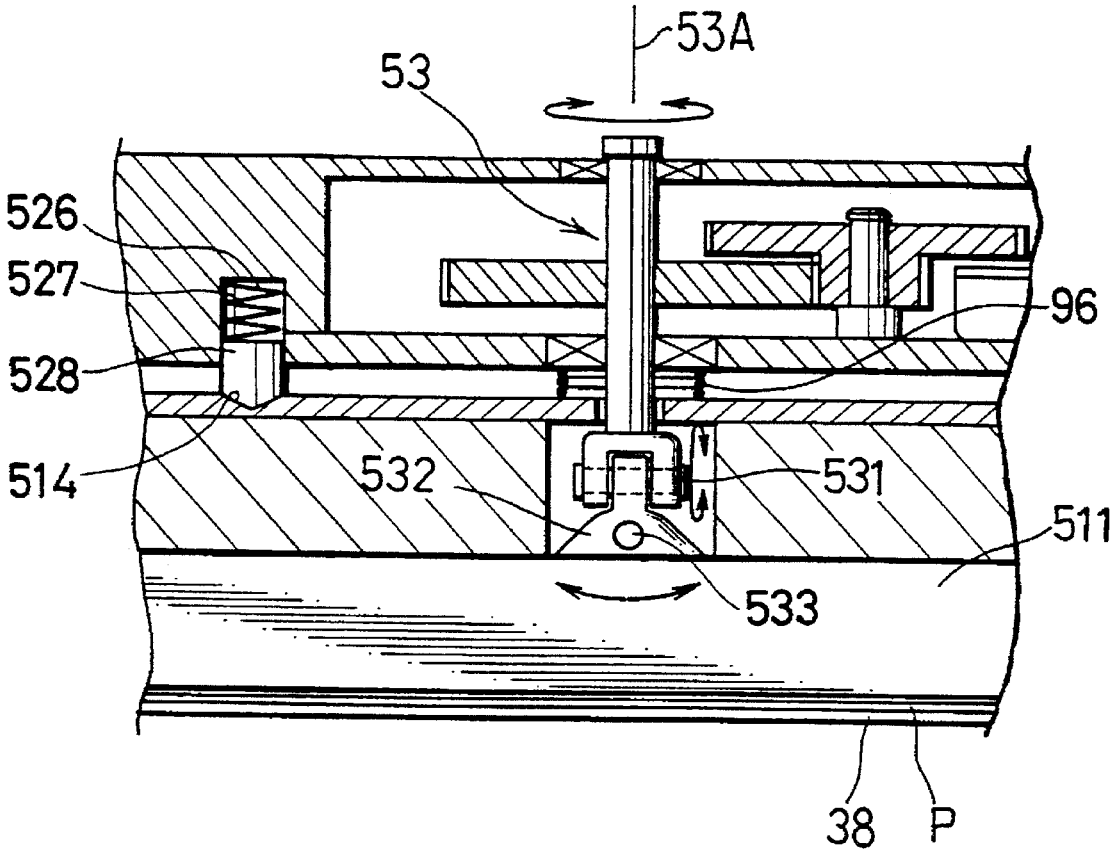
FIG. 3C is an enlarged fragmentary sectional view taken along the line IIIC—IIIC in FIG. 3A.

As shown in FIGS. 3B and 3C, a lower end of the stem shaft 53 is connected with the printing head 51 by a connecting rod 531, a connecting plate 532, and a connecting rod 533. The connecting rod 531 extends in parallel with the nozzle arrays and pivotally connects the connecting plate 532 with the stem shaft 53. The connecting rod 533 is attached to the support frame 516 of the printing head 51 and extends perpendicular to the nozzle arrays. The connecting rod 533 pivotally connects the connecting plate 532 with the support frame 516.

Accordingly, the printing head 51 is rotatable about the stem shaft 53, that is, rotatable in a horizontal plane. Also, the printing head 51 is rotatable about the connecting rod 531, that is, rotatable in a vertical plane perpendicularly intersecting the nozzle arrays. Further, the printing head 51, is rotatable about the connecting rod 533, that is, rotatable in a vertical plane parallel intersecting the nozzle arrays.

Figure 3D:
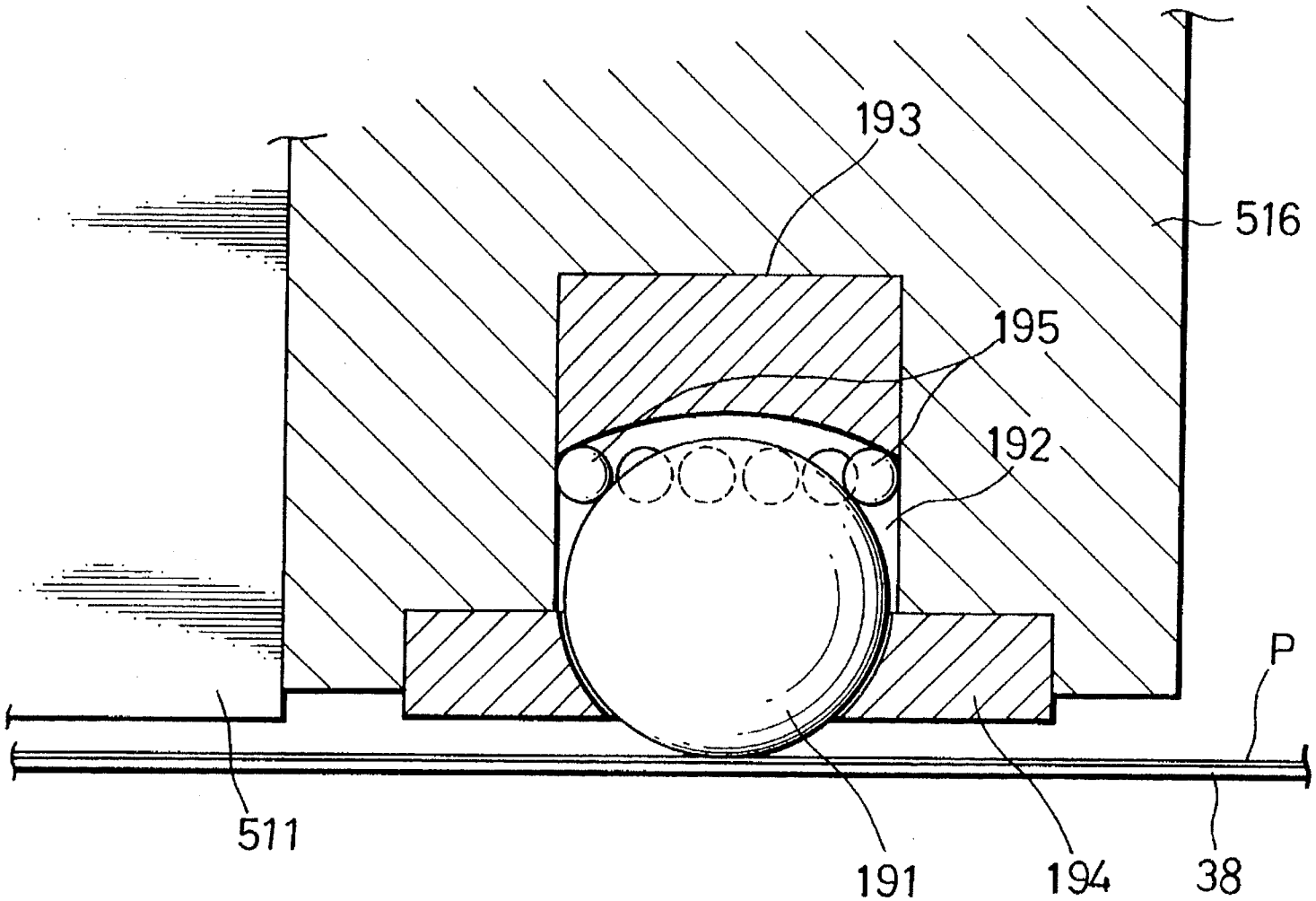
FIG. 3D is an enlarged fragmentary sectional view showing a spacer ball provided in the printing head.

The stem shaft 53 mounted on the carriage 52 can keep the nozzle portion 511 of the printing head 51 to be spaced from the printing sheet P at a desired spacing. However, to assure a constant spacing between the nozzle portion 511 and the printing sheet P, it will be appreciated to provide the printing head 51 with four spacer member 191 in the form of a ball 191 at four lower corner portions of the support frame 516. As shown in FIG. 3D, the spacer bail 191 is placed in a recess 192 formed in the underside of the support frame 516 and is retained in the recess 192 by a retaining plate 194. A resilient member 193 is provided above the spacer ball 191 to render a portion of the spacer ball 192 project downward slightly from the underside surface of the retaining plate 194 and the underside surface of the nozzle portion 511 so as to keep the printing heads from coming into contact with the printing sheet P. Further, a number of small balls 195 are provided between the spacer ball 191 and inner walls of the recess 192 to ensure the spacer ball 191 to freely rotate.

Further, a spring 196 is provided between the printing head 51 and the carriage 52. The spring 196 has a relatively small biasing force to urge the printing head 51 toward the printing sheet P. Accordingly, the combination of the spacer balls 191 and the spring 196 will keep a constant gap, e.g., 0.5 mm, between the nozzle portion 511 and the printing sheet P even if the thickness of printing sheet P changes.

It may be appreciated to electrostatically attract or vacuumedly draw the printing sheet P onto the transport belt 38 to eliminate the likelihood that the printing sheet is wrinkled by the spacer balls 191. Also, it may be appreciated to use quick drying ink to eliminate the likelihood of printed lines being smeared by spacer balls 191 during the reciprocal movement of the printing head 51. Further, it may be appreciated to provide an air blower on the printing head 51 to direct air streams to the printing sheet surface to dry printed lines.

The top surface of the support frame 516 is formed with V-shaped recesses 514, 515. The recesses 514, 515 are arranged on a circular locus of a particular position on the top surface of the printing head 51 rotating about the stem shaft 53. The recesses 514 and 515 are spaced away from each other by 90°. On the other hand, the carriage 52 is formed with a recess 526 in an underside surface thereof. The recess 526 is spaced away in a radial direction from the stem shaft 53 by the same distance as the recesses 514 and 515. In the recess 526 is provided a stopper 528 and a spring 527 pushing the stopper 528 downward. The stopper 528 is formed with slanting surfaces engageable with the V-shaped recesses 514, 515.

In the state where the printing head 51 is placed in such a position that the nozzle arrays are parallel with the printing sheet transport direction shown by solid lines in FIG. 3A, the stopper 528 engages the V-shaped recess 514 as being biased by the spring 527 as shown in FIG. 3C. On the contrary, in the state where the printing head 51 is placed in such a position that the nozzle arrays are perpendicular to the printing sheet transport direction as shown by phantom lines in FIG. 3A, the stopper 528 engages the V-shaped recess 515.

In this way, the printing head 51 can be selectively set at the two positions, that is, the parallel position with the printing sheet transport direction and the perpendicular position to the printing sheet transport direction, which are spaced away from each other on the circular locus by 90°. The setting state can be retained by the biasing force of the spring 527.

Further, it may be appreciated to provide a stopping mechanism similar to the stopping mechanism of the V-shaped recesses 514, 515, stopper 528, and the spring 527 in another position to increase the retaining force.

The ink supply system will be described next with reference to FIG. 2. Ink is supplied from an ink cartridge 61 via an ink supply tube 60 to the printing head 51.

The ink cartridge 61 includes cartridges 61C, 61M, 61Y, and 61K sealed containing ink having the color of cyan, magenta, yellow, and black, respectively. The ink supply tube 60 has a needle member at an upstream end. The ink supply tube 60 is connected with the ink cartridge 61 by inserting the needle member into the ink cartridge 61.

In the case of supplying the four kinds of ink of cyan, magenta, yellow, and black, the ink supply tube 60 is used which is a bundle of four thin tubes for supplying the four inks separately. In the case of supplying the black ink only, the ink supply tube 60 is used which is a single tube for supplying the black ink.

A downstream portion **60*a* of the ink supply tube 60 is made of a soft synthetic resin. The downstream portion 60*a* is adhered on a flexible strip combining a number of signal lines 513. The flexible downstream portion 60*a* has a length sufficient to follow the reciprocal movement of the printing head 51**.

Also, at an upstream portion of the ink supply tube 60 is provided a detector 62 for detecting the ink remaining amount of the ink cartridge 61. If the amount of ink remaining in the ink cartridge 61 falls below a predetermined level, the necessity of replacement of new ink cartridge is warned on the display unit 85. A filter 63 is provided at a downstream of the detector 62 to eliminate foreign matters from being supplied.

A pressure stabilizer 64 is provided on the top surface of the carriage 52 and connected to a downstream end of the ink supply tube 60. The stabilizer 64 absorbs abrupt changes in the ink pressure which are likely to occur due to the inertia force of the ink in the ink supply tube 60 during the reciprocal movement of the carriage 52 to eliminate bubbles and variations in the ink pressure and emitting ink amount.

Further, there is provided an emission maintenance device including an enclosure unit 65 and a pump 66. The enclosure unit 65 is provided below a home position of the carriage 52. The enclosure unit 65 is adapted for enclosing the printing head 51 to prevent the ink from drying or solidifying, foreign matter from entering the ink through the nozzle. The enclosure unit 65 has a number of passages which are able to communicate with the corresponding nozzles. The enclosure unit 65 is reciprocally moved in vertical directions by a motor 84. When the carriage 52 is returned at the home position after the printing, the enclosure is elevated to the printing head 51 so that the nozzles of the printing head 51 communicate with the passages formed in the enclosure unit 65. When starting the printing, the enclosure unit 65 is moved downward away from the printing head 51.

A reflecting type photosensor 15 is provided near the home position of the carriage 52 to detect whether the carriage 52 is returned to the home position.

The carriage 52 is returned to the home position at a specified interval. At the home position, the ink is forcibly emitted through all the nozzles to prevent less frequently used nozzles from clogging. The home position emission may be performed either in the state of the enclosure unit 65 enclosing the printing head 51 or in the state of the enclosure unit 65 not enclosing the printing head 51.

The pump 66 is communicated with the passages formed in the enclosure unit 65 to reduce the ink pressure or give a pressure and adjust the meniscus of the ink in the nozzle when the passages of the enclosure unit 65 communicate with the nozzles of the printing head 51. Also, the pump 66 draws the ink to eliminate foreign matters and bubbles and maintain the specified emission conditions.

The ink which has been drawn by the pump 66 is flowed to a waste tank 68 by way of a tube 67. The waste tank 68 is provided with an ink absorber to absorb the drawn ink.

Figure 4:
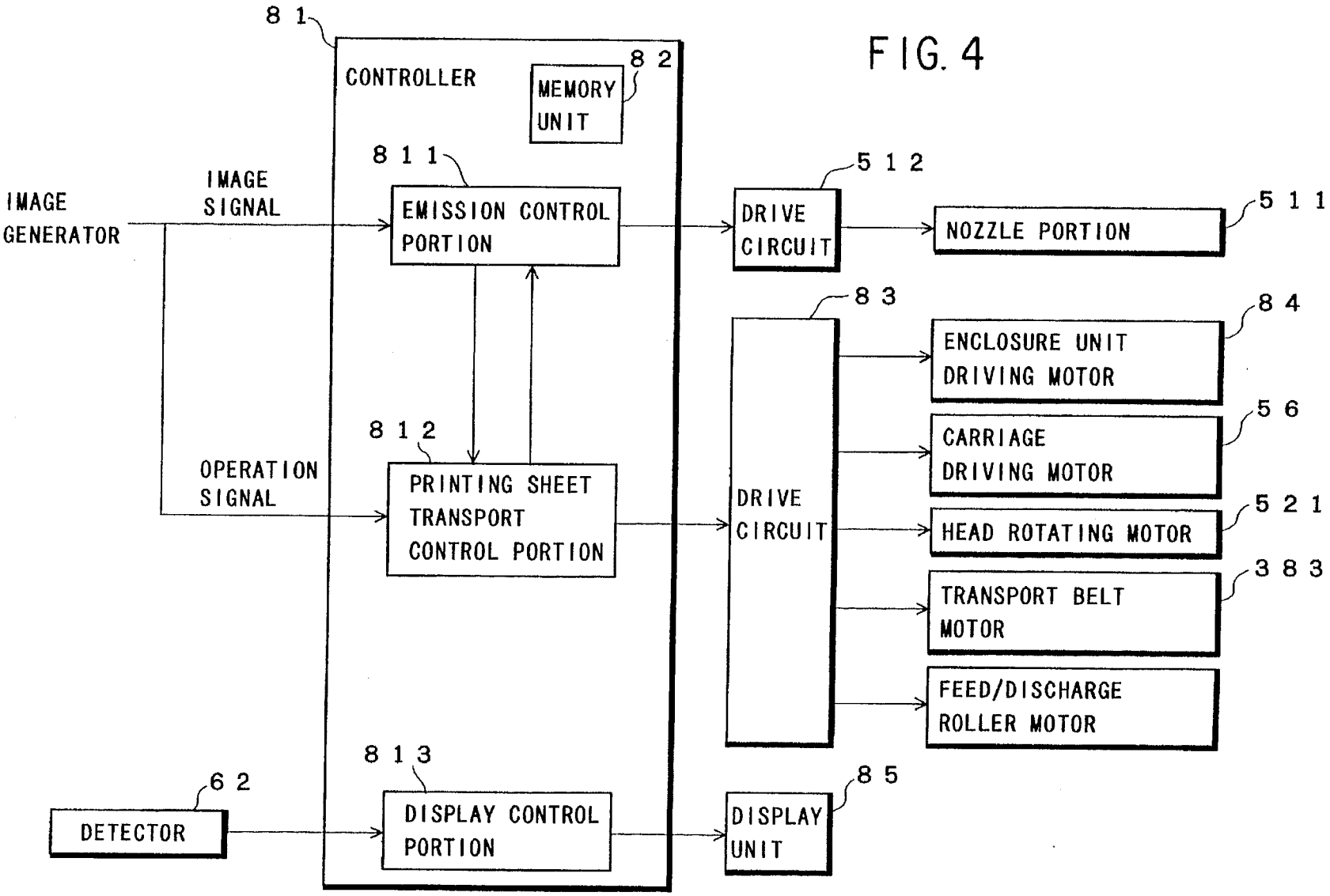
FIG. 4 is a block diagram showing a control system of the first apparatus.

A control system of the ink jet printing apparatus will be described next with reference to a block diagram in FIG. 4.

The ink jet printing apparatus is communicated with the image generator such as a personal computer, and operates in accordance with an operation signal and an image signal sent from the image generator.

The control system of the ink jet printing apparatus is provided with a controller 81 including a microcomputer. The controller 81 has an emission control portion 811, a printing sheet transport control portion 812, and a display control portion 813. The controller 81 is internally provided with a memory unit 82. The memory unit 82 includes an ROM (Read Only Memory) for storing a control program and an RAM (Random Access Memory) for temporarily storing image data.

The image generator generates an image signal and an operation signal. The image signal is sent to the emission control portion 811. The operation signal indicative of a sheet size, a printing mode to be described later, and the like is sent to the printing sheet transport control portion 812. The printing sheet transport control portion 812 generates a command signal to the emission control portion 811 in accordance with an inputted printing mode. The emission control portion 811 and the printing sheet transport control portion 812 mutually and synchronously control various operations of the ink jet printing apparatus.

The emission control portion 811 serially transmits the inputted image signal via the line 513 to the drive circuit 512 where the serial signal is converted to parallel signals. The parallel signals are sent to the piezoelectric conversion elements in the nozzles of the nozzle portion 511 in synchronism with the operation of the printing sheet transport control portion 812, to thereby control the ink emission. The period of ink emission, namely, period of outputting parallel signals to the piezoelectric conversion elements, is set in accordance with an inputted printing mode.

The printing sheet transport control portion 812 sends a control signal to the drive circuit 83 which in turn drives the printing sheet transport assembly 13 to transport a printing sheet from a specified cassette. At the same time, the drive circuit 83 controlledly drives the enclosure unit driving motor 84, carriage driving motor 56, head rotating motor 521, and transport belt motor 383.

In this embodiment, the following two printing modes can be set: the first or large-size printing mode and the second or high speed printing mode.

The first or large-size printing mode is suitable for the case where a printing image has a width larger than the shorter side of A4-size printing sheet, that is, the length of the nozzle array of the printing head 51. In the first or large-size printing mode the transport belt motor 383 is intermittently driven to transport the printing sheet by a specified distance. In other words, the transporting and staying of the printing sheet are alternately executed at a specified interval. During the time of the printing sheet being stayed, the carriage 52 is moved by the carriage driving motor 56 to execute printing of one-line.

In the first or large-size printing mode, ink is emitted while the printing head 51 is moved. The ink pressure changes with the movement of the printing head 51 because the bending portion of the ink supply tube 60*a* shifts with the movement of the printing head 51. Accordingly, the moving speed of the printing head 51 cannot be increased beyond a particular speed to keep the fluctuation of pressure within a specified limit. However, the printing mode can be moved beyond the length of the nozzle array. Accordingly, the large-size printing mode enables printing of large-sized image.

On the other hand, the second or high-speed printing mode is suitable for the case where a printing image has a width equal to or shorter than the shorter side of A4-size printing sheet, that is, the length of the nozzle array of the printing head 51. In the high-speed printing mode, a printing image is printed on a printing sheet by staying the printing head 51 at a specified position while transporting the printing sheet.

Specifically, when the second high-speed printing mode is selected, the printing head rotating motor 521 is driven to rotate the printing head 51 by 90° and sets the nozzle array of the printing head 51 in a direction perpendicular to the printing sheet transport direction. The carriage 52 is fixed at the specified position on the reciprocal movement range of the carriage. The printing sheet is transported at a constant speed by the transport belt 38 which is driven by the transport belt motor 383.

In the second or high-speed printing mode, the printing sheet is continuously transported at a constant speed. This will make it possible to complete the printing at higher speed than the first or large-size printing mode where the printing sheet is intermittently transported. In the second or high-speed printing mode, also, the printing head 51 is stayed in the specified position during the printing, and the supply tube 60*a* is retained in a fixed posture. There will be no fluctuation in the ink pressure. Accordingly, the printing speed can be further raised by shortening the ink emission period and increasing the printing sheet transporting speed.

The display control portion 813 receives detection signals indicative of the ink remaining amount of the ink cartridge 61, the absence of printing sheet in each cassette and the like, and causes the detection results to be displayed on the display unit 85.

Further, it may be appreciated to provide the display unit 85 near an input key portion to set the number of printing sheets, the size of printing sheet, the printing mode and the like, and render the display unit 85 display set conditions in addition to the detection results.

Figure 5:
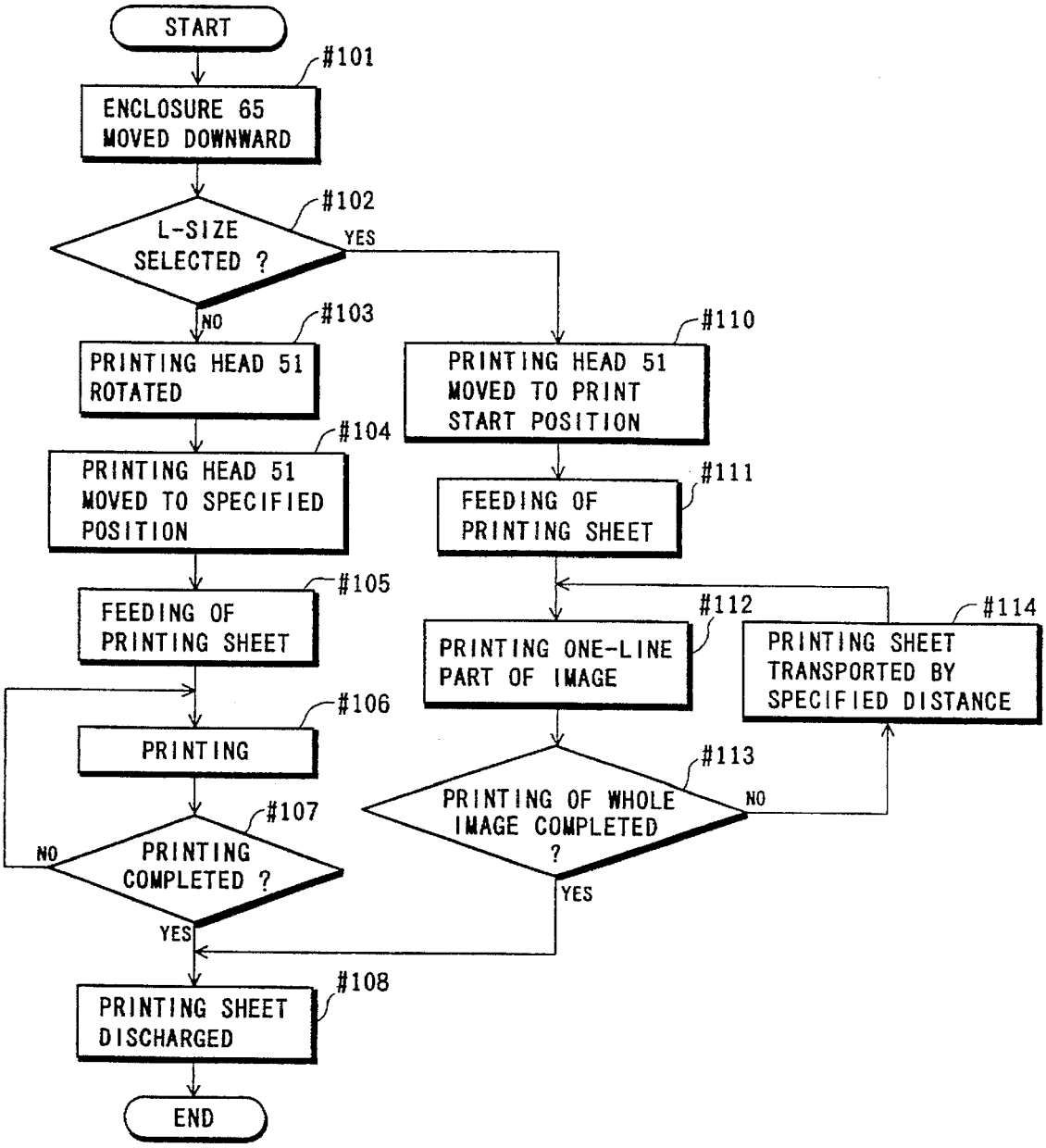
FIG. 5 is a flowchart showing a printing operation of the first apparatus.

A printing operation of the ink jet printing apparatus will be described with reference to a flowchart of FIG. 5 showing operation procedures of the ink jet printing apparatus.

Upon printing being instructed, the enclosure 65 is moved downward and retracted from the printing head 51 (Step #101). It should be noted that the printing head 51 is initially set in the position parallel to the printing sheet transport direction which is the position shown in FIG. 2.

Subsequently, a printing mode is selected based on an operation signal sent from the image generator (Step #102). Specifically, in the case that an image is printed on a printing sheet having a width equal to or shorter than the shorter side of A4-size printing sheet, the high-speed printing mode is selected. On the second or other hand, in the case that an image is printed on a printing sheet having a width larger than the shorter side of A4-size printing sheet, the first or large-size printing mode is selected.

In Step #102, when the second or high-speed printing mode is selected, the printing head 51 is rotated by 90° that is, 90° from the position shown in FIG. 2, and the nozzle arrays are set in the position perpendicular to the printing sheet transport direction (Step #103).

Subsequently, the printing head 51 is moved to the specified position just below which the printing sheet is to be transported (Step #104). Alternatively, the printing head 51 may be first moved to the specified position and then rotated to the position perpendicular to the printing sheet transport direction.

After the printing head 51 being set at the specified position, the printing sheet is fed out of the cassette and transported to the transport belt 38 (Step #105). The printing head 51 prints the image on the printing sheet which is being continuously transported at a specified constant speed in the direction D-1 by the transport belt 38 (Step #106). When the printing is completed (YES in Step #107), the printing sheet is discharged (Step #108). Consequently, this routine ends.

On the contrary, when the first or large-size printing mode is selected in Step #102, the printing head 51 is moved to a start position (Step #110). In this case, the printing head 51 and nozzle arrays are held in the position shown in FIG. 2 parallel with the printing sheet transport direction.

The printing sheet is fed out of the cassette and transported to the transport belt 38 (Step #111). The transport belt 38 transports the printing sheet to a specified position and stops the transporting to keep the printing sheet at the position. Thereafter, the printing head 51 is moved at a constant speed in the widthwise direction D-1 of the printing sheet from the start position while emitting ink in accordance with parallel image signals, consequently printing one-line part of the image (Step #112).

In Step #113, it is judged whether the printing of the whole image is completed. If the printing of the whole image is not finished (NO in Step #113), the printing sheet is transported by a specified distance corresponding to one line part (Step #114). In this time, the printing head 51 is returned to the start position. Thereafter, the printing head 51 is again moved in the widthwise direction D-1 while emitting ink in accordance with parallel image signals, to thereby print next one-line part of the image (Step #112). These operations of Steps #112 to #114 are repeated to complete the whole image printing. After the whole image being printed (YES in Step #113), the printing sheet is discharged (Step #108). Each movement of the printing head 51 in a width wide direction D-1 while emitting ink in accordance with parallel image signals is referred to as a sub-operation.

As described above, there are the two printing modes which are selectively changeable depending on the size of printing image or printing sheet. In the case of printing a small-sized image, the second or high-speed printing mode is selected to print the small-sized image at a high speed. Also, in the case of printing a large-sized image, the first or large-size printing mode is selected to enable printing of the large-sized image.

Also, the printing mode can be easily changed by merely rotating the printing head 51 by 90° without actuating the other parts.

Figure 6:
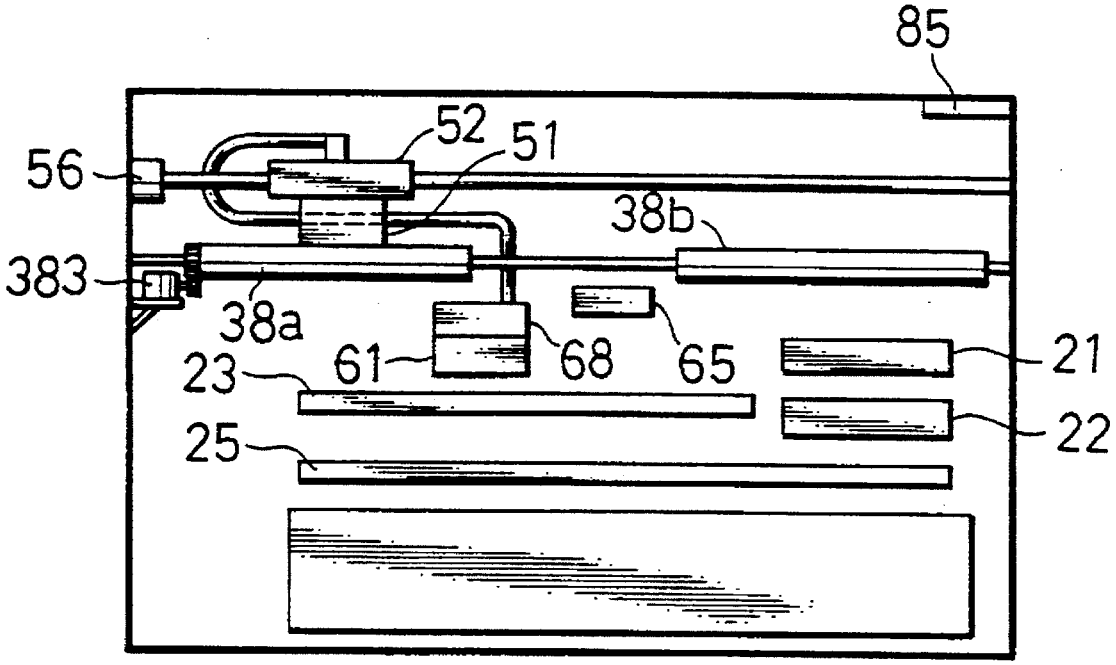
FIG. 6 is a diagram schematically showing a front view of an overall construction of a second ink jet printing apparatus according to the present invention.
Figure 7:
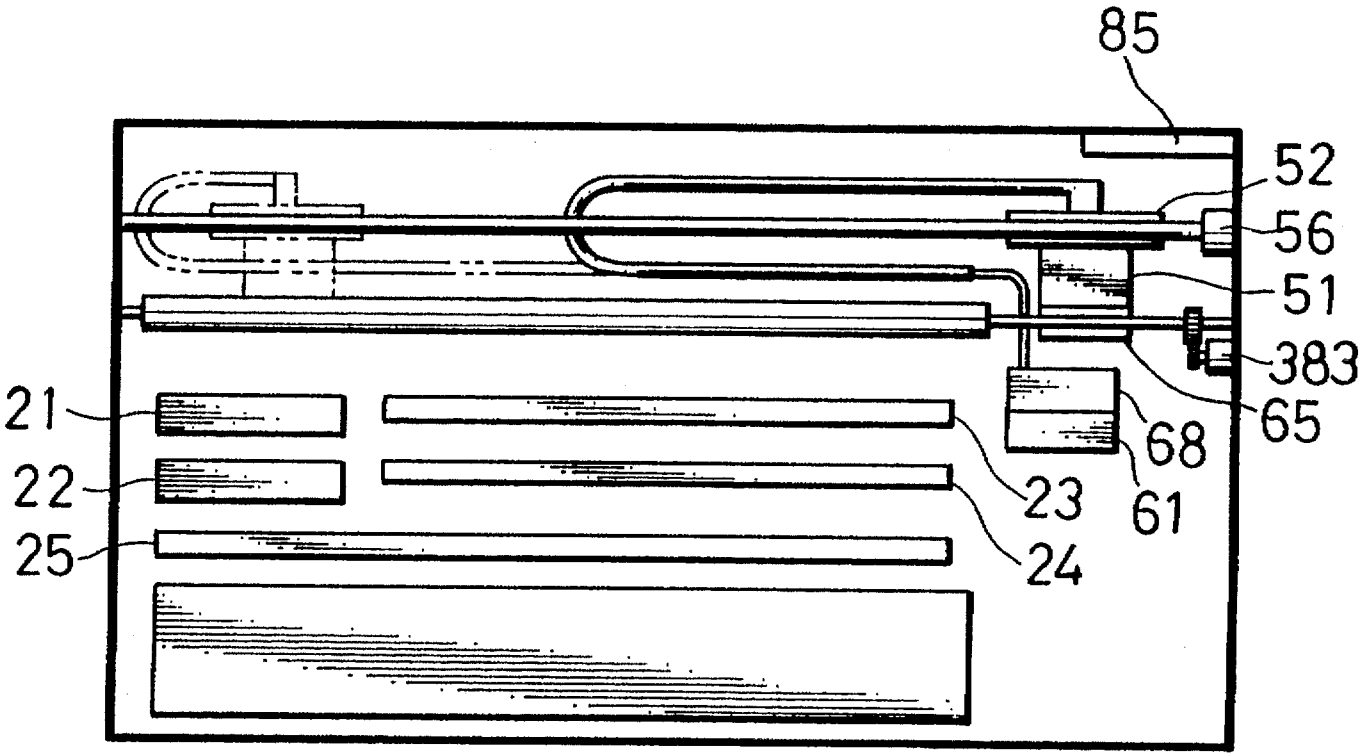
FIG. 7 is a diagram schematically showing a front view of an overall construction of a third ink jet printing apparatus according to the present invention.
Figure 8B:
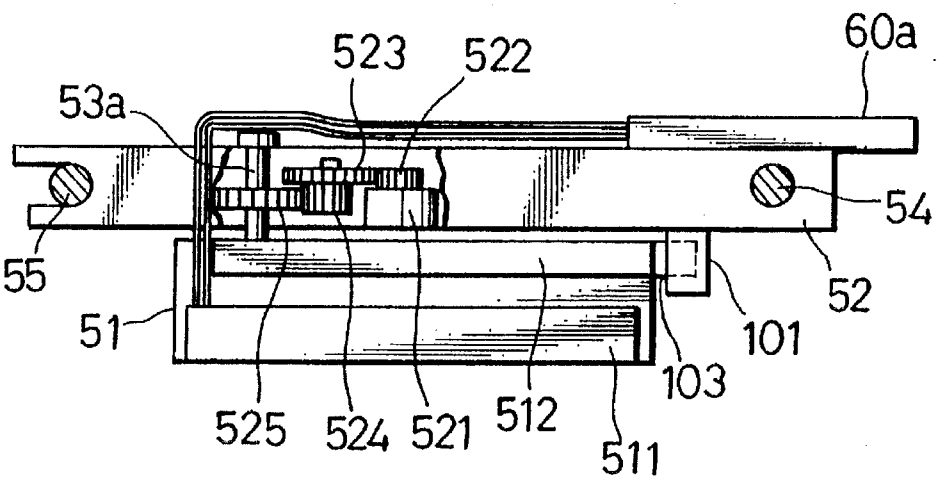
FIG. 8B is a side view showing the carriage carrying the printing head.
Figure 8A:
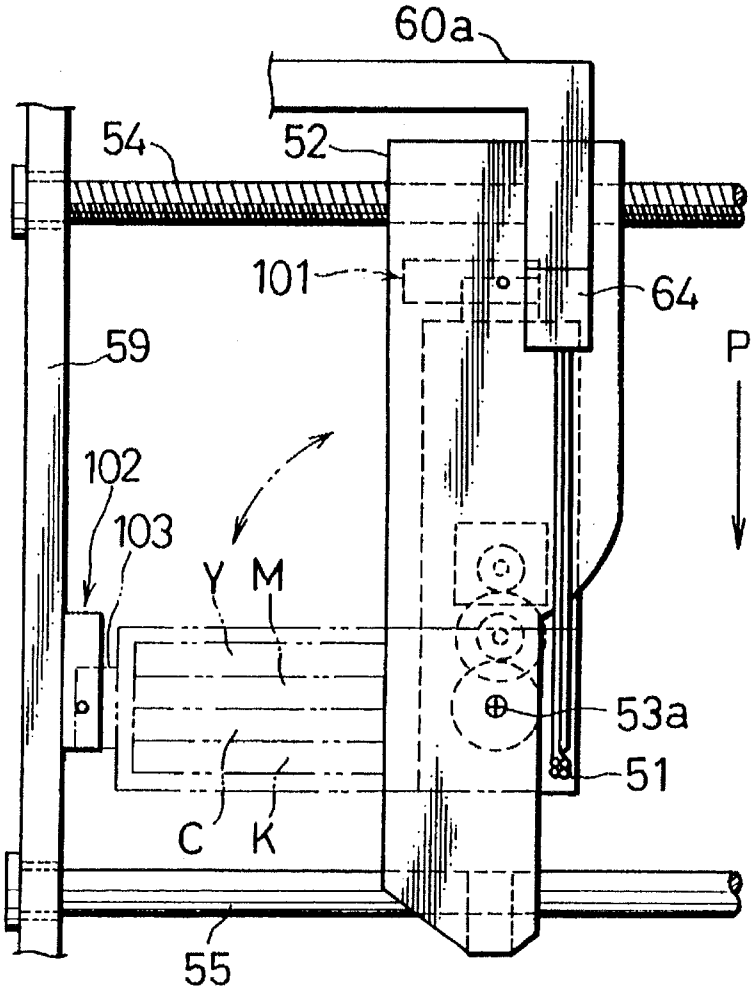
FIG. 8A is a top plan view showing a carriage carrying a printing head in the third apparatus.
Figure 9A:
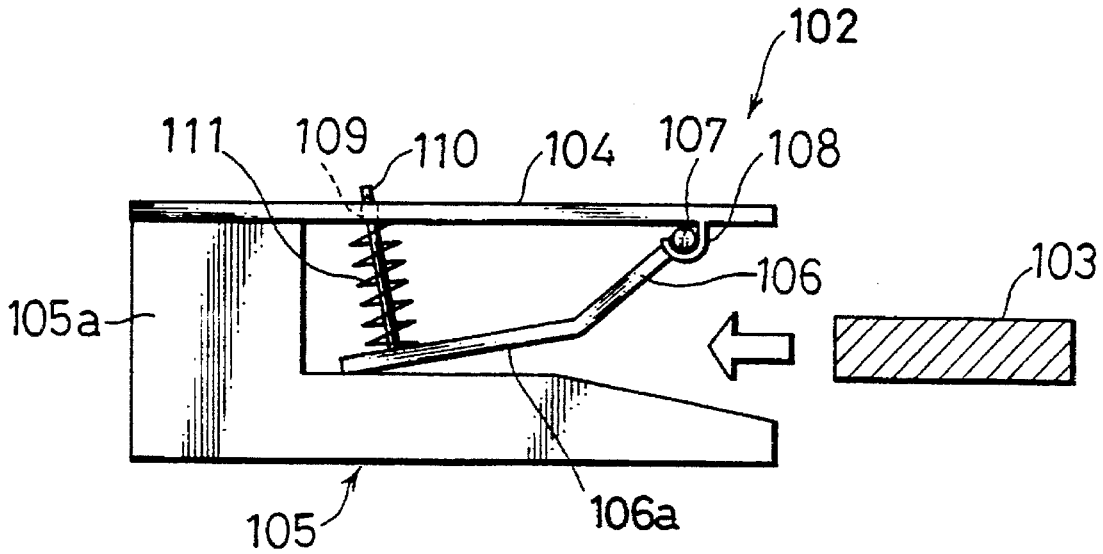
FIGS. 9A and 9B are side views showing a printing head holding device used in the third apparatus.
Figure 9B:
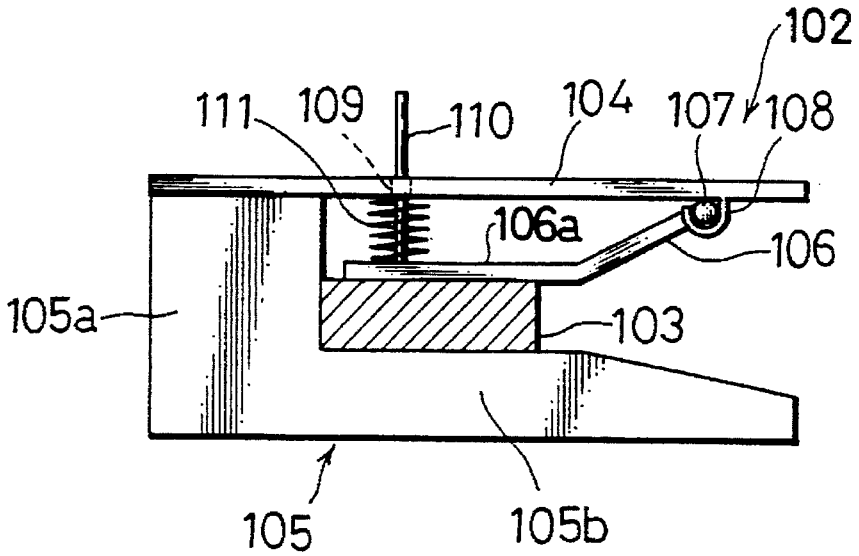

FIG. 6 schematically shows a second ink jet printing apparatus of the present invention. In FIG. 6, parts identical to those of the first ink jet printing apparatus are indicated at the same reference numerals. The second ink jet printing apparatus is basically identical with the first ink jet printing apparatus except for the fact that two transport belts 38*a* and 38*b* are separately arranged in parallel with each other at a specified space, and an enclosure unit 65 is provided below the space.

The transport belts 38*a* and 38*b* transport a large-sized printing sheet dispensed from a cassette 23 or a cassette 25 while drawing both laterally ends of the transported sheet by air suction, consequently assuredly transporting the large-sized printing sheet in the true course without any skew. Further, the enclosure unit 65 is disposed at a center portion of the ink jet printing apparatus, which will considerably reduce the entire width of ink jet printing apparatus, compared with the first ink jet printing apparatus where the enclosure unit 65 is disposed at one side of the single transport belt 38.

A third ink jet printing apparatus according to the present invention will be described next with reference to FIGS. 7 to 10. In this embodiment, parts identical to those of the first ink jet printing apparatus are indicated at like reference numerals.

Figure 10:
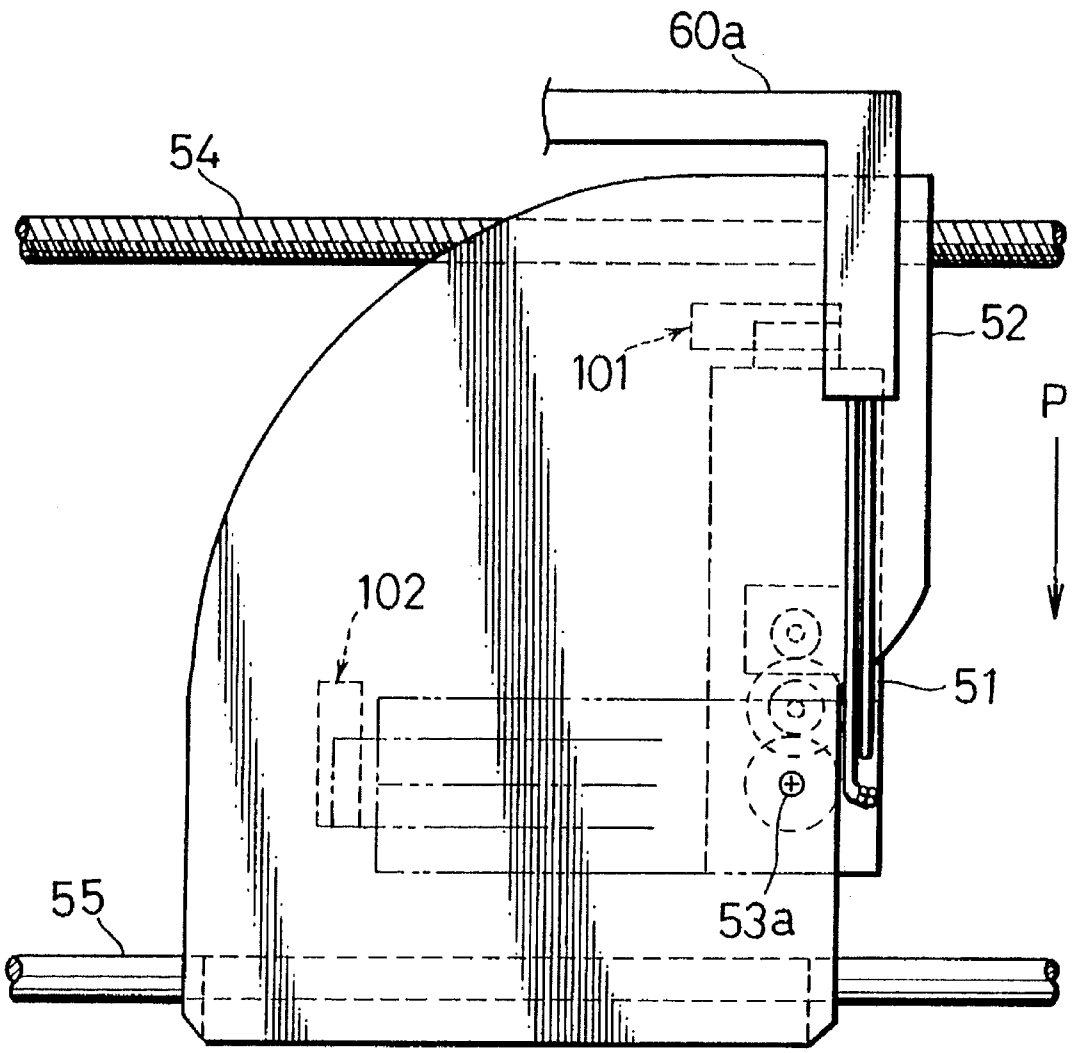
FIG. 10 is a top plan view showing another carriage used in the third apparatus.

In the third ink jet printing apparatus, cassettes 21, 22 each containing a stack of small sized printing sheets are arranged one over another in a left side of a main body of the apparatus as shown in FIG. 10.

A stem shaft 53*a* about which a printing head 51 is to be pivotally rotated is provided at a specified position near one end of the printing head 51 and a carriage 52. The carriage 52 has at the other end thereof a holding device 101 for holding nozzle arrays of the printing head 51 in parallel with the sheet transport direction in the large-size printing mode. It is to be noted that a construction of a rotating mechanism including a printing head rotating motor 521 for rotating the printing head 51 is similar to that described in the first ink jet printing apparatus.

A side wall 59 disposed at a left side of a main body of the third ink jet printing apparatus is provided with a holding device 102 for holding the nozzle arrays of the printing head 51 in a direction perpendicular to the printing sheet transport direction for the high speed printing mode.

Further, the printing head 51 is provided with a projection member 103 at one end thereof. The projection member 103 is supported by the holding device 101 or 102 to bring the printing head 51 in a stationary state.

The holding device 102 includes a top member 104 fixedly secured to the side wall 59, a bottom member 105 having an L-shape in cross section, and a presser 106 provided at a specified position in the top member 104 for pressing the projection member 103 of the printing head 51 against the bottom member 105.

The bottom member 105 has a vertical portion 105*a* extending to the top member 104 and a horizontal portion 105*b* extending from the vertical portion 105*a* in parallel to the top member 104. The vertical portion 105*a* serves as a stopper for stopping the projection member 103 thereat. The horizontal portion 105*b* is formed with a slanting surface in an end to ensure smooth insertion of the projection member 103 in the holding device 102. The top member 104 is provided with a hook 108 to support the presser 106.

The presser 106 is bent at an intermediate portion by a specified angle to form a pressing portion 106*a*. The presser 106 has a pivotal shaft 107 at a base end thereof. The pivotal shaft 107 is fitted in the hook 108 to pivotally support the presser 106 in a space defined by the top member 104 and the horizontal portion 105*b* of the bottom member 105.

The pressing portion 106*a* is positioned parallel to the horizontal portion 105 of the bottom member 105 when the projection member 103 is sandwiched between the bottom member 105 and the presser 106. Further, the pressing portion 106*a* is attached with an upright guide rod 110 passing through a hole 109 formed in the top member 104. A spring 111 is provided around the guide rod 110 to bias the presser 106 toward the bottom member 105.

When the printing head 51 is rotated to hold the projection member 103 between the presser 106 and the bottom member 105, the projection member 103 is pressed against the bottom member 105 by the biasing force of the spring 111 to thereby bring the printing head 51 in a stationary state.

Further, the support member 101 is provided on a specified position of the underside of the carriage 52 in similar to the support member 102 except that in the support member 101, the carriage 52 serves as a top member. When the printing head 51 is rotated, the projection member 103 is securely held in the support member 101 to thereby support the printing head 51 in a stationary state.

As mentioned above, the provision of the support member 102 at the side wall 59 makes it possible to widen the printing range of the head 51 up to a position close to the side wall 59 in the high speed printing mode. Accordingly, a side end space of the apparatus can be utilized more efficiently.

The printing head 51 is reliably supported at the stem shaft 53*a* and one of the two positions of the support members 101 and 102, which consequently prevents printed images from being blurred or deteriorated.

As shown in FIG. 10, further, it may be appreciated to use a carriage 52 having a substantially quarter round shape with a stem shaft 53*a* located at a center thereof and a support member 102 provided at an underside of the carriage 52 instead of at the side wall 59. With this arrangement, the location of the cassettes 21 and 22 is not limited to the left end portion of a main body of the ink jet printing apparatus but can be set at a desired position in the ink jet printing apparatus.

A fourth ink jet printing apparatus according to the present invention will be described with reference to FIGS.

Figure 12:
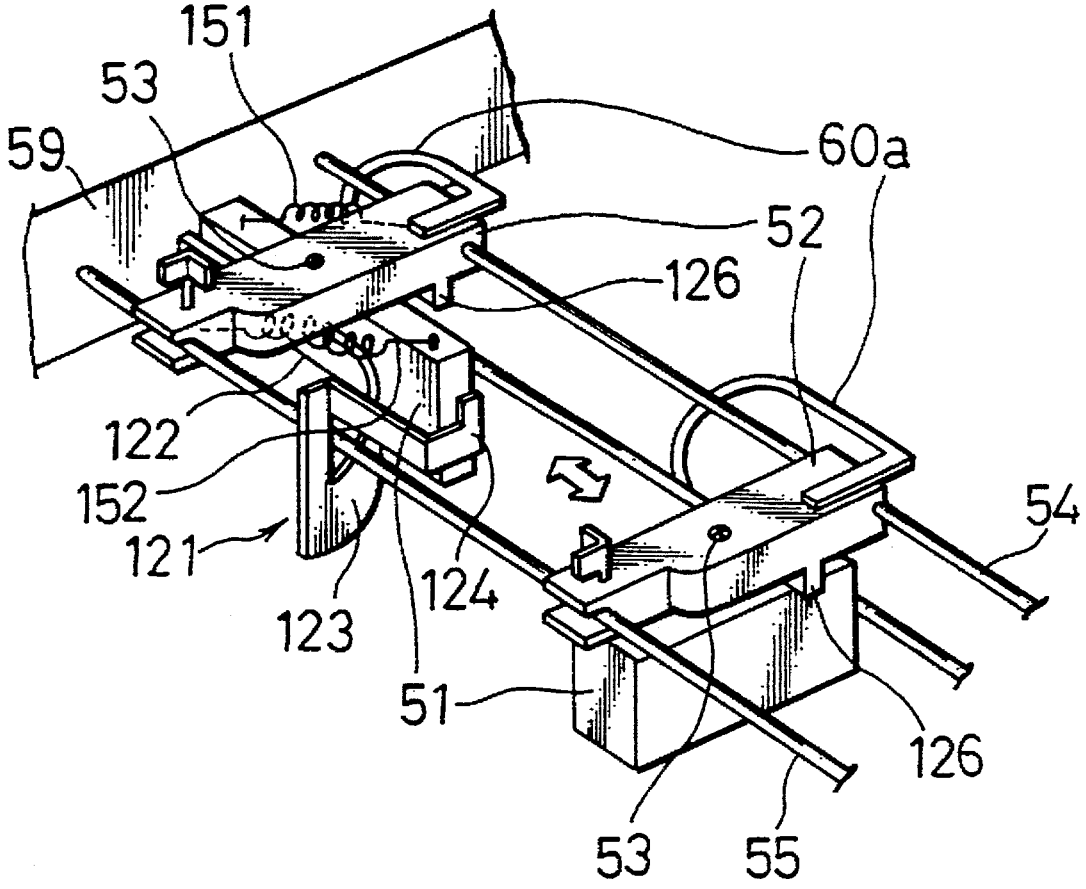
FIG. 12 is a perspective view showing a printing portion of the fourth apparatus.

11 to 14C. Parts identical to those of the first ink jet printing apparatus are indicated at like reference numerals. It should be noted that the fourth ink jet printing apparatus has a single printing head 51 similarly to the foregoing embodiments, for purpose of clear comparison, a high-speed and large-size printing states of the printing head 51 are drawn in the single drawing of FIGS. 12 and 13.

Figure 11:
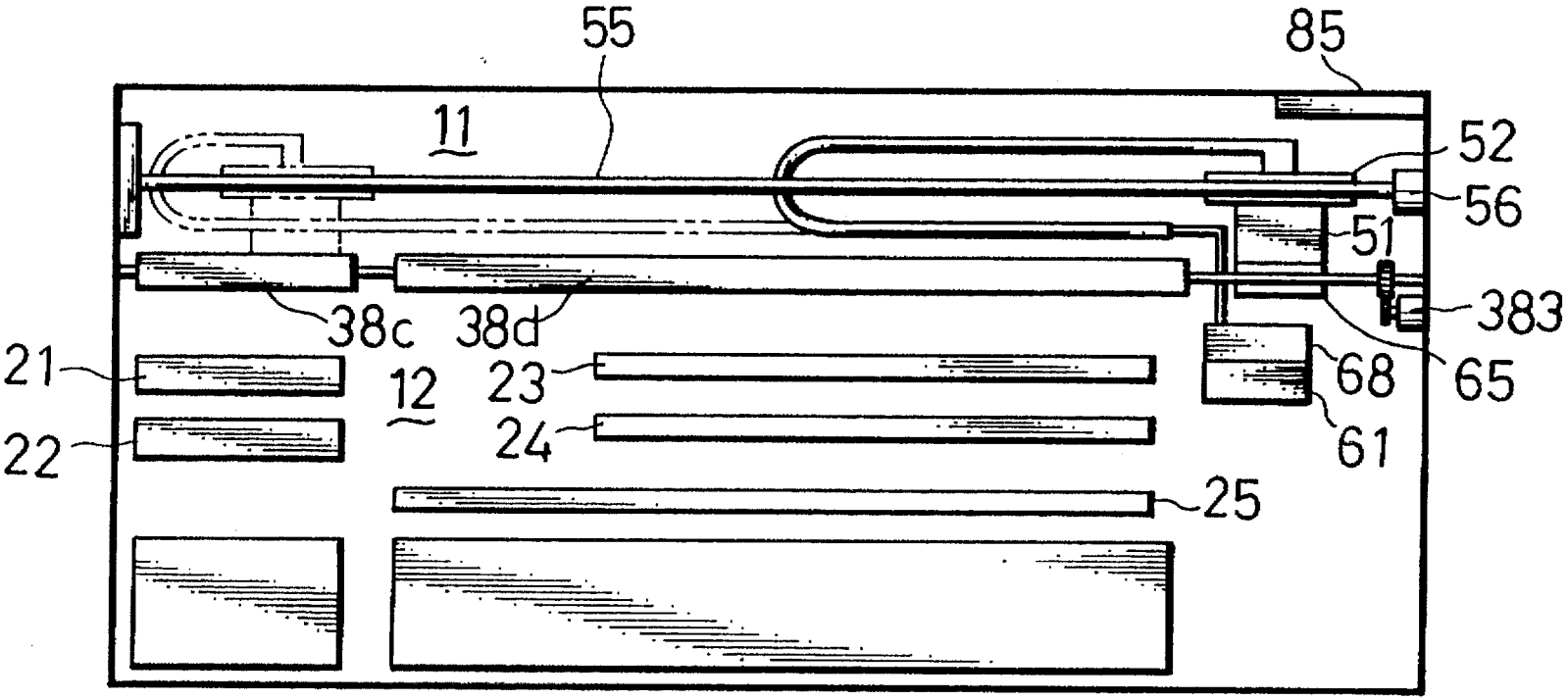
FIG. 11 is a diagram schematically showing a front view of an overall construction of a fourth ink jet printing apparatus according to the present invention.

In the fourth ink jet printing apparatus, a printing sheet transport path from cassettes 21, 22 in the high-speed printing mode and that from cassettes 23, 24, and 25 in the large-size printing mode are formed separately. A transport belt may be constructed, as shown in FIG. 11, by two separate belts 38*c* and 38*d* or may be formed of one belt similar to the arrangement in the first ink jet printing apparatus.

A guide member 121 is provided between screw and guide shafts 54 and 55. The guide member 121 is operable to come into contact with a vertical surface of the printing head 51 to guide a pivotal movement of the printing head 51. The guide member 121 includes a straight portion 122 and a curved portion 123. The straight portion 122 extends from a base end attached on the side wall 59 in parallel to the extending direction of the shafts 54, 55, namely, in a direction perpendicular to the printing sheet transport direction. The curved portion 123 is connected with the straight portion 122. The curved portion 123 has a round surface to gradually change the printing head 51 in a direction perpendicular to the extending direction of the shafts 54, 55, namely, in the printing sheet transport direction.

The guide member 121 is further formed with a contact portion 124. The guide member 121 has a vertical portion extending from a terminal end of the curved portion 123 to a level beyond the top surface of the carriage 52, a horizontal portion extending from an upper end of the vertical portion in the shaft extending direction, and an inward horizontal portion extending in an inward direction perpendicular to the shaft extending direction. The extent of the horizontal portion is greater than a width of a short side of the printing head 51. The contact portion 124 extends in a vertical direction from an end of the inward horizontal portion.

On the other hand, the carriage 52 is formed with a chamber 131 having a cylindrical configuration at a specified position near the screw shaft 55. The chamber 131 is communicated outside the carriage 52 through an upper hole 133 and a lower hole 134. In the chamber 131 is movably provided a retaining member 135.

The chamber 131 is formed with a quarter helical groove 132 in an inner wall thereof. An upper end portion of the quarter helical groove 132 is slanted in a downward direction to form a stopping portion 132*a*.

The retaining member 135 has a cylindrical main body, an upper shaft 136, and a lower shaft 137. The upper shaft 136 and the lower shaft 137 project outward from the upper hole 133 and the lower hole 134, respectively. The cylindrical main body is formed with a round projection 138 engaging with the quarter helical groove 132.

Further, a spring 141 is provided between an upper inner surface of the chamber 131 and a top surface of the cylindrical main body of the retaining member 135. The spring 141 has a relatively small biasing force.

Flag plates 139 and 140 are provided at an upper end of the upper shaft 136. The flag plates 139 and 140 are circumferentially spaced away from each other at a right angle. The flag plates 139 and 140 is operable to come into contact with the contact portion 124 of the guide member 121 when the carriage 52 is moved. The printing head 51 is formed with a recessed portion 142 engageable with the lower shaft 137 when the large-size printing mode.

Figure 13:
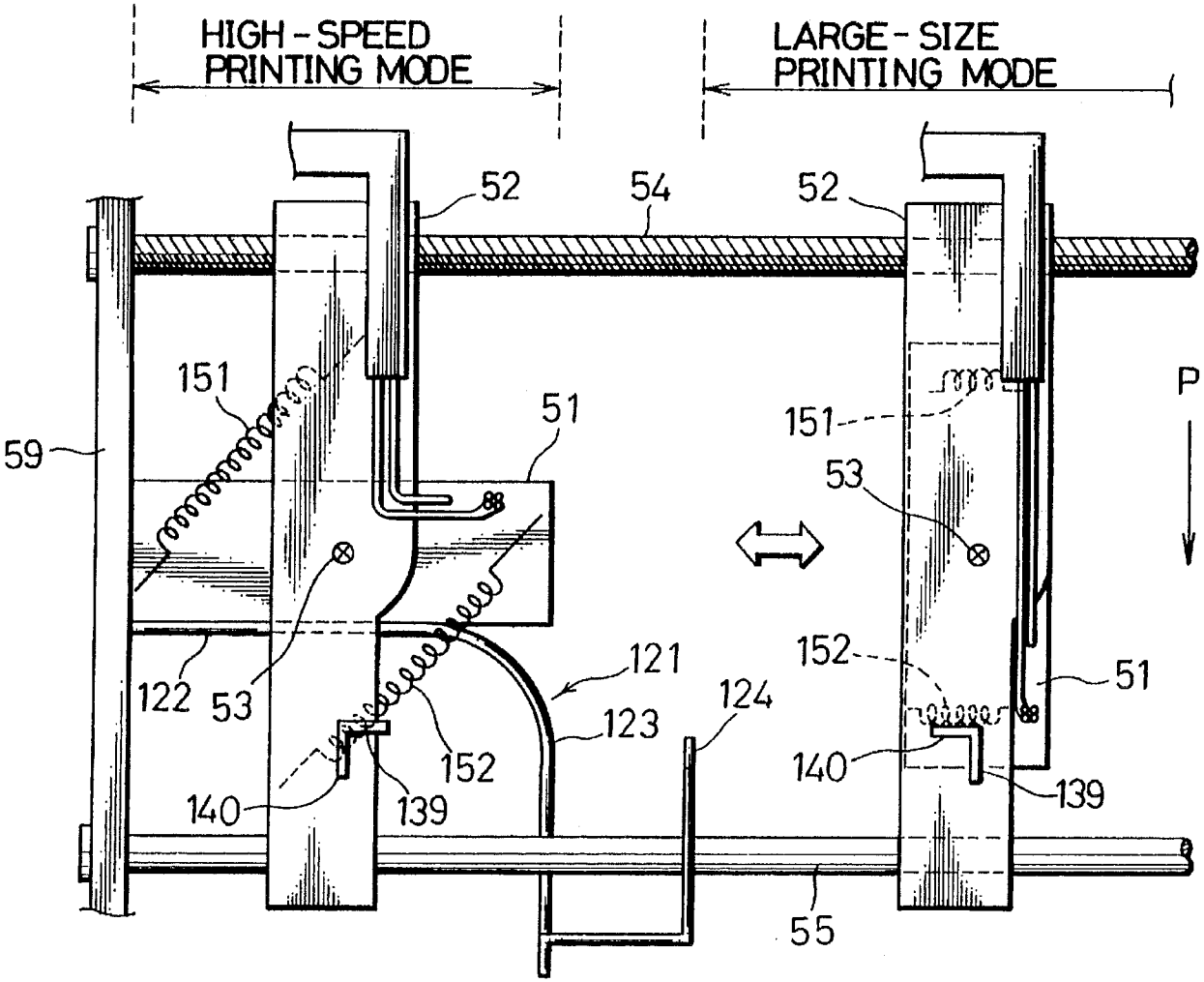
FIG. 13 is a top plan view showing a printing head rotating mechanism in the fourth apparatus.

As shown in FIG. 13, further, springs 151 and 152 are mounted between a top surface of the printing head 51 and an underside surface of the carriage 52 at their respective both ends, respectively. The springs 151 and 152 give the printing head 51 a biasing force to rotate the printing head 51 in a clockwise direction about the stem shaft 53 except for the case where the printing head 51 is directed along the printing sheet transport direction, that is, the arrangement of the printing head 51 in the large-size printing mode. It may be appreciated to provide only one spring at one end of the printing head 51 and the carriage 52 to give the biasing force to the printing head 51.

Further, the carriage 52 is formed with a projecting member 126 (see FIG. 12) at a side of the underside thereof. The projecting member 126 extends downward to come into contact with the printing head 51 in the large-size printing mode. The projecting member 126 is adapted for restricting the printing head 51 from rotating beyond the specified position by the biasing force of the springs 151, 152 when the printing head 51 is rotated from the high-speed printing state to the large-size printing state.

Figure 14A:
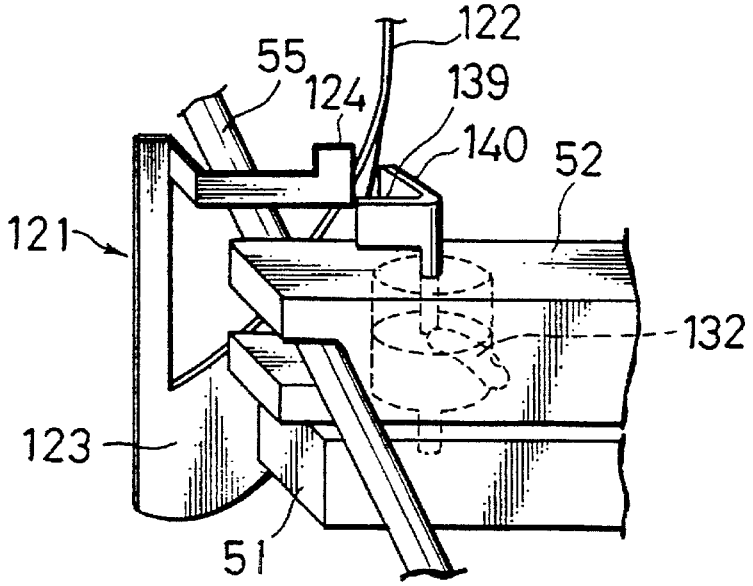
FIG. 14A is a perspective view showing a printing head holding mechanism in the fourth apparatus.
Figure 14B:
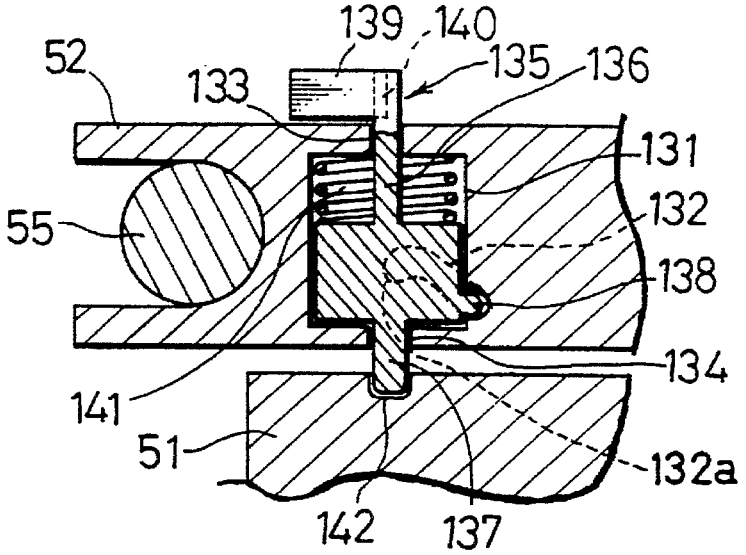
FIGS. 14B and 14C are cross-sectional views showing the printing head holding mechanism.
Figure 14C:
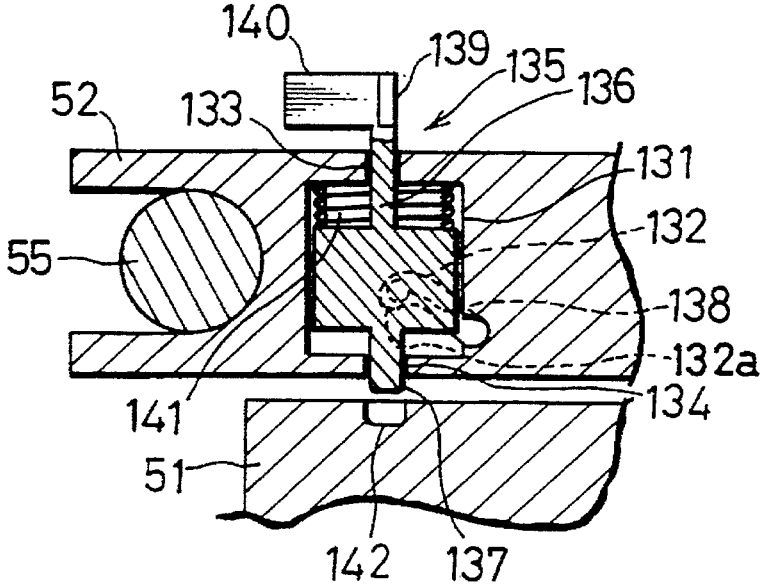

As shown in FIGS. 13, 14B, and 14C, the flag plate 139 is positioned along the sheet transport direction in the large-size printing mode while the flag plate 140 is positioned along the sheet transport direction in the high-speed printing mode. The flag plate 139 is rotated in the counterclockwise direction by the contact portion 124 in the process of the carriage being moved toward the side wall 59. The flag plate 140 is rotated in the clockwise direction by the contact portion in the process of the carriage being moved away from the side wall 59.

The counterclockwise rotation of the flag plate 139 causes the retaining member 135 to rotate in the counterclockwise direction while the round projection 138 rises along the helical groove 132. In other words, the retaining member 135 moves up from the state of FIG. 14B to the state of FIG. 14C.

The clockwise rotation of the flag plate 140 causes the retaining member 135 to rotate in the clockwise direction while the round projection 138 lowers along the helical groove 132. In other words, the retaining member 135 moves down from the state of FIG. 14C to the state of FIG. 14B.

The contact portion 124 has a vertical length able to come into contact with the flag plates 139 and 140 whose height are different in the large-size printing mode and the high-speed printing mode.

The rotation of the printing head 51 will be described next. In the large-size printing mode, the printing head 51 is brought in the stationary state where the lower shaft 137 of the retaining member 135 is fitted in the recessed portion 142 of the printing head 51.

On the other hand, when the high-speed printing mode is selected, the carriage 52 is moved toward the side wall 59. As the carriage 52 is moved, the flag plate 139 comes into contact with the contact portion 124 of the guide member 121 and pressed against the contact portion 124 to thereby rotate the retaining member 135. Consequently, the projection 138 rises along the helical groove 132 to move the retaining member 135 upward. As the retaining member 135 moves upward, the fitting of the lower shaft 137 in the recessed portion 142 is released as shown in FIG. 14C. When the projection 138 reaches the stopping portion 132*a* of the helical groove 132, the retaining member 135 is kept in this state without being moved downward by the spring force of the spring 141 because the projection 138 fits in the reversely slanted stopping portion 138*a*.

Subsequently, the printing head 51 is brought into contact with the curved portion 123 of the guide member 121, and slidingly moved therealong against the biasing force applied from the springs 151, 152 to thereby being rotated by 90° precisely while the carriage 52 is moved toward the side wall 59.

The carriage 52 is moved until the long side surface of the printing head 51 completely comes into contact with the straight portion 122 of the guide member 121. Consequently, the printing head 51 is set in the high-speed printing position.

On the contrary, when printing mode is selectively changed from the high-speed printing mode to the large-size printing mode, the carriage 52 is moved away from the side wall 59 along the extending direction of the shafts 54, 55 to the transport path of the large-size printing mode where a large-sized printing sheet is transported. As the movement of the carriage 52, the stem shaft 53 of the printing head 51 passes over the curved portion 123 of the guide member 121, and the printing head 51 is rotated along the curved portion by the biasing force of the springs 151, 152 to the large-size printing position.

After the printing head 51 is set in the large-size printing position, the flag plate 140 comes into contact with the contact portion 124 of the guide member 121 and pressed against the contact portion 124 as further movement of the carriage 52. The retaining member 135 is rotated and the projection 138 is moved away from the stopping portion 132*a* of the helical groove 132. Consequently, the retaining member 135 moves downward in accordance with the movement of the projection 138. As shown in FIG. 14B, the lower shaft 137 of the retaining member 135 fits in the recessed portion 142 of the printing head 51 to hold the printing head 51 in the large-size printing position.

As mentioned above, the arrangement of the guide member 121 makes it possible to change the direction of the printing head 51 without any other rotating mechanism including a motor. Accordingly, this will considerably reduce the number of parts and the weight of apparatus.

Further, the fitting the lower shaft 137 of the retaining member 135 into the recessed portion 142 of the printing head 51 can assuredly hold the printing head 51 in the large-size printing position to thereby eliminate a deteriorated printed image.

Preferably, the transport belt 38*c* and the transport belt 38*d* may be driven by separate motors. In this case, the load applied to the motors can be reduced, and accordingly, the intermittent transporting of printing sheet can be performed with a high precision.

In this embodiment, the printing head 51 is initially directed in the direction of large-size printing mode, and be changed into the direction of high-speed printing mode upon receipt of designation of the high-speed printing mode. However, the present invention is not limited to the above. Conversely, the printing head 51 may be initially directed in the direction of high-speed printing mode and be changed into the direction of large-size printing mode upon receipt of designation of the large-size printing mode.

A fifth ink jet printing apparatus according to the present invention will be described next with reference to FIGS. 15A to 21. Parts identical to those shown in the first ink jet printing apparatus are indicated at like reference numerals.

Figure 15A:
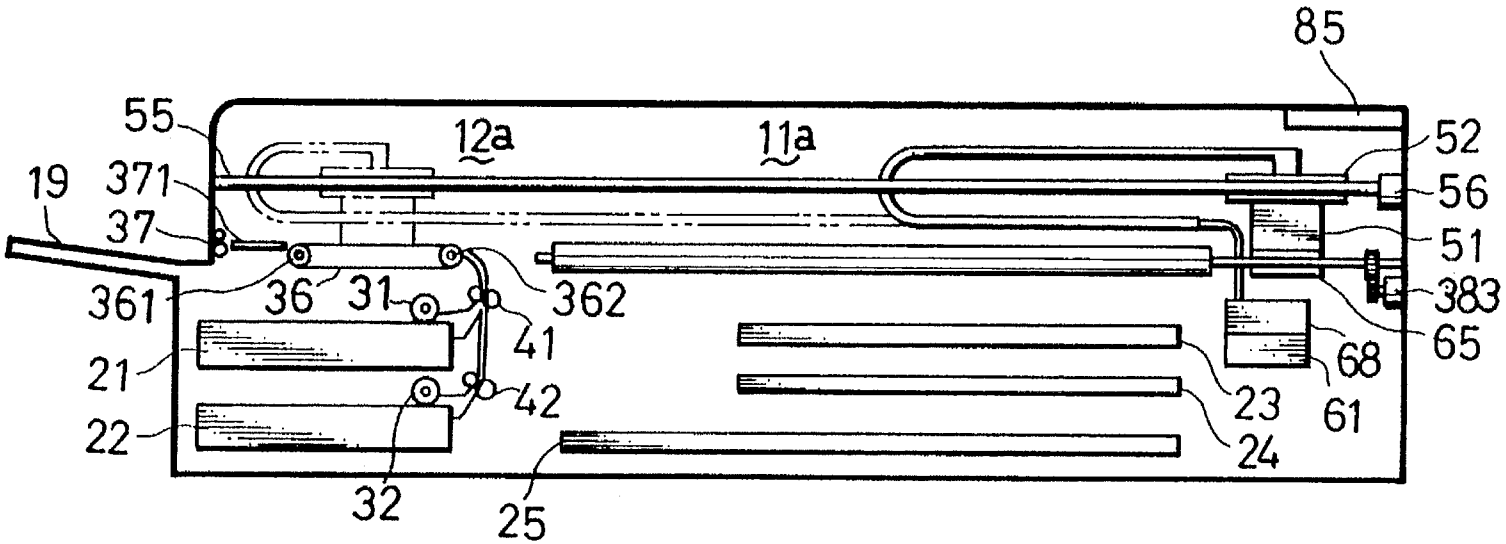
FIG. 15A is a diagram schematically showing a front view of an overall construction of a fifth ink jet printing apparatus according to the present invention.
Figure 15B:
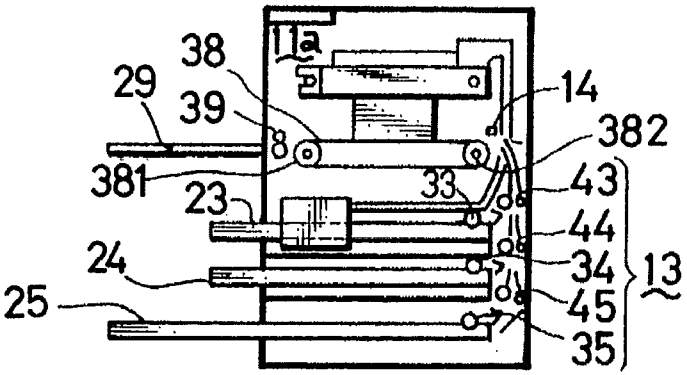
FIG. 15B is a diagram schematically showing a right side view of the overall construction of the fifth apparatus.

Similar to the first ink jet printing apparatus, the fifth ink jet printing apparatus is connected with an unillustrated image generator such as copying machine or personal computer and adapted for printing an image generated in the image generator on a sheet P of printing paper. Referring to FIGS. 15A and 15B, the fifth ink jet printing apparatus is provided with a large-size printing portion 11*a* located at a right side thereof for executing the large-size printing mode and a high speed printing portion 12*a* located at a left side thereof for executing the high-speed printing mode.

The large-size printing portion 11*a* includes a printing sheet storage portion and a printing sheet transport assembly. Likewise, the high speed printing portion 12*a* includes a printing sheet storage portion and a printing sheet transport assembly.

The printing sheet storage portion of the large-size printing portion 11*a* includes cassettes 23, 24, 25 for holding large-sized printing sheets having different sizes respectively, while the printing sheet storage portion of the high speed printing portion 12*a* includes cassettes 21, 22 for holding small-sized printing sheets having different sizes respectively.

The printing sheet transport assembly of the large-size printing portion 11*a* comprises feed rollers 33, 34, 35 adapted for dispensing printing sheets contained in the corresponding cassettes 23, 24, 25 one by one: pairs of rollers 44, 45 for transporting the printing sheet dispensed from the cassettes 24, 25; pairs of registration rollers 43 for transporting the printing sheet dispensed from the cassettes 23, 24, 25 in timed relation with ink jet operation; and a transport belt 38.

Similarly, the printing sheet transport assembly of the high speed printing portion 12*a* comprises: feed rollers 31, 32 adapted for dispensing printing sheets contained in the corresponding cassettes 21, 22 one by one; pairs of rollers 42 for transporting the printing sheet dispensed from the cassette 22; pairs of registration rollers 41 for transporting the printing sheet dispensed from the cassettes 21, 22 in timed relation with ink jet operation; and a transport belt 36.

The transport belt 38 is an endless belt stretched around transport rollers 381 and 382. As shown in FIG. 15B, the transport belt 38 is driven by a transport belt motor 383, and adapted for advancing a printing sheet P which has been transported from the sheet storage portion. The transport belt 38 holds the printing sheet P by an electrostatic or air vacuum attraction to transport the printing sheet P in the forward direction. There is provided a discharge roller 39 downstream of the transport belt 38 to discharge the printing sheet P transported by the transport belt 38 to a discharge tray 29.

The transport belt 36 is also an endless belt stretched around transport rollers 361 and 362. As shown in FIG. 15A, the transport belt 36 is driven by a transport belt motor 363, and adapted for advancing a printing sheet P which has been transported from the sheet storage portion. The transport belt 36 also holds the printing sheet P by an electrostatic or air vacuum attraction to transport the printing sheet P in the forward direction. There is provided a discharge roller 37 downstream of the transport belt 36 to discharge the printing sheet P transported by the transport belt 36 along a transport path 371 to a discharge tray 19.

At an immediate upstream of the transport belts 36, 38 are disposed sheet detecting sensors 14, 16, e.g., a photo-reflecting type sensor, to detect a leading end of the printing sheet P being transported.

A construction of the large-size printing portion 11*a* and the high speed printing portion 12*a* will be described next with reference to FIGS. 15A to 17. A screw shaft 54 and a slide shaft 55 are provided over the large-size printing portion 11*a* and the high speed printing portion 12*a* parallel with each other in a widthwise direction of the ink jet printing apparatus. A carriage 52 is supported on the screw shaft 54 and the slide shaft 55 which extend in a widthwise direction of the transport belt 38. The carriage 52 carries a printing head 51.

The printing head 51 includes a nozzle portion 511. The nozzle portion 511 includes four arrays of nozzle units, 51Y, 51M, 51C, and 51K adapted for emitting inks having the color of yellow (Y), magenta (M), cyan (C), and black (K), respectively. The nozzle portion 511 may be provided with an array of nozzle units 51K which emit ink having the color of black (K) to print a black monochromatic image on the printing sheet P.

The carriage 52 is made reciprocally movable in the widthwise direction of the transport belt 38 by a driver mechanism including a carriage driving motor 56. A construction of the driver mechanism in this embodiment is similar to the construction shown in the first ink jet printing apparatus. It should be appreciated that the carriage 52 is made reciprocally movable in the widthwise direction of the transport belt 38 in the large-size printing portion 11*a*, whereas in the high speed printing portion 12*a*, the carriage 52 is stayed at a specified position.

Figure 16:
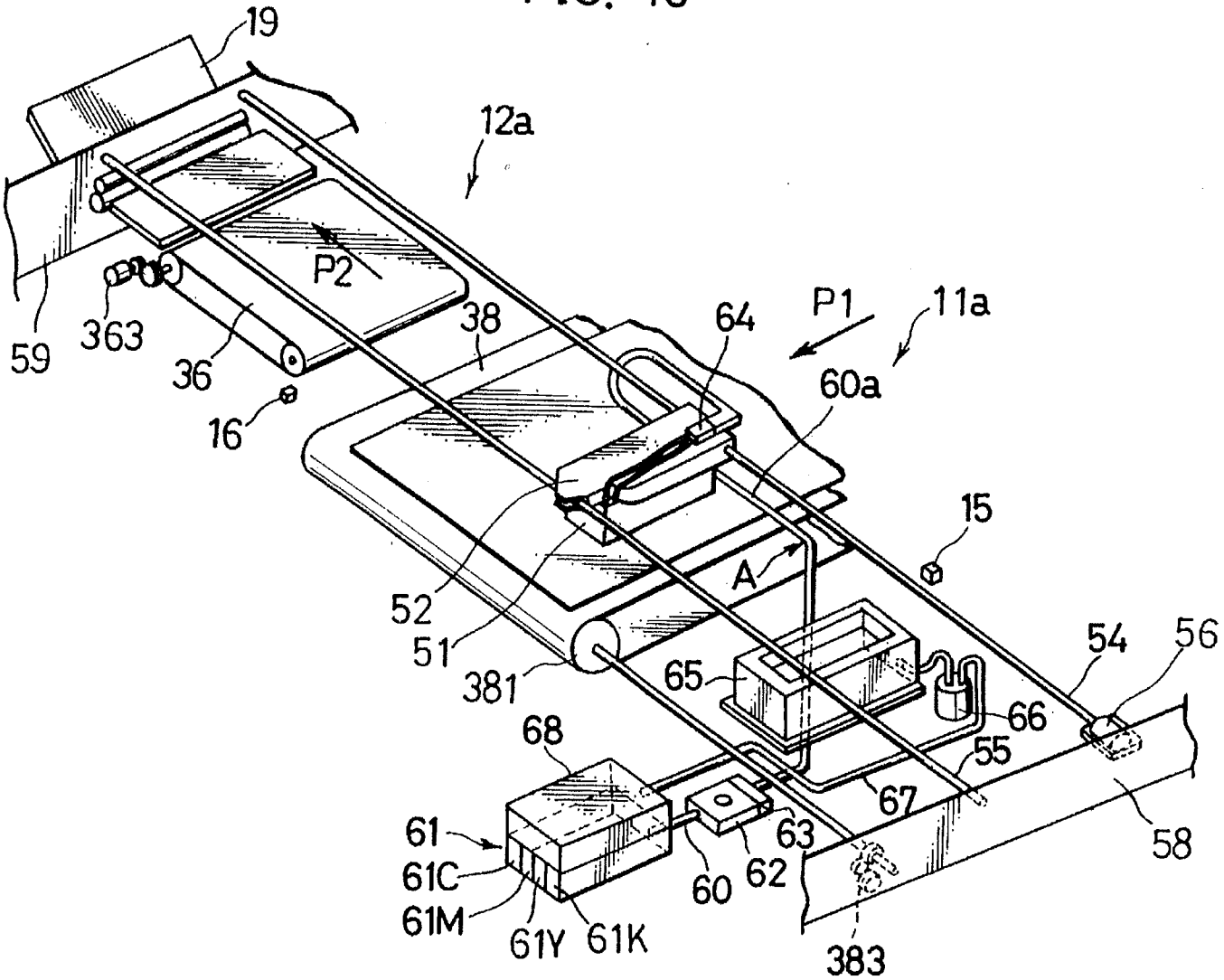
FIG. 16 is a perspective view showing a printing portion of the fifth apparatus.
Figure 17B:
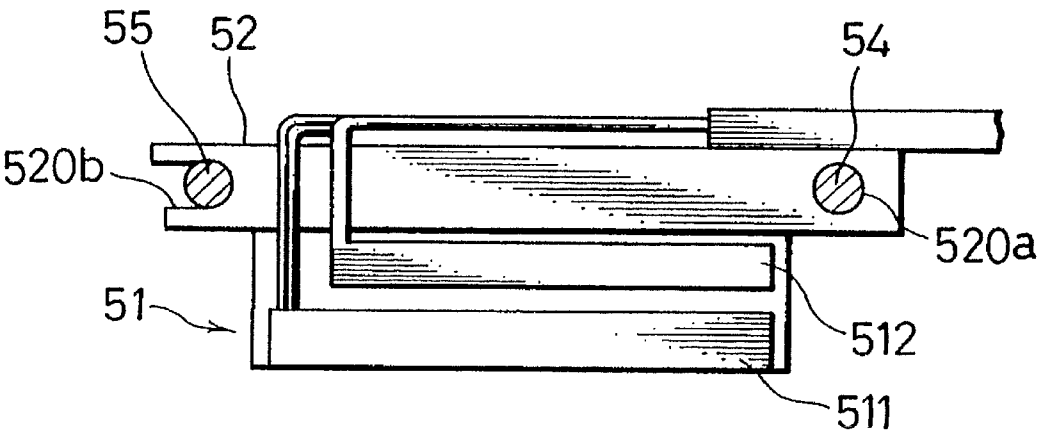
FIG. 17B is a right side view showing the carriage and printing head.
Figure 17A:
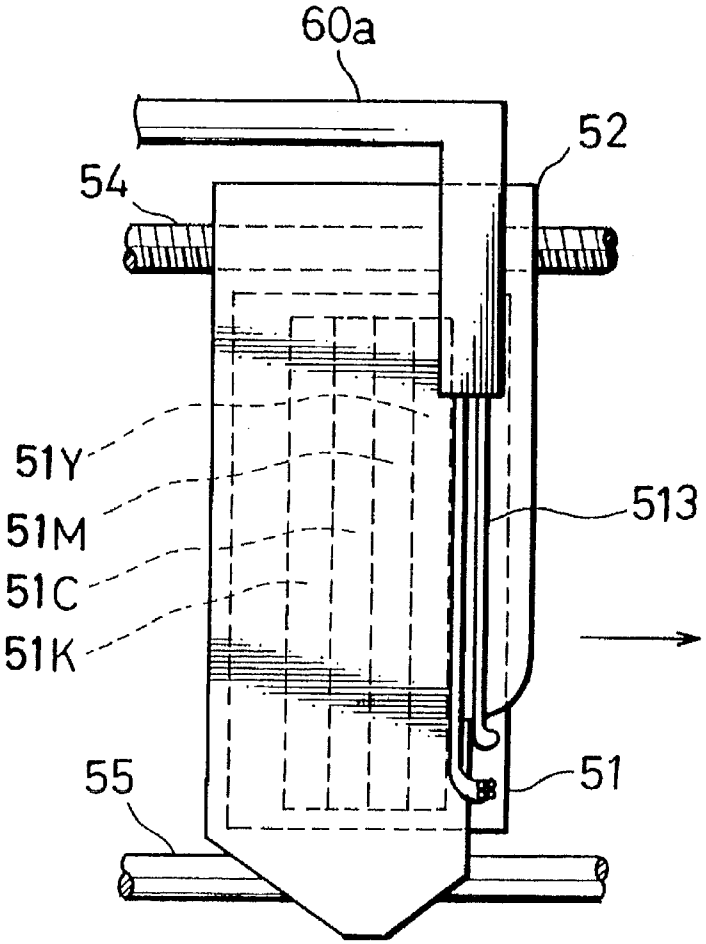
FIG. 17A is a top plan view showing a carriage carrying a printing head of the fifth apparatus.

As shown in FIG. 16, the fifth ink jet printing apparatus is provided with an ink supply system and an ink pressure stabilizer having a construction similar to the first ink jet printing apparatus. A downstream portion 60*a* of an ink supply tube 60 in the ink supply system has a length sufficient to follow the reciprocal movement of the printing head 51.

A control system of the fifth ink jet printing apparatus shown in FIG. 18 is similar to that of the first ink jet printing apparatus. Also in this embodiment, the following two modes can be set: the large-size printing mode and high-speed printing mode.

In the large-size printing mode where a printing image has a width larger than the shorter side of A4-size printing sheet, that is, the length of the nozzle array of the printing head 51, the transport belt motor 383 is intermittently driven to transport a printing sheet P dispensed from the cassettes 23 to 25 and transported on the transport belt 38 by a specified distance in a direction perpendicular to the extending direction of the screw shaft 54 and the slide shaft 55. During the time of the printing sheet being stayed, the carriage 52 is moved by the carriage driving motor 56 at a printing position on the large-size printing portion 11*a* to execute printing of one-line.

In the large-size printing mode, ink is emitted while the printing head 51 is moved. The ink pressure changes with the movement of the printing head 51 because the bending portion of the ink supply tube 60*a* shifts with the movement of the printing head 51. Accordingly, the moving speed of the printing head 51 cannot be increased beyond a particular speed to keep the fluctuation of pressure within a specified limit. However, the printing mode can be moved beyond the length of the nozzle array. Accordingly, the large-size printing mode enables printing of large-sized image.

On the other hand, in the high-speed printing mode where a printing image has a width equal to or shorter than the shorter side of A4-size printing sheet, that is, the length of the nozzle array of the printing head 51, a printing image is printed on a printing sheet P dispensed from the cassettes 21, 22 by fixedly staying the printing head 51 at a specified position while transporting the printing sheet P. Specifically, when the high-speed printing mode is selected, the carriage 52 is moved to a specified printing position on the high speed printing portion 12*a* by the carriage driving motor 56 and then fixed at the printing position. The printing sheet P is transported at a constant speed in a direction parallel with the extending direction of the screw shaft 54 and the slide shaft 55 by the transport belt 36 which is driven by the transport belt motor 363.

In the high-speed printing mode, the printing sheet is continuously transported at a constant speed. This will make it possible to complete the printing at higher speed than the large-size printing mode where the printing sheet is intermittently transported. In the high-speed printing mode, also, the printing head 51 is stayed in the specified position during the printing, and the supply tube 60*a* is retained in a fixed posture. There will be no fluctuation in the ink pressure. Accordingly, the printing speed can be further raised by shortening the ink emission period and increasing the printing sheet transporting speed.

Figure 19:
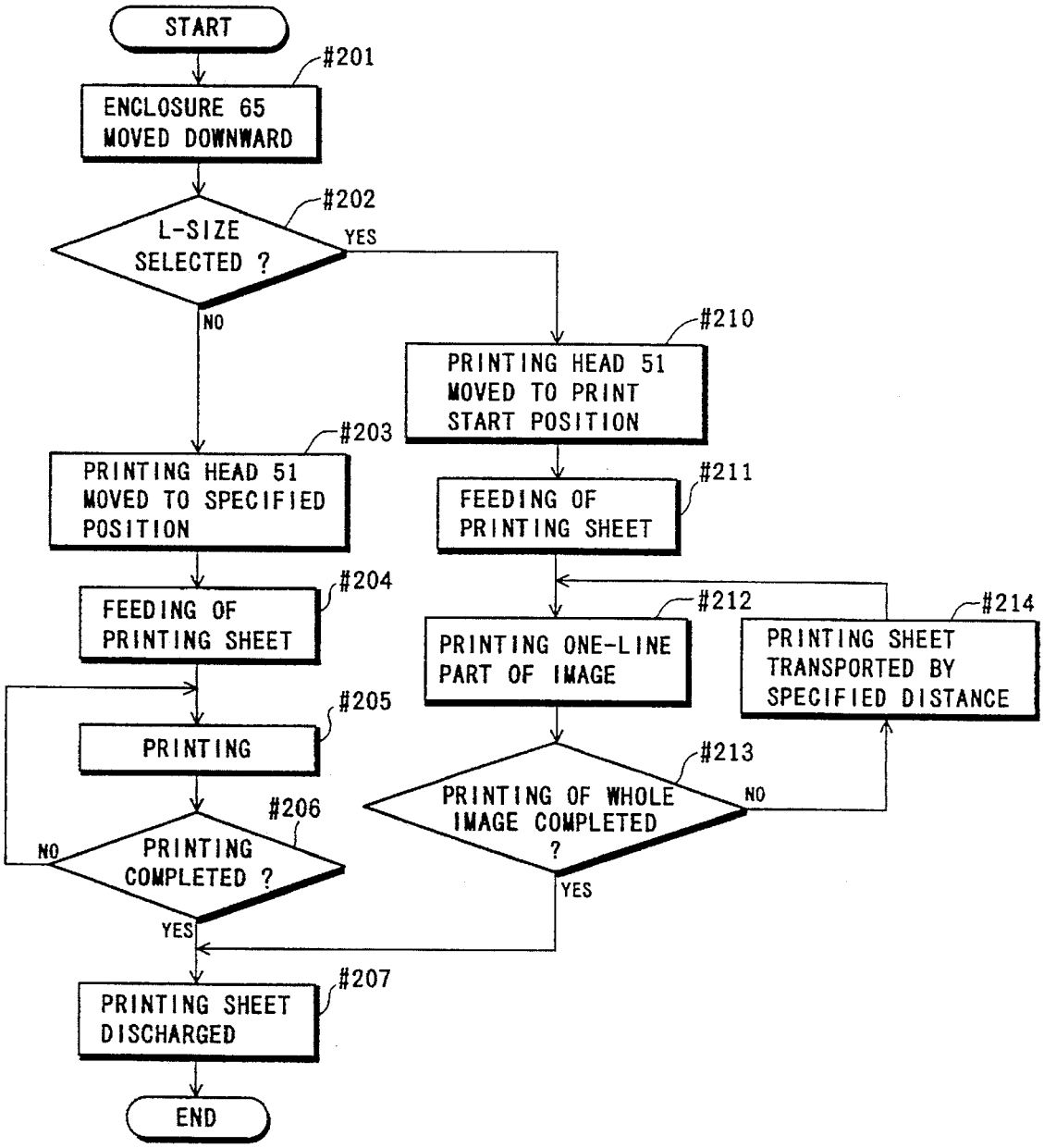
FIG. 19 is a flowchart showing a printing operation of the fifth apparatus.

A printing operation of the fifth ink jet printing apparatus will be described with reference to a flowchart shown in FIG. 19.

When printing is instructed, an enclosure unit 65 is moved downward and retracted from the printing head 51 (Step #201).

Subsequently, the printing mode is selected based on an operation signal sent from the image generator (Step #202). Specifically, in the case that an image is printed on a printing sheet having a width equal to or shorter than the shorter side of A-4 size printing sheet, the high-speed printing mode is selected. On the other hand, in the case that an image is printed on a printing sheet having a width larger than the shorter side of A4-size printing sheet, the large-size printing mode is selected.

In Step #202, when the high-speed printing mode is selected, the printing head 51 is moved to a specified printing position above the transport belt 36 (Step #203). After the printing head 51 being set at the specified position just below which the printing sheet is to be transported, the printing sheet is fed out of the cassette and transported to the transport belt 36 (Step #204). The printing head 51 prints an image on the printing sheet which is being continuously transported at a specified constant speed by the transport belt 36 (Step #205). When the printing is completed (YES in Step #206), the printing sheet is discharged (Step #207). Consequently, this routine ends.

On the contrary, when the large-size printing mode is selected in Step #202, the printing head 51 is moved to a start position (Step #210). In this case, the nozzle arrays are held in the position parallel with the printing sheet transport direction.

The printing sheet is fed out of the cassette and transported to the transport belt 38 (Step #211). The transport belt 38 transports the printing sheet to a specified position and stops the transporting to keep the printing sheet at the position. Thereafter, the printing head 51 is moved at a constant speed in the widthwise direction of the printing sheet from the start position while emitting ink in accordance with parallel image signals, consequently, printing one-line part of the image (Step #212).

In Step #213, it is judged whether the printing of the whole image is completed. If the printing of the whole image is not finished (NO in Step #213), the printing sheet is transported by a specified distance corresponding to one line part (Step #214). In this time, the printing head 51 is returned to the start position. Thereafter, the printing head 51 is again moved in the widthwise direction of the printing sheet while emitting ink in accordance with parallel image signals to thereby print next one-line part of the image (Step #212). These operations of Steps #212 to #214 are repeated to complete the whole image printing. After the whole image being printed (YES in Step #213), the printing sheet is discharged (Step #207).

As described above, there are the two printing modes which are selectively changeable depending on the size of printing image or printing sheet. In the case of printing a small-sized image, the high-speed printing mode is selected to print the small-sized image. Also, in the case of printing a large-sized image, the large-size printing mode is selected to enable printing of the large-sized image.

Also, the printing mode can be easily changed by merely moving the printing head 51 to either one of the large-size printing portion 11*a* and the high-speed printing portion 12*a* without the necessity of rotating the printing head 51.

Figure 20:
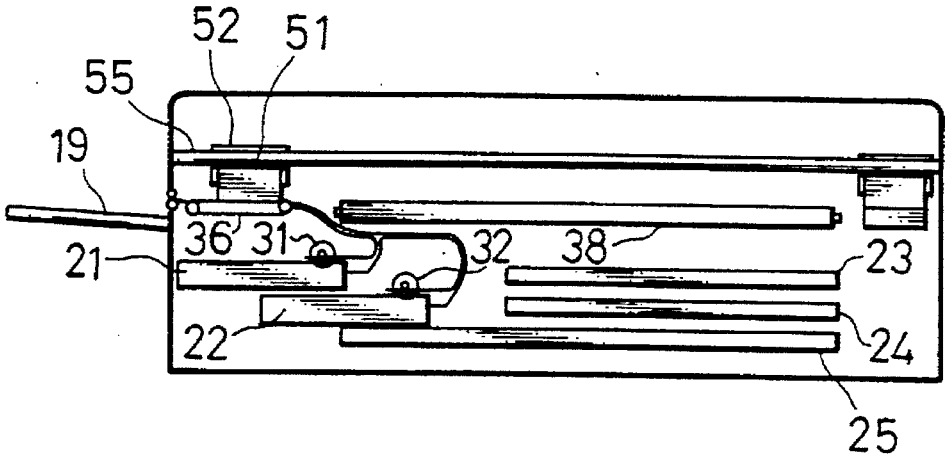
FIG. 20 is a diagram schematically showing a modification of the fifth apparatus.
Figure 21:
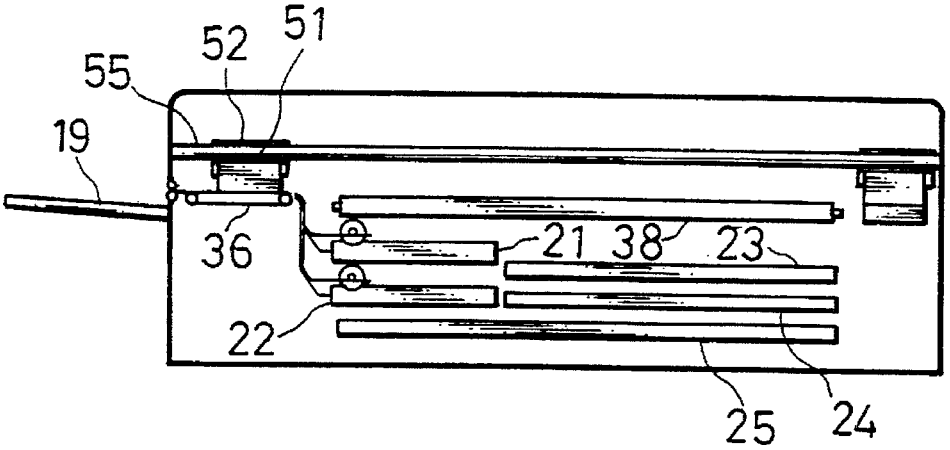
FIG. 21 is a diagram schematically showing another modification of the fifth apparatus.

The cassettes 21 and 22 may be arranged in the position shown in FIGS. 20 and 21. Specifically, in FIG. 20, the cassettes 22 may be positioned horizontally inward with respect to the cassette 21 so that the feed roller 32 of the lower cassette 22 is placed in the same horizontal plane of a bottom surface of the cassette 21 which is located above the lower cassette 22. This arrangement reduces the size of the ink jet printing apparatus vertically.

As shown in FIG. 21, the paper storage portion of the high-speed printing portion 12*a* for holding small-sized printing sheets may be mounted on the paper storage portion of the large-size printing portion 11*a* for holding large-sized printing sheets. Specifically, the cassettes 21, 22 for high-speed printing are disposed above the cassette 25 for holding the largest sized printing sheets and positioned horizontally parallel with the cassettes 23, 24, respectively. This arrangement also reduces the size of the ink jet printing apparatus in sideways directions.

Further, in FIG. 21, the lower cassette 22 may be arranged outward with respect to the upper cassette 21 so that the feed roller 32 of the cassette 22 is positioned in the same horizontal plane of the bottom surface of the cassette 21. This arrangement makes it possible to reduce the size of the apparatus vertically.

Figure 22:
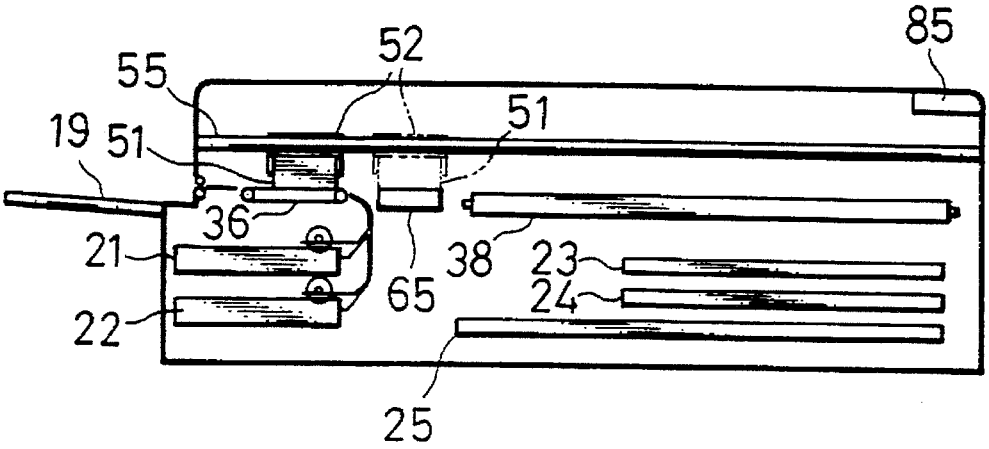
FIG. 22 is a diagram schematically showing a front view of an overall construction of a sixth ink jet printing apparatus according to the present invention.

A sixth ink jet printing apparatus according to the present invention will be described next with reference to FIG. 22. In FIG. 22, a printing head 51 and a carriage 52 carrying the printing head 51 in a position of executing high-speed printing are shown by solid lines while those at a home position are shown by phantom lines. Parts identical to those shown in the first ink jet printing apparatus are indicated at like reference numerals.

In this embodiment, the home position of the printing head 51 is located at a spacing defined by a large-size printing portion 11*a* and a high-speed printing portion 12*a*. An enclosure unit 65 is located at a spacing defined between a transport belt 36 of the large-size printing portion 11*a* and a transport belt 38 of the high-speed printing portion 12*a*.

This arrangement reduces the high-speed moving range within which the printing head 51 is to be moved from the home position to a printing position of the high-speed printing portion 12*a* when the high-speed printing mode is selected. Thereby, the time required for the printing head 51 to start printing upon receipt of an operation start signal can be reduced. Also, this arrangement makes it possible to reduce the time required for the printing head 51 to reciprocally move to the home position for forcible ink emission.

When the large-size printing mode is selected, a printing 11*a* start position of the large-size printing portion may be set at a left end of the large-size printing portion 11*a*. This arrangement also reduces the large-size moving range within which the printing head 51 is to be moved from the home position to a printing start position of the large-size printing mode, and accordingly, the time required for the printing head 51 to start printing upon receipt of an operation start signal can be reduced.

A seventh ink jet printing apparatus of the present invention will be described next with reference to FIGS. 23 to 27D. The construction of this ink jet printing apparatus is generally identical to that of the fifth ink jet printing apparatus shown in FIGS. 15A and 15B except that a dryer is provided on a printing head. Accordingly, detailed description of other portions than the provision of dryer will be omitted. It should be noted that FIG. 24B schematically shows an arrangement of a printing head, a carriage, and a dryer of the seventh ink jet printing apparatus.

Figure 24B:
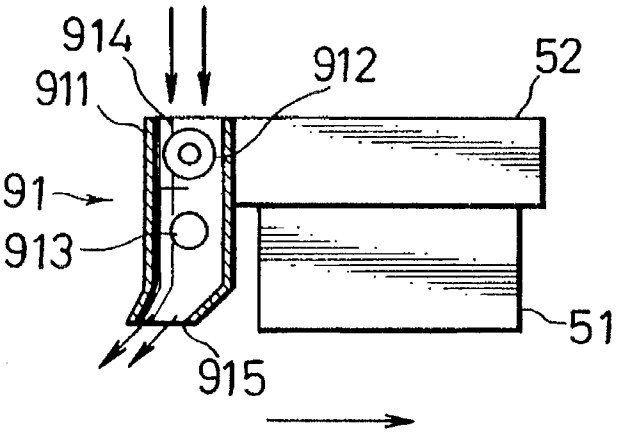
FIG. 24B is a diagram showing a construction of the first dryer.
Figure 24A:
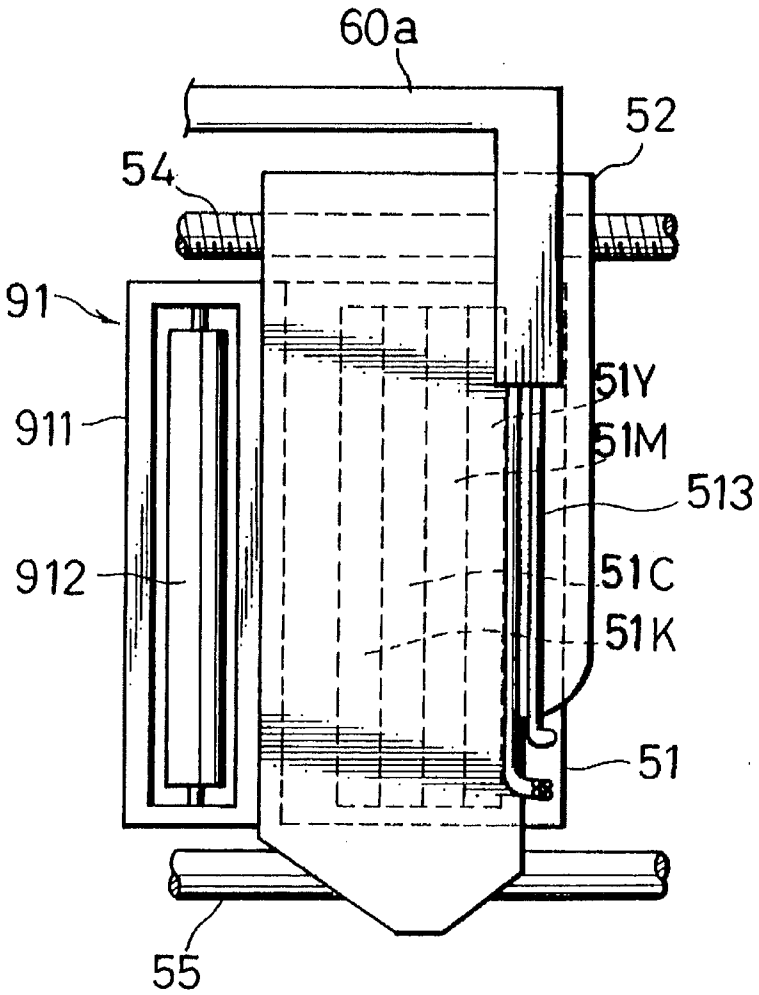
FIG. 24A is a top plan view showing a carriage carrying a printing head of the seventh apparatus, the carriage being attached with a first dryer.

This ink jet printing apparatus is provided with a first dryer 91 as shown in FIGS. 24A and 24B. The first dryer 91 is adapted for drying ink adhered on a printing sheet immediately after the ink emission to prevent a rear surface of one discharged printing sheet from being smeared with ink on another discharged printing sheet. Printing sheets bearing a printed image are discharged onto discharge trays 19, 29 after the printing is conducted and stacked over the preceding printing sheet.

This ink jet printing apparatus is further provided with a second dryer 92 for assuredly drying ink adhered on a printing sheet in a high-speed printing portion 12*a*.

Figure 23:
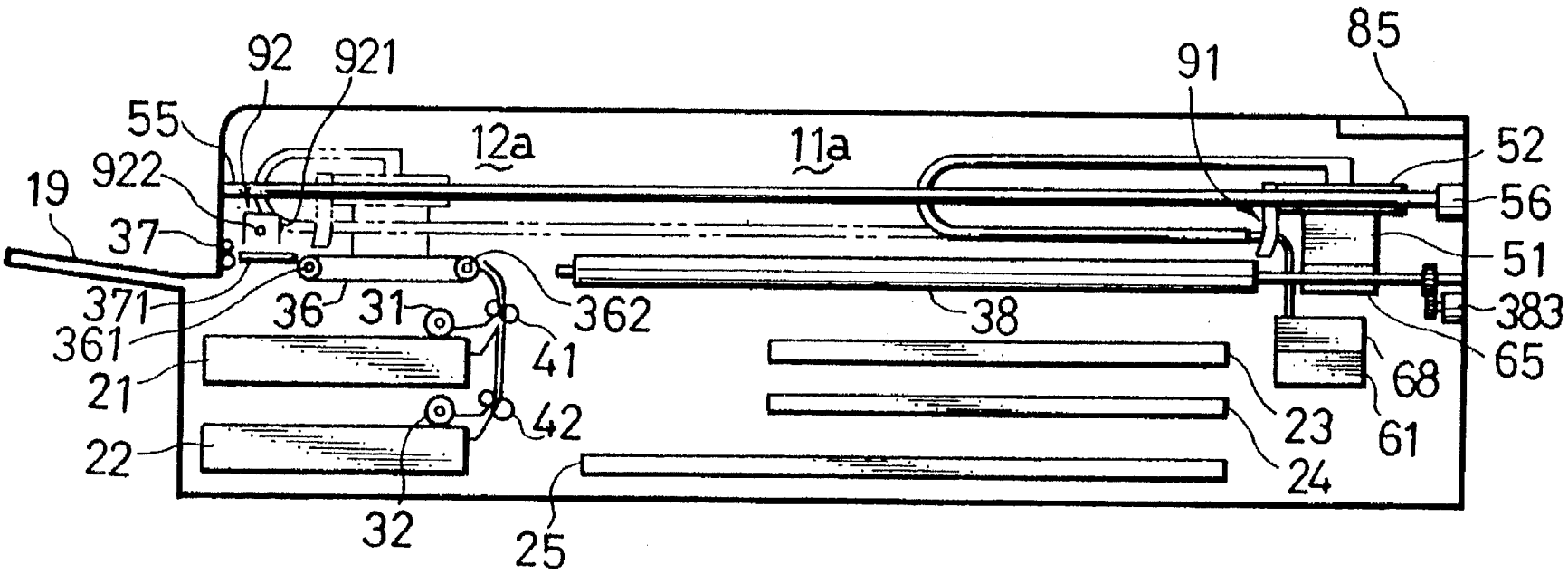
FIG. 23 is a diagram schematically showing a front view of an overall construction of a seventh ink jet printing apparatus according to the present invention.

As shown in FIG. 23, the first dryer 91 is arranged at a left side of the carriage 52 to be movable together with the carriage 52. The first dryer 91 includes an air current directing member 911 in the form of a box. The longer side of the air current directing member 911 has a length substantially identical to the printing head 51. A fan member 912 is provided in an upper inside of the air current directing member 911. A heater 912 including a heating wire is provided in a lower inside of the air current directing member 911. The fan member 912 and the heater 913 have a length substantially identical to the nozzle array.

The first dryer 91 is operated as follows. The fan member 912 inhales air into the air current directing member 911 through an air inlet 914 defined in an upper end of the air current directing member 911. The inhaled air is heated by the heater 913, and the heated air is blown out of the air current directing member 911 onto a printed surface of the printing sheet through an air outlet 915 defined in a lower end of the air current directing member 911 to thereby dry ink on the printed surface.

The second dryer 92 is arranged at a downstream side of the printing position on the high-speed printing portion 12*a*, e.g., at a transport path 371. The second dryer 92 includes a reflector member 921. The reflector member 921 extends in the same direction as the printing head 51 and has substantially the same length as the printing head 51. The reflector member 921 has a box-like shape including an opening in a lower end thereof. The opening faces the transport path 371. Inside the reflector member 921 is provided a heater 922 which has substantially the same length as the printing head 51. The heater 922 is heated to generate heat and the generated is directly radiated onto a printed surface of the printing sheet and reflected from the reflector member 921 onto the printed surface to dry ink on the printed surface.

A control system of the seventh ink jet printing apparatus will be described next with reference to a block diagram shown in FIG. 25.

The fan member 912 and the heaters 913, 922 are controlled by a printing sheet transport control portion 812 through a drive circuit 83.

When the large-size printing mode is selected, the fan member 912 and the heater 913 are operated while the printing head 51 is being reciprocally moved. At this time, the fan member 912 and the heater 913 may be operated during the time when the printing head 51 is moved from the home position to one end of the large-size printing portion 11*a* (from left to right in FIG. 23) to print one-line part of image.

Alternatively, the fan member 912 and the heater 913 may be operated during the time when the printing head 51 is moved toward the one end of the large-size printing portion 11*a* and then returned to the home position so that ink of the printed one-line part is dried also in the returning movement of the printing head 51.

On the contrary, when the high-speed printing mode is selected, the fan member 912 and the heater 913 of the first dryer 91 are operated, and the heater 922 of the second dryer 92 is also operated to assuredly dry a printed image on the printing sheet and to discharge the printing sheet having the ink of the printed image completely dried.

Since ink of a printed image on a printing sheet can be reliably dried in this embodiment, the rear surface of a printing sheet which is discharged onto discharge trays 19, 29 after the printing and which is stacked over the preceding printing sheet can be prevented from being smeared with ink of a printed image on the preceding printing sheet.

Further, the seventh ink jet printing apparatus is provided with the first dryer 91 which is operable both in the large-size printing portion 11*a* and the high-speed printing portion 12*a* and the second dryer 92 which is operable exclusively in the high-speed printing portion 12*a*. When the large-size printing mode is selected, the heater 913 of the first dryer 91 is operated while the second dryer 92 is kept in an inoperative state. This arrangement reduces the power consumption and eliminates redundant heat to be generated by the heater 922 of the second dryer 92 while the large-size printing is performed, which results in saving energy.

The second dry 92 may be constructed by using a pair of a heating roller and a pressure roller to thermally fix a printed image on the printing sheet. In this case, ink of the printed image which has been dried to some extent by the first dryer 91 will be surely fixed on the printing sheet by thus constructed second dryer 92 to perfectly prevent ink adhered on the printing sheet from flowing and deteriorating a finished printed image.

Further, the rotating speed of the fan member 912 and the heat amount generated by the heater 913 may be set at a variable level. Specifically, when the high-speed printing mode is selected, a printing sheet transport control portion 812 allows the fan member 912 to increase the rotating speed or allows the heater 913 to increase the amount of heat to be generated.

Further, it may be appreciated to remove the second dryer 92 in the case where ink of a printed image on a printing sheet can be completely dried solely by the first dryer 91 by increasing the rotating speed of the fan member 912 and the heat amount of the heater 913 of the first dryer 91.

Figure 26:
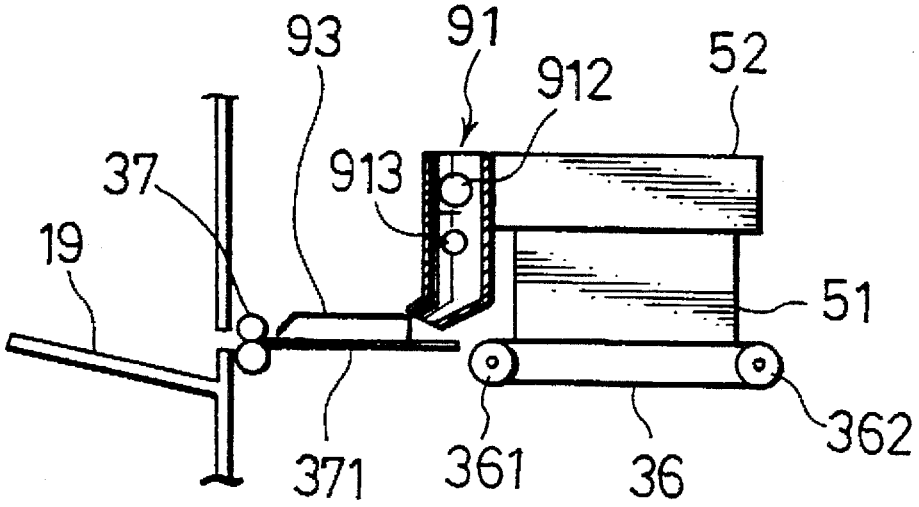
FIG. 26 is a diagram showing a modification of a second dryer used in the seventh apparatus.

Moreover, as shown in FIG. 26, a cover member 93 may be disposed above the transport path 371 of the high-speed printing portion 12*a* for covering the transport path 371. The cover member 93 serves as a second dryer. Both ends of the cover member 93 in the widthwise direction may be bent downward to effectively and temporarily enclose the heat generated by the heat 912 so as not to escape the heat from the transport path 371. With this arrangement, ink of a printed image on a printing sheet in the high-speed printing portion 12*a* can be reliably dried during transport of the printing sheet along the transport path 371. Accordingly, the printing sheet can be discharged onto the discharge tray 19 with the printed image completely dried.

A modified first dryer 91 will be described next with reference to FIGS. 27A and 27B. This modified first dryer 91 is provided with an air deflector member 94 on an air inlet 914 of the first dryer 91.

The air deflector member 94 utilizes a relative air flow which occurs owing to the movement of a carriage 52 and introduces the air into an air current directing member 911 of the first dryer 91. The air deflector member 94 has an length identical to the air inlet 914, and covers substantially half of the air inlet 914.

The air deflector member 94 comprises an air deflecting portion 941 and air receiving portions 942, 943. The air deflector member 94 is pivotally rotatable about pivots 942, 943 by the force of the relative air flow to change its position to one deflecting posture and the other deflecting posture which is opposite to the one deflecting posture. The pivots 942, 943 are disposed at a center portion of the air inlet 914 and extend parallel with the extending direction of the air inlet 914.

The air deflecting portion 941 is preferably formed in the shape of arc to deflect the air smoothly. The air receiving portions 942, 943 are formed at both ends of the air deflecting portion 941 in such a manner that the air receiving portion 942 extends by a specified length in a plane which passes the axial center of the pivots 944, 945 and one end of the air deflecting portion 941 while the air receiving portion 943 extends by a specified length in another plane which passes the axial center of the pivots 944, 945 and the other end of the air deflecting portion 941. The two planes passing the air receiving portions 942, 943 define a angle of 90 degrees so that the air receiving portions 942, 943 receive the air most effectively.

Figure 27B:
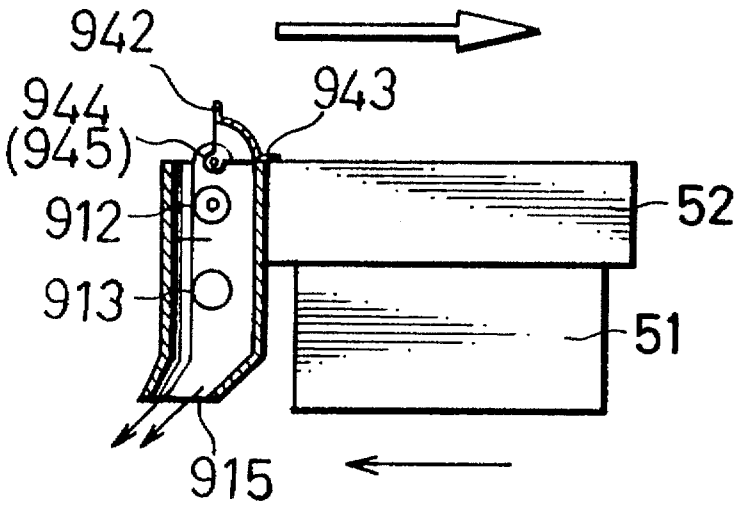
FIGS. 27A and 27B are diagrams showing a modification of the first dryer.

When an inner surface of the air deflecting portion 941 and of the air receiving portion 942 receive the relative air flow which occurs by the movement of the carriage 52, the air is flown into the air current directing member 911 of the first air dryer 91 along the inner surfaces of the air receiving portion 942 and the air deflecting portion 941 through the air inlet 914 as shown in FIG. 27B.

Figure 27A:
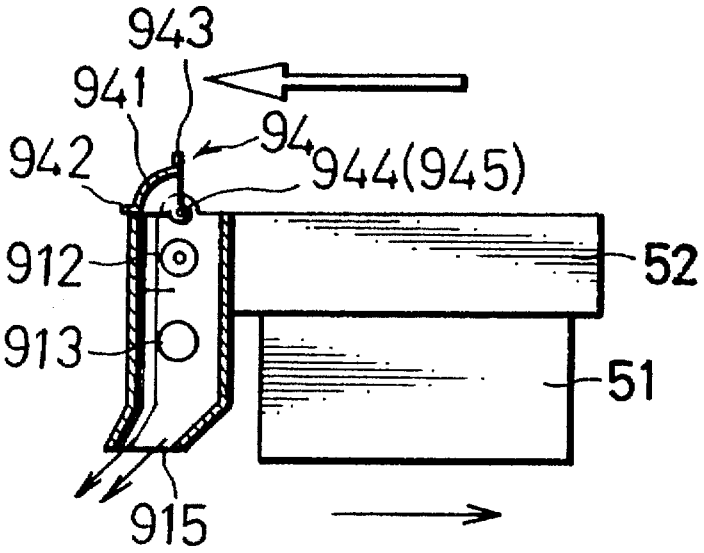

On the contrary, when an outer surface of the air deflecting portion 941 and of the air receiving portion 942 receive the relative air force, the air deflecting member 94 is pivotally rotated to change its position to the other deflecting posture shown in FIG. 27A. Thereby, the air is blown into the air current directing member 911 along an inner surface of the air receiving portion 943 and the inner surface of the air deflecting portion 941 through the air inlet 914.

As mentioned above, when the inner surfaces of the air deflecting portion 941 and of the air receiving portion 943 receive the relative air force, the air is flown into the air current directing member 911 through the air inlet 914. On the contrary, when the outer surface of the air deflecting portion 941 and an outer surface of the air receiving portion 942 receive the relative air force, the air deflecting member 94 is pivotally rotated to be returned to the initial deflecting posture shown in FIG. 27B. Thereby, the air is flown into the air current directing member 911 along the inner surfaces of the air receiving portion 942 and the air deflecting portion 941 through the air inlet 914.

Operations of the air deflecting member 94 when the large-size printing mode is selected will be described next with reference to FIGS. 27A and 27B. FIG. 27A shows a state where the carriage 52 is about to be moved from one end to the other end of a large-size printing portion 11*a*; and FIG. 27B shows a state where the carriage 52 is about to be returned from the other end to the one end of the large-size printing portion 11*a*.

When the large-size printing mode is selected, driving of a fan member 912 is stopped. As shown in FIG. 27A, when the printing head 51 is moved from the one end to the other end of the large-size printing portion 11*a*, the air is flown into the air current directing member 911 along the inner surfaces of the air receiving portion 943 and of the air deflecting portion 941 through the air inlet 941, heated by the heater 913, and flown out onto the surface of the printing sheet through an air outlet 915.

On the other hand, as shown in FIG. 27B, when the printing head 51 is returned from the other end to the one end of the large-size printing portion 11*a*, the air is flown into the air current directing member 911 along the inner surfaces of the air receiving portion 942 and of the air deflecting portion 941 through the air inlet 914, heated by a heater 913, and flown out onto a surface of a printing sheet through the air outlet 915.

As mentioned above, the air deflector member 94 of the first dryer 91 makes it possible to utilize the force of relative air flow which is generated by the reciprocal movement of the carriage 52 when the large-size printing mode is selected. Accordingly, there is no need of driving the fan member 912 while the carriage 52 is reciprocally moved in the large-size printing portion 11*a*, which results in reducing power consumption.

When the high-speed printing mode is selected, the carriage 52 is held in a fixed posture, and accordingly, the air deflector member 94 does not introduce the relative air flow into the air current directing member 911. In this case, the fan member 912 is driven to forcibly flow the air forcibly into the air current directing member 911.

Figure 27D:
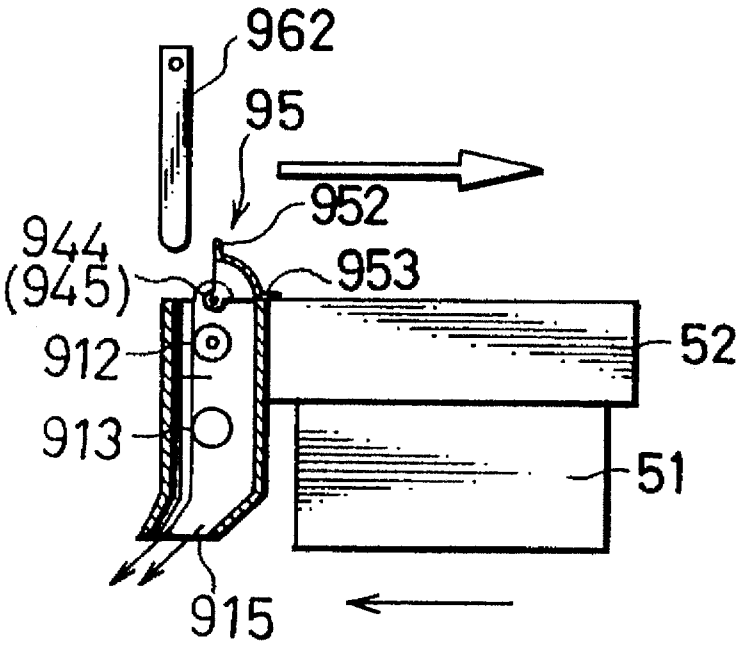
FIGS. 27C and 27D are diagrams showing another modification of the first dryer.
Figure 27C:
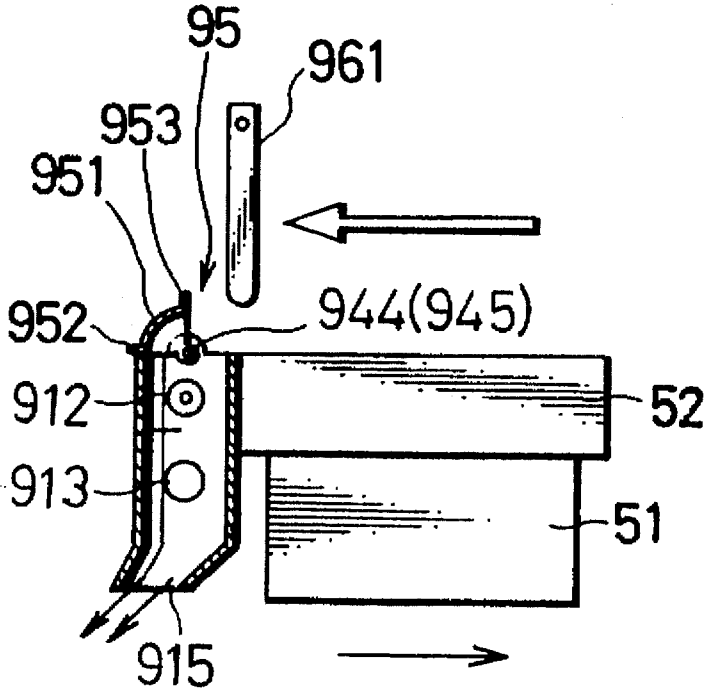

FIGS. 27C and 27D show a further modified first dryer 91 which makes it possible to selectively change the position of a deflector member 95 or pivotally rotate the deflector member 95 by a mechanical force without using the force of relative air flow.

Specifically, levers 961, 962 which are pivotally rotatable only in a single direction may be arranged at specified positions between one end and the other end of the large-size printing portion 11*a*. The deflector member 95 is formed with a projection portion 952 in one end thereof having a specified length in the longitudinal direction, while the deflector member 95 is formed with a projection portion 953 in the other end thereof having a specified length in the longitudinal direction.

The lever 961 is arranged near the other end of the large-size printing portion 11*a* facing the projection portion 953, and made pivotably rotatable only in a counterclockwise direction. The lever 962 is arranged near the one end of the large-size printing portion 11*a* facing the projection portion 952, and made pivotally rotatable only in a clockwise direction.

When the carriage 52 is moved from the one end of the large-size printing portion 11*a* toward the other end, the projection portion 953 is brought into contact with the lever 961 to move the lever 961 in the counterclockwise direction. Subsequently, when the carriage 52 is returned from the other end toward the one end, the projection portion 953 is once again brought into contact with the lever 961. However, at this time, since the lever 961 is not made rotatable in the clockwise direction, the projection portion 953 is pressed against the lever 961 and thereby rotated in the clockwise direction as shown in FIG. 27D. Accordingly, the deflector member 95 is brought into a state shown in FIG. 27D.

On the contrary, when the carriage 52 is returned from the other end of the large-size printing portion 11*a* toward the one end, as shown in FIG. 27D, the projection portion 952 is brought into contact with the lever 962 to move the lever 962 in the counterclockwise direction. Subsequently, when the carriage 52 is moved from the one end toward the other end, the projection portion 952 is once again brought into contact with the lever 962. However, at this time, since the lever 962 is not made rotatable in the clockwise direction, the projection portion 952 is pressed against the lever 962 and thereby rotated in the counterclockwise direction. Accordingly, the deflecting member 95 is brought into a state shown in FIG. 27C.

Figure 28:
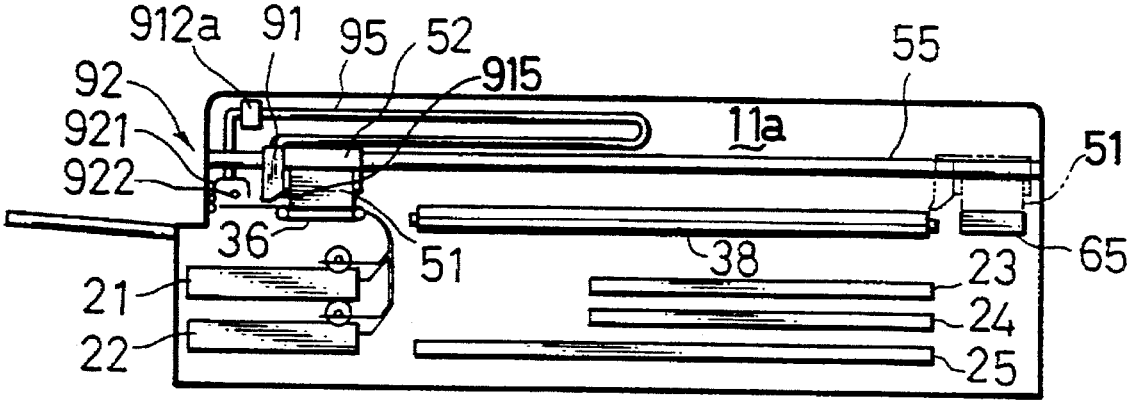
FIG. 28 is a diagram schematically showing a front view of an overall construction of an eighth ink jet printing apparatus according to the present invention.

An eighth ink jet printing apparatus according to the present invention will be described next with reference to FIG. 28 where an ink supply system is not illustrated.

This ink jet printing apparatus is provided with a first dryer 91, a second dryer 92 and an air duct 95 for communicating the first and second dryers 91, 92. The first dryer 91 does not have a fan member or a heater while the second dryer 92 has a heater 922. The air which is heated by the second dryer 92 is sent through the air duct 95 to the first dryer 91.

The air duct 95 communicates a reflector member 921 of the second dryer 92 and an air inlet 914 of the first dryer 91 to form an air passage connecting the second dryer 92 and the first dryer 91. A fan member 912*a* is arranged at a specified position in the air duct 95. The fan member 912*a* is adapted for sending the air heated in the second dryer 92 to the first dryer 91. The air duct 95 is made flexible by being formed of a soft synthetic resin and has a length sufficient to follow the reciprocal movement of a printing head 51.

Operations of the first and second dryers 91, 92 will be described. When the large-size printing mode is selected, both a heater 922 of the second dryer 92 and the fan member 912*a* are turned on. Subsequently, the air heated by the heater 922 is introduced into the air duct 95 by the fan member 912*a* and flown out of an air outlet 915 of the first dryer 91 to thereby dry ink of a printed image on a printing sheet which is temporarily stopped at the printing position of the large-size printing portion 11*a*. On the other hand, when the high-speed printing mode is selected, the fan member 912*a* is turned off while the heater 922 of the second dryer 92 is kept in an ON-state. Thereby, ink of a printed image on a printing sheet transported in the high-speed printing portion 12*a* is dried by the heat of the heater 922.

As mentioned above, the heater 922 is commonly used both for the first dryer 91 and for the second dryer 92. Accordingly, the number of parts necessary to constitute the first and second dryers can be reduced. Further, since the fan member 912*a* is arranged in the air duct 95 instead in the first dryer 91, the light-weighted first dryer 91 can be produced, and consequently, the load applied to a carriage driving motor 56 for driving a carriage 52 carrying the first dryer 91 can be reduced.

A ninth ink jet printing apparatus according to the present invention will be described next with reference to FIGS. 29 to 36.

The ninth ink jet printing apparatus comprises a printer main body 211 and a high-speed printer unit 210 which is detachably mounted on the printer main body 211. The printer main body 211 includes a large-size printing portion 11*a*, a carriage 52 carrying a printing head 51 movable along an extending direction of a screw shaft 54 and a slide shaft 55, and a cover 213.

Figure 29:
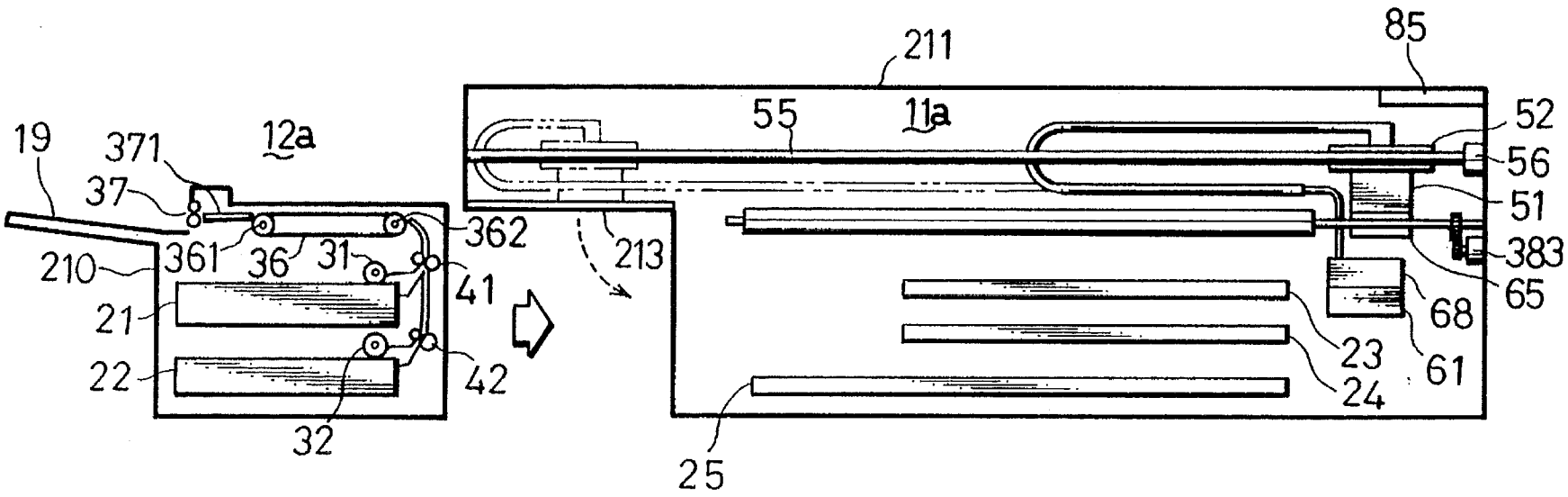
FIG. 29 is a diagram schematically showing a front view of an overall construction of a ninth ink jet printing apparatus according to the present invention.

As shown in FIG. 29, the screw shaft 54 and the slide shaft 55 extend to a left end of the cover 213 so that the printing head 51 is movable to a high-speed printing portion 12*a* of the high-speed printer unit 210 when the high-speed printer unit 210 is mounted on the printer main body 211. The printer main body 211 has a hollow space below the cover 213 in which the high-speed printer unit 210 is attached to the printer main body 211.

The high-speed printer unit 210 is mounted on the printer main body 211 as follows. When the cover 213 is removed from the printer main body 211 to form an opening in the printer main body 211, and the high-speed printer unit 210 is moved to the printer main body 211 in the direction shown by the arrow in FIG. 29 to thereby render an upper opening portion of the high-speed printer unit 210 face the opening of the printer main body 211.

Figure 30:
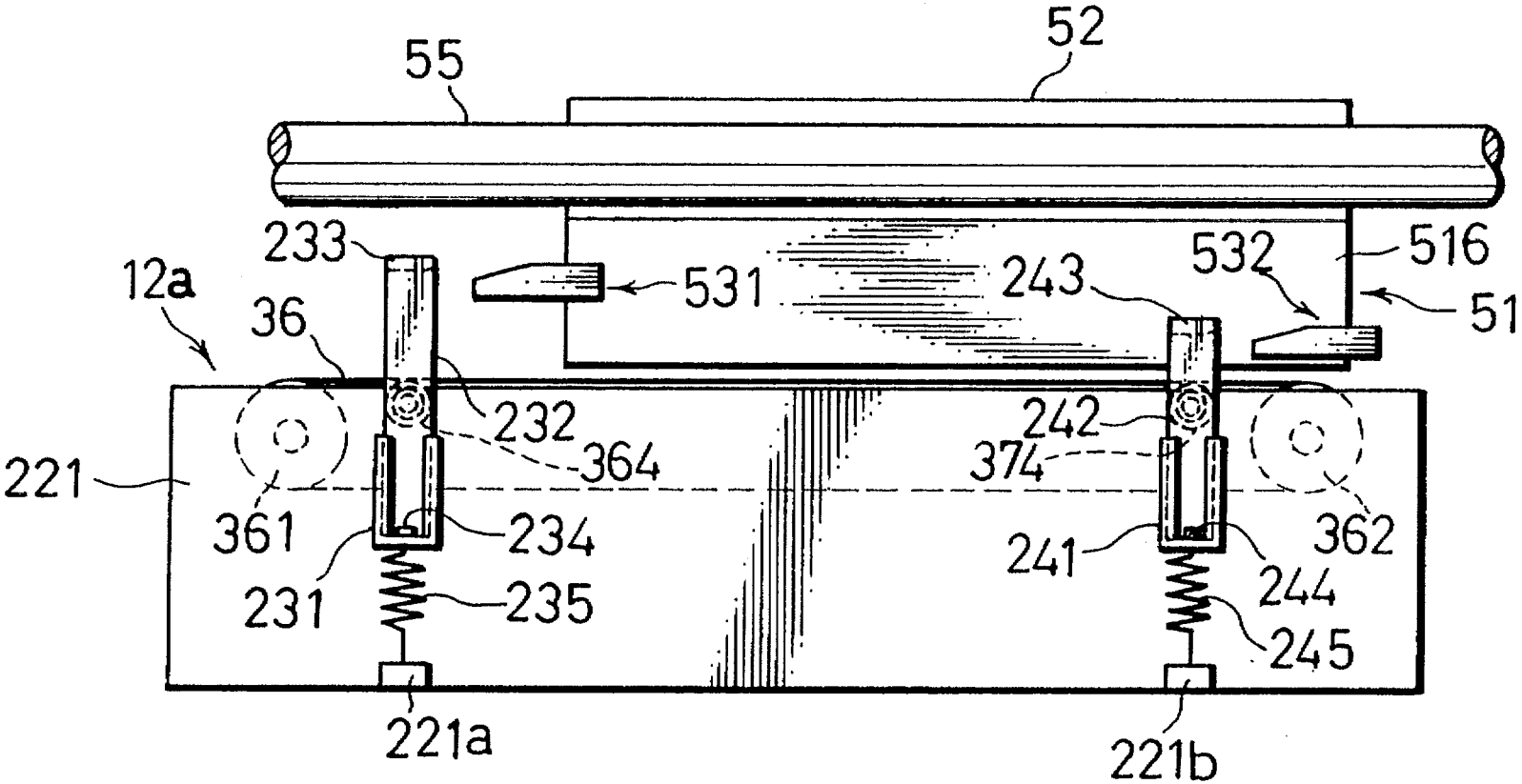
FIGS. 30 and 31 are front views showing a mounting mechanism in the ninth apparatus.
Figure 31:
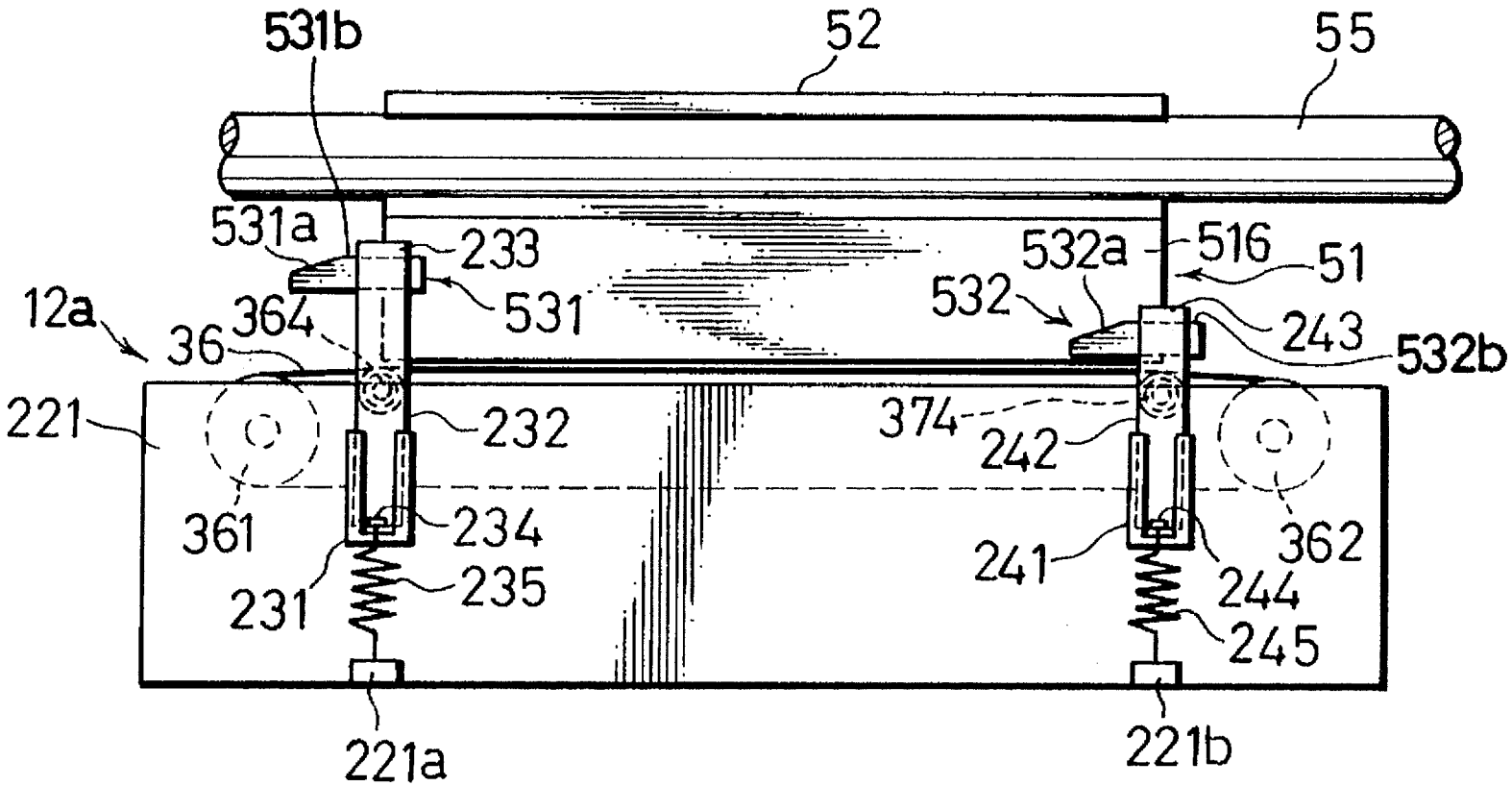
Figure 32:
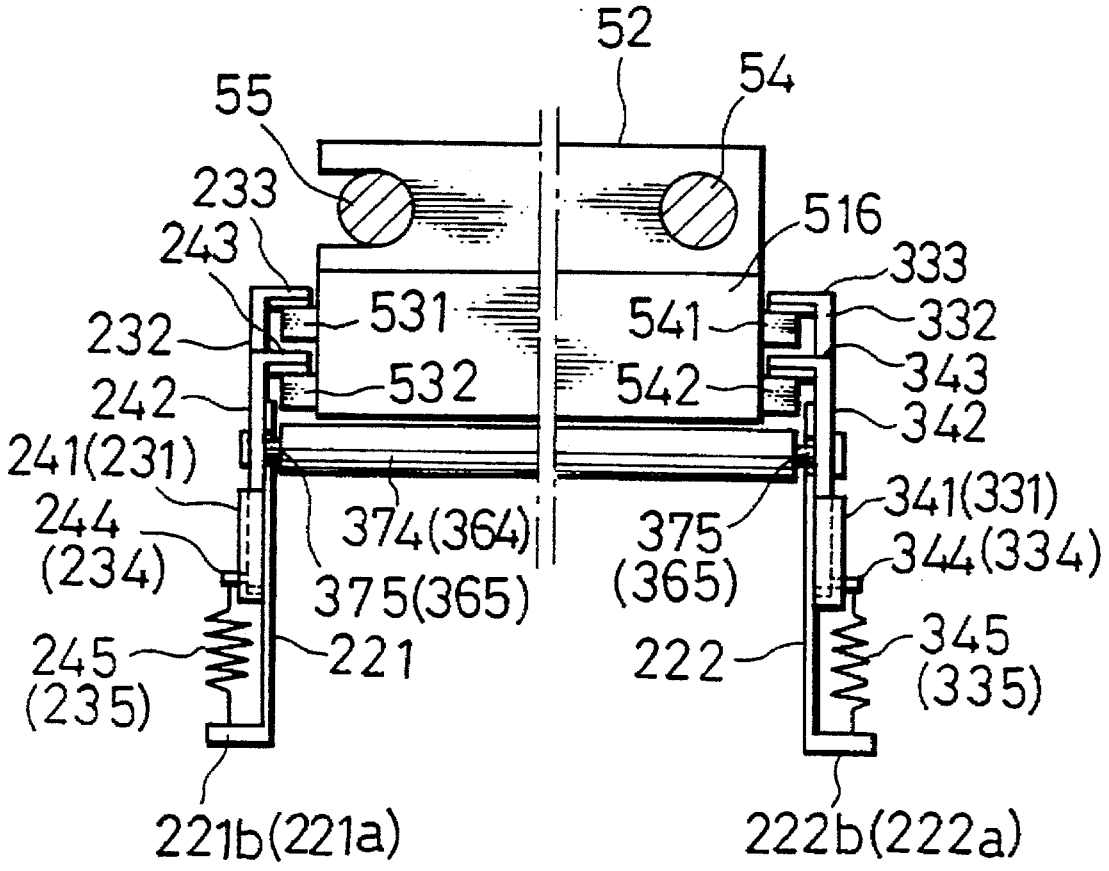
FIG. 32 is a side view showing the mounting mechanism.

Subsequently, the high-speed printer unit 210 is fixed to the printer main body 211 as shown in FIGS. 30 to 32. FIG. 30 shows a state where the printing head 51 is not in a printing position of the high-speed printing portion 12*a*; and FIG. 31 shows a state where the printing head 51 is fixedly stopped at the printing position of the high-speed printing portion 12*a*. FIG. 32 shows a right side elevation view of the state of FIG. 31 in which a transport roller 362 and a transport belt 36 are not shown.

The high-speed printer unit 210 includes a front wall 221 and a rear wall 222. The front wall 221 is provided with guide members 231, 241 on an outside thereof. The guide members 231, 241 are arranged spaced apart by a distance corresponding to the width of the printing head 51 and arranged at the same level. The front wall 221 is further provided with bracket portions 221*a*, 221*b* at a specified position at a lower end thereof. The bracket portions 221*a*, 221*b* are positioned below the guide members 231, 241 respectively, and are bent outward.

The guide members 231, 241 hold hanger members 232, 242, respectively. The hanger members 232, 242 are formed with contact portions 233, 243 at their respective upper ends and spring holding pins 234, 244 at their respective lower ends. The contact portions 233, 243 extend inward by a specified length. The spring holding pins 234, 244 extend outward by a specified length. Springs 235, 245 are provided between the bracket portions 221*a*, 221*b* of the guide members 231, 241 and the spring holding pins 234, 244, respectively to urge the hanger members 232, 242 downward. Further, the hanger member 232 is longer than the hanger member 242 by a specified length.

On the other hand, the rear wall 222 is provided with bracket portions 222*a*, 222*b* at a specified position corresponding to the projection portions 221*a*, 221*b* of the front wall 221, respectively. The rear wall 222 is further provided with guide members 331, 341, hanger members 332, 342, and springs 335, 345 at a specified position corresponding to the guide members 231, 241, the hanger members 232, 242, and the springs 235, 245 of the front wall 221, respectively.

The hanger member 232 of the front wall 221 and the hanger member 332 of the rear wall 222 are connected by a rod member 365, and a roller 364 is supported on the rod member 365 at a specified position between an upper stretch portion and a lower stretch portion of the transport belt 36 in such a manner that the roller 364 is moved upward and downward as the hanger members 232, 332 are moved upward and downward. When the roller 364 is moved upward to be brought into pressing contact with the upper stretch portion of the transport belt 36, the transport belt 36 is given a specified tension force and projects outside a top surface of the high-speed printing portion 12*a*.

On the other hand, the hanger member 242 of the front wall 221 and the hanger member 342 of the rear wall 222 are connected by a rod member 375, and a roller 374 is supported on the rod member 375 in a similar manner as the roller 364.

The endless transport belt 36 is stretched around transport rollers 361, 362 in such a manner that the upper stretch portion of the transport belt 36 is kept in a contact state with the rollers 364, 374. The rollers 364, 374 are rollable together with the transport rollers 361, 362 when the transport belt 36 is driven by a transport belt motor 363.

As shown in FIGS. 30 and 31, a support frame 516 for supporting the printing head 51 is provided with a hook member 531 on a left end portion on a front wall thereof. The support frame 516 is further provided with a hook member 532 on a right end portion on the front wall thereof. The hook member 532 is positioned at a lower position compared with the hook member 531 so that the hook member 531 does not collide against the hanger member 242 when the printing head 51 is moved to the high-speed printing portion 12*a*.

As shown in FIG. 31, the hook members 531, 532 are formed with slanting surfaces 531*a*, 532*a* and horizontal surfaces 531*b*, 532*b*, respectively. The contact portions 233, 243 of the hanger members 232, 242 are positioned lower than the horizontal surfaces 531*b*, 532*b*, respectively before being brought into contact with the hook members 531, 532. The slanting surfaces 531*a*, 532*b* are adapted for smoothly lifting up the hanger members 232, 242 when the hook members 531, 532 are brought into contact with the contact portions 233, 243 of the hanger members 232, 242. After being guided along the slanting surfaces 531*a*, 532*a* of the hook members 531, 532, the hanger members 232, 242 are completely lifted up to be placed on the horizontal surfaces 531*b*, 532*b*. Accordingly, a surface of nozzle arrays of the printing head 51 is retained horizontally spaced apart from an upper surface of the transport belt 36 by an optimum gap when the hanger members 232, 242 are moved upward by the hook members 531, 532. This will be described later in detail.

The rear wall 222 is provided with hook members 541, 542 at a specified position corresponding to the hook members 531, 532 of the front wall 221. The hook members 541, 542 have the same construction as the hook members 531, 532.

As shown in FIG. 30 where the printing head 51 is not in the printing position of the high-speed printing portion 12*a*, the hanger members 232, 332, 242, 342 are urged downward by the spring force of the springs 235, 335, 245, 345, respectively, thereby being brought into contact with a bottom surface of the guide members 231, 331, 241, 341, respectively. With this arrangement, an outer circumferential surface of the rollers 364, 374 are preferably kept flush with or positioned slightly lower than an outer circumferential surface of the transport rollers 361, 362 by a specified distance. It should be appreciated that the rollers 364, 374 are arranged at a desired position as long as a lower surface of the printing head 51, namely, the surface of the nozzle arrays is not brought into contact with the upper stretch portion of the transport belt 36 when the printing head 51 is inadvertently moved to the high-speed printing portion 12*a*, although the high-speed printing mode is not selected.

On the other hand, when the high-speed printing mode is selected and the printing head 51 is moved to the high-speed printing portion 12*a*, the hook members 531, 541, 532, 542 are brought into contact with the contact portions 233, 333, 243, 343, respectively. The contact portions 233, 333, 243, 343 are lifted by the hook members 531, 541, 532, 542 as being guided along the slanting surfaces of the hook members 531, 541, 532, 542, although the downward urging force of the springs 235, 335, 245, 345 and the resilient force of the transport belt 36 for urging the hanger members downward act on the hanger members 232, 332, 242, 342.

Accordingly, the hanger members 232, 332, 242, 342 are lifted upward by a specified distance, thereby raising the rollers 364, 374 by the same distance. Consequently, the surface of the nozzle arrays of the printing head 51 and a printing sheet on the transport belt 36 are retained spaced away by a specified gap, e.g., 1 mm when the printing head 51 is located in the printing position of the high-speed printing portion 12*a* as shown in FIG. 31.

As mentioned above, the rollers 364, 374 are made liftable only when the hanger members 232, 242, 332, 342 are lifted by the hook members 531, 532, 541, 542 and the printing head 51 is stopped at the printing position of the high-speed printing portion 12*a*. Accordingly, the upper stretch portion of the transport belt 36 of the high-speed printer unit 210 does not project from the top surface of the high-speed printer unit 210 to eliminate the likelihood that the transport belt 36 hits against corner edges of the printer main body 211 when the high-speed printing unit 210 is attached to or detached from the printer main body 211.

When the large-size printing mode is selected under the state that the high-speed printer unit 210 is mounted on the printer main body 211, and the printing head 51 is made movable along the extending direction of the screw shaft 54 and the slide shaft 55 within the large-size printing portion 11*a*, there may occur a case that a portion of the printing head 51 inadvertently overrides on the transport belt 36 of the high-speed printing portion 12*a*. However, since the transport belt 36 does not project from the high-speed printing portion 12*a* when the printing head 51 is not in the printing position of the high-speed printing portion 12*a*, the likelihood can be eliminated that the printing head 51 comes into sliding contact with the upper stretch portion of the transport belt 36.

Further, since the hanger members 232, 242, 332, 342 which are lifted by the hook members 531, 532, 541, 542, respectively lift the rollers 364, 374, the surface of the nozzle arrays of the printing head 51 and a printing sheet on the transport belt 36 can be reliably retained spaced apart with each other at a desired gap.

A modified mounting mechanism will be described next with reference to FIGS. 33 to 36. This modified mounting mechanism is different from the previous mounting mechanism in that hook members provided in a printing head for lifting up a transport belt 36 are formed in a different shape from the previous hook members 531, 541, 532, 542 to serve as elevating means for moving an enclosure unit upward and downward as well as elevating means for moving the rollers upward and downward. With this arrangement, an enclosure unit driving motor 84 (see FIG. 4) can be dispensed with.

Figure 33:
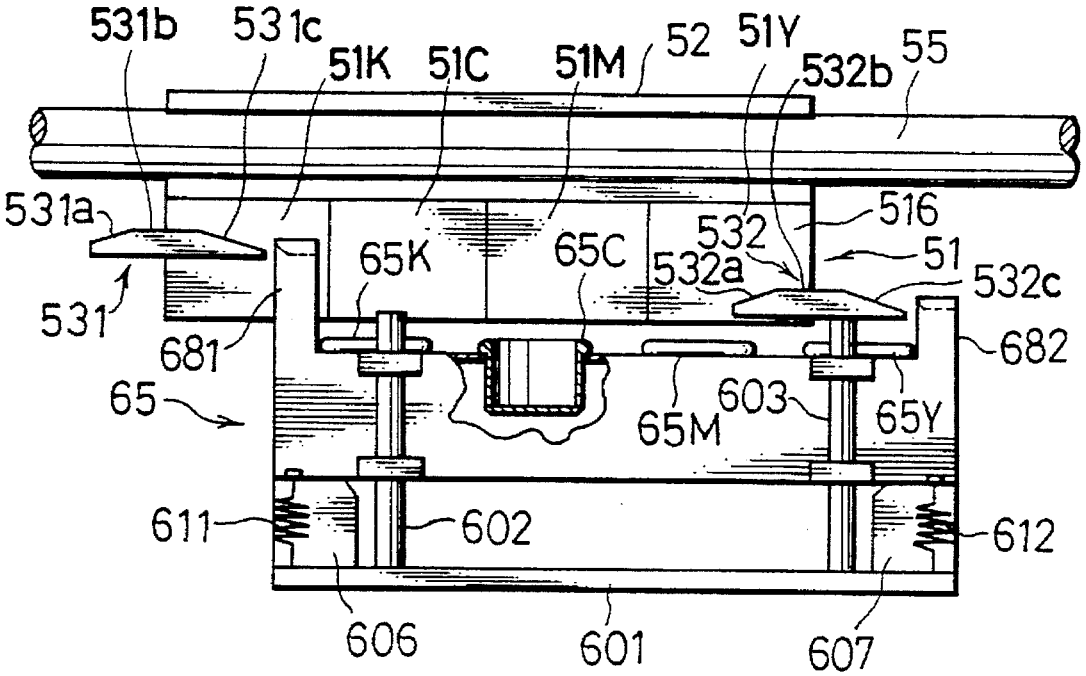
FIGS. 33 and 35 are front views showing another mounting mechanism.
Figure 34:
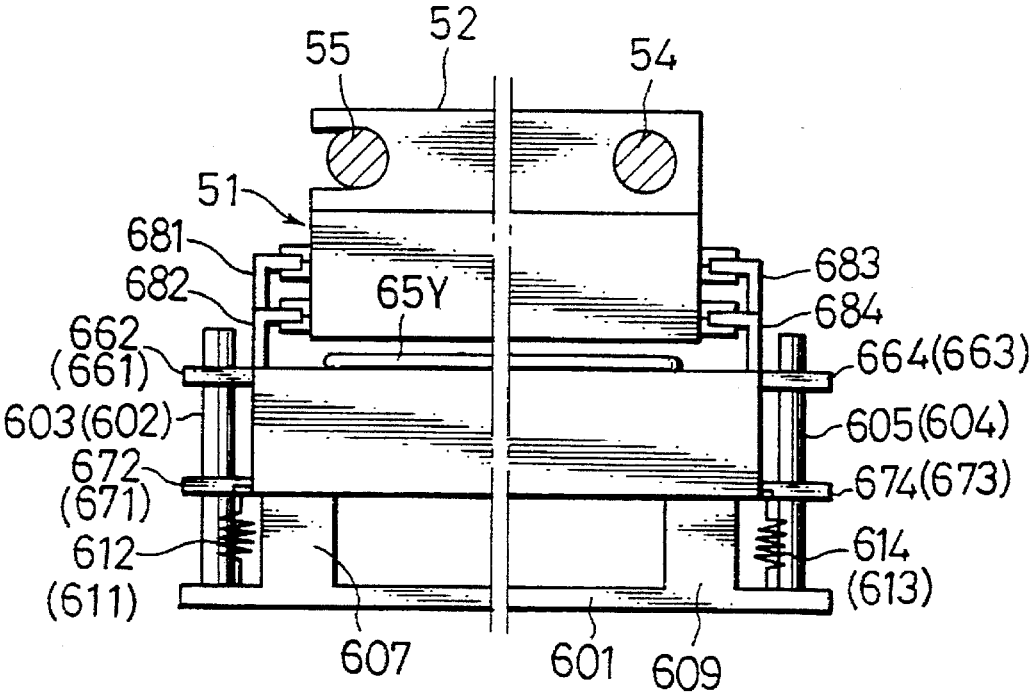
FIGS. 34 and 36 are side views showing the another mounting mechanism.
Figure 35:
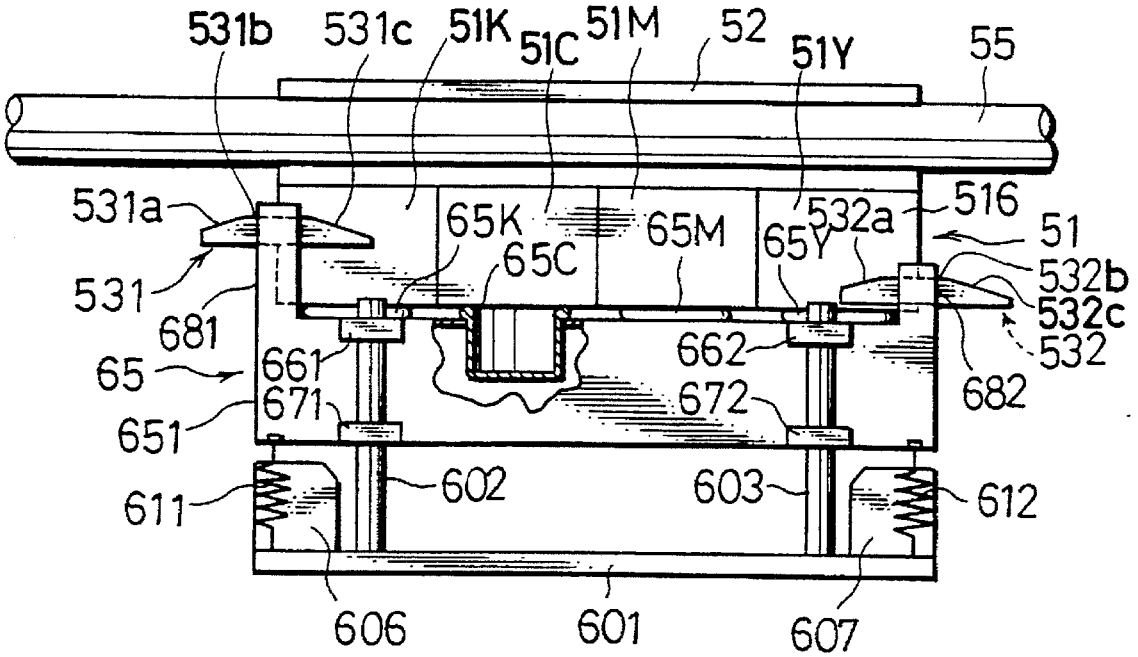
Figure 36:
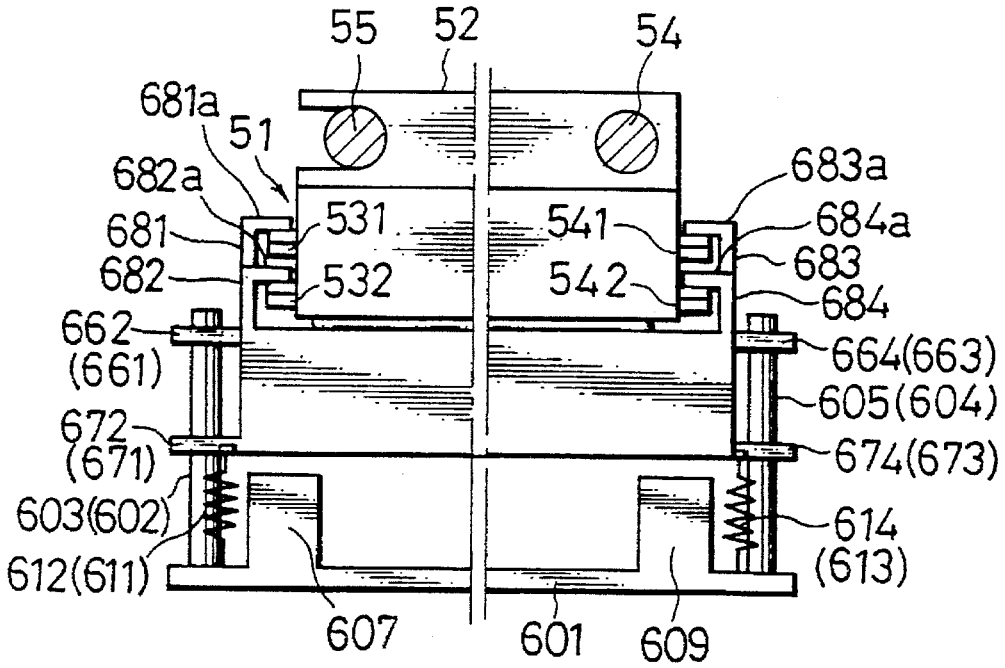

FIG. 33 shows a state that an enclosure unit 65 is moved downward and retracted from a printing head 51; and FIG. 35 shows a state that the enclosure unit 65 is moved upward and encloses the printing head 51 therein. FIGS. 34 and 36 are right side elevation views of the states of FIGS. 33 and 35, respectively.

The enclosure unit 65 includes enclosing portions 65Y, 65M, 65C, 65K formed of, e.g., a synthetic rubber and adapted for enclosing corresponding arrays of nozzle units 51Y, 51M, 51C, 51K, respectively. In FIGS. 33 and 35, an enclosing portion 65C is shown.

The enclosure unit 65 is provided with a base portion 601 which is fixedly secured to a printer main body 211. The base portion 601 has a shape of a flat plate. The enclosure unit 65 is further provided with springs 611, 612, 613 (not shown), 614 arranged at four corner portions thereof, respectively. The springs 611, 612, 613, 614 have the same urging force with one another to urge the enclosure unit 65 downward. The base portion 601 is further provided with upright supporting blocks 606, 607, 608 (not shown), 609 at a specified position near the springs 611, 612, 613, 614, respectively to support the enclosure unit 65 so that the enclosure unit 65 is prohibited from being moved downward beyond the limit.

The base portion 601 is arranged with upright rod members 602, 603, 604 (not shown), 605 in the form of, for example, a cylinder or a rectangular parallelepipeds at a specified position thereon. The enclosure unit 65 is moved upward and downward along the extending direction of the rod members 602, 603, 604, 605.

As shown in FIGS. 33 and 35, a support frame 651 of the enclosure unit 65 is provided with arm members 661, 671 at an upper left end portion and a lower left end portion on an outer front wall thereof, respectively. The arm members 661, 671 are formed with insertion holes into which the rod member 602 is insertable. On the other hand, the support frame 651 is provided with arm members 662, 672 at an upper right end portion and a lower right end portion thereof, respectively. The arm members 662, 672 are formed with insertion holes into which the rod member 603 is insertable. The arm members 661, 671, 662, 672 are adapted for moving the enclosure unit 65 upward and downward along the rod members 602, 603, 604, 605. Likewise, the support frame 651 is provided with arm members 663, 673, 664, 674 at a rear wall thereof with the same arrangement as the arm members 661, 671, 662, 672 provided in the front wall of the support frame 651.

Further, the support frame 651 of the enclosure unit 65 is formed with hanger arm members 681, 682 at an upper left end portion and an upper right end portion on the front wall thereof. The hanger arm members 681, 682 extend upward by a specified length in such a manner that the hanger arm member 681 extends further upward with its length longer than the hanger arm member 682. The hanger arm members 681, 682 are formed with contact portions 681*a*, 682*a* whose lead end is bent inward, respectively.

On the other hand, the support frame 651 is formed with hanger arm members 683, 684 and contact portions 683*a*, 684*a* at a rear wall thereof at a specified position corresponding to the hanger arm members 681, 682 and the contact portions 681*a*, 682*a* formed in the front wall of the support frame 651.

A support frame 516 of the printing head 51 is provided with hook members 531, 532 at a front wall thereof. The hook members 531, 532 comprise first slanting surfaces 531*a*, 532*a*, second slanting surfaces 531*c*, 532*c*, and horizontal surfaces 531*b*, 531*b*, respectively. On the other hand, the support frame 516 is provided with hook members 541, 542 at a rear wall thereof at a specified position corresponding to the hook members 531, 532, respectively. The hook members 541, 542 comprise first slanting surfaces, 541*a*, 542*a*, second slanting surfaces 541*c*, 542*c*, and horizontal surfaces 541*b*, 542*b*, respectively at a specified position corresponding to the first slanting surfaces 531*a*, 531*b*, the second slanting surfaces 531*c*. 532*c*, and the horizontal surfaces 531*b*, 532*b*.

With this arrangement, as shown in FIG. 33, in the case where the printing head 51 is not in a home position, the enclosure unit 65 is urged downward by the springs 611, 612, 613, 614 to be brought into contact with the supporting blocks 606, 607, 608, 609. Thereby, the enclosure unit 65 is kept in a retracted state from the printing head 51.

On the contrary, in the case where the printing head 51 is returned to the home position to stabilize the ink emission or after the printing operation is finished as shown in FIG. 35, the hook members 531, 541, 532, 542 of the printing head 51 are brought into contact with the contact portions 681*a*, 683*a*, 682*a*, 684*a* of the enclosure unit 65. Thereby, the contact portions 681*a*, 683*a*, 682*a*, 684*a* are moved upward along the slanting surfaces 531*c*, 532*c*, 541*c*, 542*c* despite the urging force of the springs 611, 613, 612, 614 acting downward, and then stably positioned on the horizontal surfaces 531*b*, 532*b*, 541*b*, 542*b*.

Consequently, the enclosure unit 65 is lifted up by a specified distance, and accordingly, as shown in FIG. 35, the enclosure portions 65Y, 65M, 65C, 65K are pressed against nozzle array units of the printing head 51 by an optimum pressure level when the printing head 51 is positioned in the home position.

As mentioned above, the arrangement of the hook members 531, 541, 532, 542 provided in the printing head 51 and the springs 611, 612, 613, 614 and the hanger arm members 681, 682, 683, 684 provided in the enclosure unit 65 makes it possible to move the enclosure unit 65 upward and downward. Accordingly, the provision of a driver mechanism such as a motor for allowing the enclosure unit 65 to move upward and downward can be dispensed with, and power consumption can be reduced.

Further, since the previous elevating mechanism for the rollers 364, 374 and this elevating mechanism for the enclosure unit 65 have the similar construction with each other, elements constituting the previous elevating mechanism can be used for this elevating mechanism, and vice versa to thereby manufacture an ink jet printing apparatus with a simplified construction.

Figure 37A:
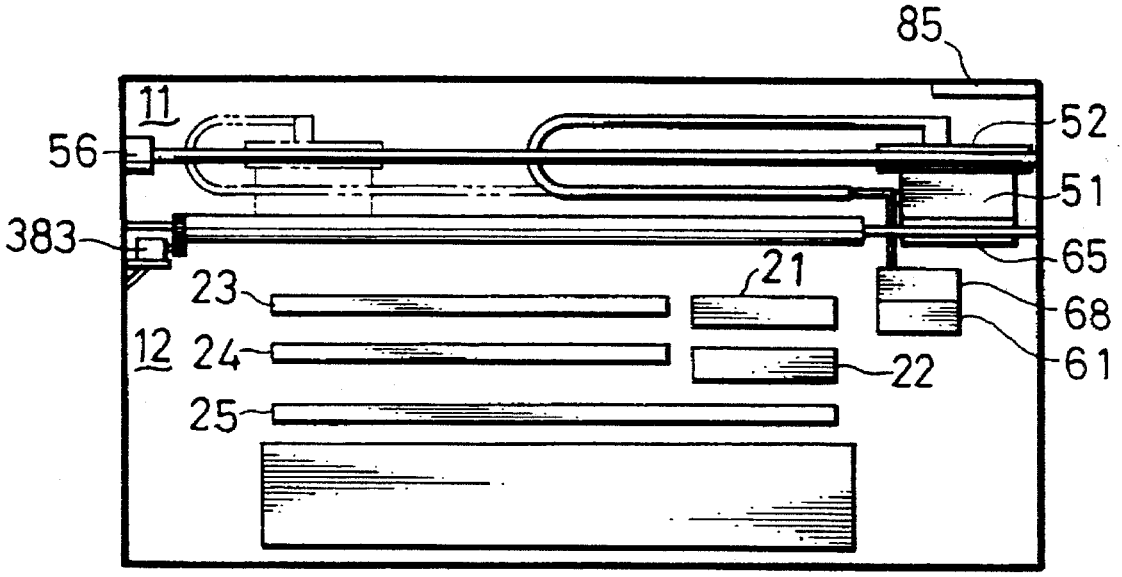
FIG. 37A is a diagram schematically showing a front view of an overall construction of a tenth ink jet printing apparatus according to the present invention.
Figure 37B:
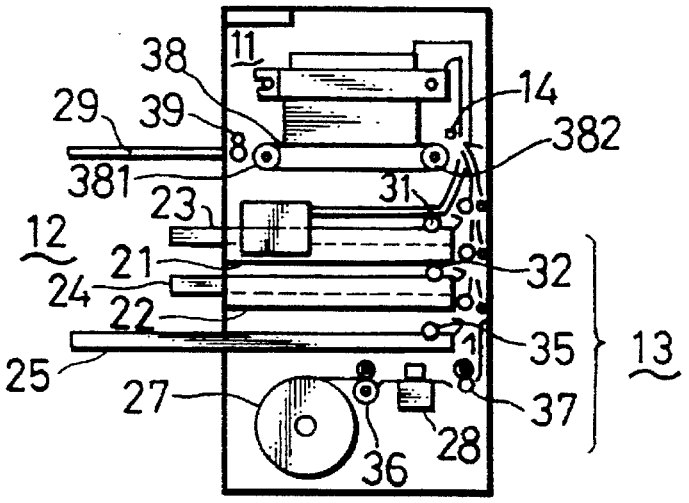
FIG. 37B is a diagram schematically showing a right side view of the overall construction of the tenth apparatus.

A tenth ink jet printing apparatus according to the present invention will be described next with reference to FIGS. 37A to 44. Parts identical to those shown in the first ink jet printing apparatus are indicated at like reference numerals. FIGS. 37A and 37B are schematic diagrams showing an overall construction of the tenth ink jet printing apparatus: FIG. 37A showing a front view of the apparatus; and FIG. 37B showing a right side view of the apparatus.

The ink jet printing apparatus is connected with an unillustrated image generator such as copying machine or personal computer, and adapted for printing an image generated in the image generator on a sheet P of printing paper. The ink jet printing apparatus includes a printing portion 11 in an upper portion thereof, a printing sheet storage portion 12 in a lower portion thereof, and a printing sheet transport assembly 13 in a middle portion.

The printing sheet storage portion 12 includes a plurality of cassettes 21 to 25 for holding different sized printing sheets respectively. The plurality of cassettes 21 to 25 are arranged one over another.

The printing sheet transport assembly 13 transports a printing sheet P from the printing sheet storage portion 12 to the printing portion 11.

The ink jet printing apparatus is further provided with a display unit 85 at an appropriate position on a top surface thereof. The display unit 85 is adapted for displaying the absence of printing sheet in their respective cassettes 21 to 25 in the printing sheet storage portion 12 and the remaining amount of ink in the printing portion 11.

The printing sheet transport assembly 13 comprises: feed rollers 31 to 35 adapted for dispensing printing sheets contained in the corresponding cassettes 21 to 25 one by one; and a transport belt 38.

A construction of the printing portion 11 will be described next with reference to FIGS. 37A to 39B. The printing portion 11 includes a printing head 51, a carriage 52 carrying the printing head 51, a driver mechanism for reciprocally moving the carriage 52 in widthwise directions of the transported printing sheet P, an ink supply system for supplying ink to the printing head 52, and an ink pressure stabilizer for stabilizing the ink pressure of the printing head 51.

Figure 39A:
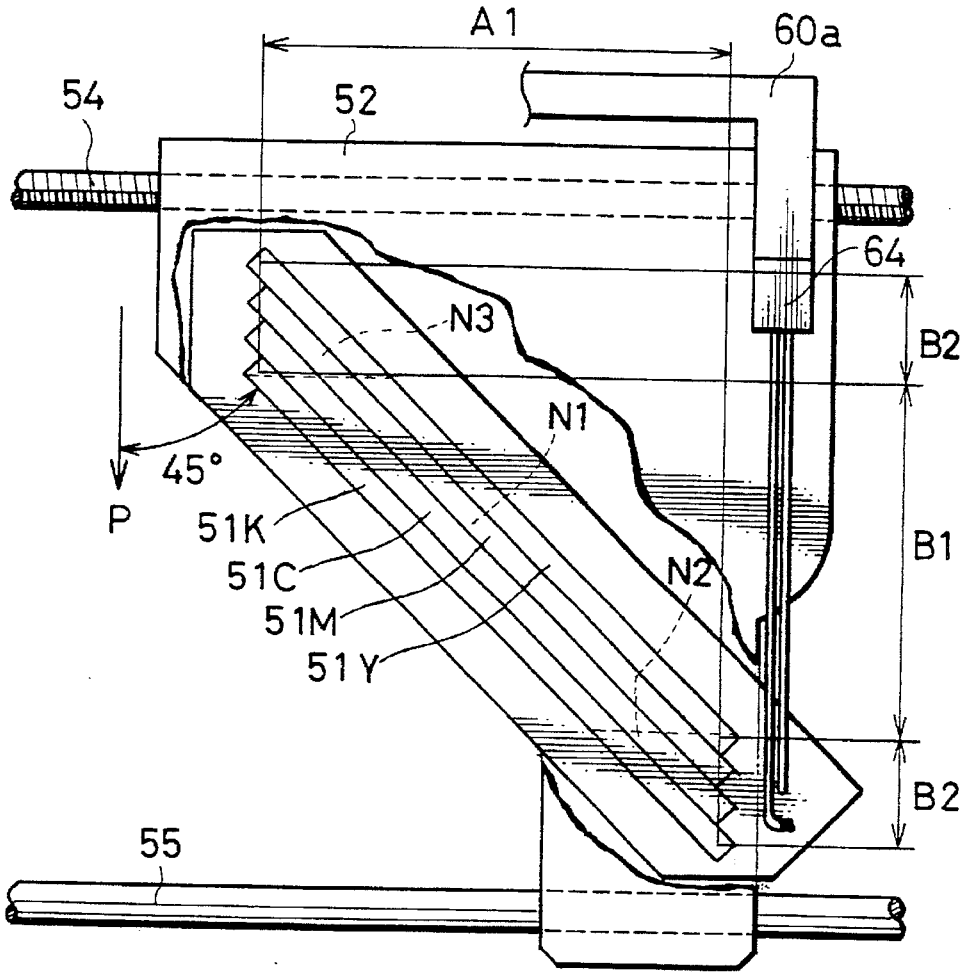
FIG. 39A is a top plan view showing a carriage carrying a printing head in the tenth apparatus.
Figure 39B:
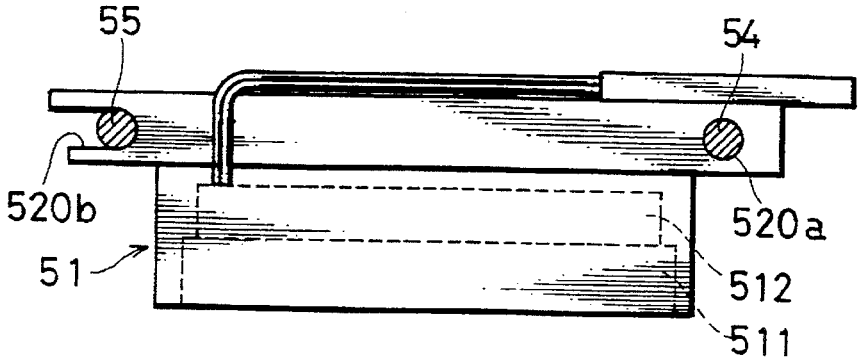
FIG. 39B is a right side view showing the carriage and the printing head.

The printing head 51 has a nozzle portion 511. As shown in FIG. 39A, the nozzle portion 511 has four arrays of nozzle units 51Y, 51M, 51C, 51K adapted for emitting inks having the color of yellow (Y), magenta (M), cyan (C), and black (K), respectively. Also, each nozzle unit array has a length equal to the short side of the A4-sized printing sheet. These inks are superimposedly emitted onto the printing sheet P to thereby print a colored image on the printing sheet P.

The arrays of nozzle units 51Y, 51M, 51C, 51K are preferably arranged having an inclination of 45° with respect to a transport direction of a printing sheet P and have a length equal to the base of an isosceles triangle whose shorter side corresponds to, for example, the shorter side A1 of A-4 sized printing sheet in FIG. 39A. Specifically, the length of the nozzle unit array is set about as 1.4 times long as the shorter side of A-4 sized printing sheet.

The nozzle portion 511 may be provided with an array of nozzle units 51K which emit ink having the color of black (K) to print a black monochromatic image on the printing sheet P.

The carriage 52 carries the printing head 51 and is supported on a screw shaft 54 and a slide shaft 55 which extend in a widthwise direction of the transport belt 38 and which bridges across side walls 58, 59 of the ink jet printing apparatus in such a manner that the screw shaft 54 meshes with a threaded hole 520 *a* formed in one end of the carriage 52 and the slide shaft 55 passes a guide groove 520*b* formed in the other end of the carriage 52. The carriage 52 is reciprocally moved along the shafts 54 and 55.

Figure 38:
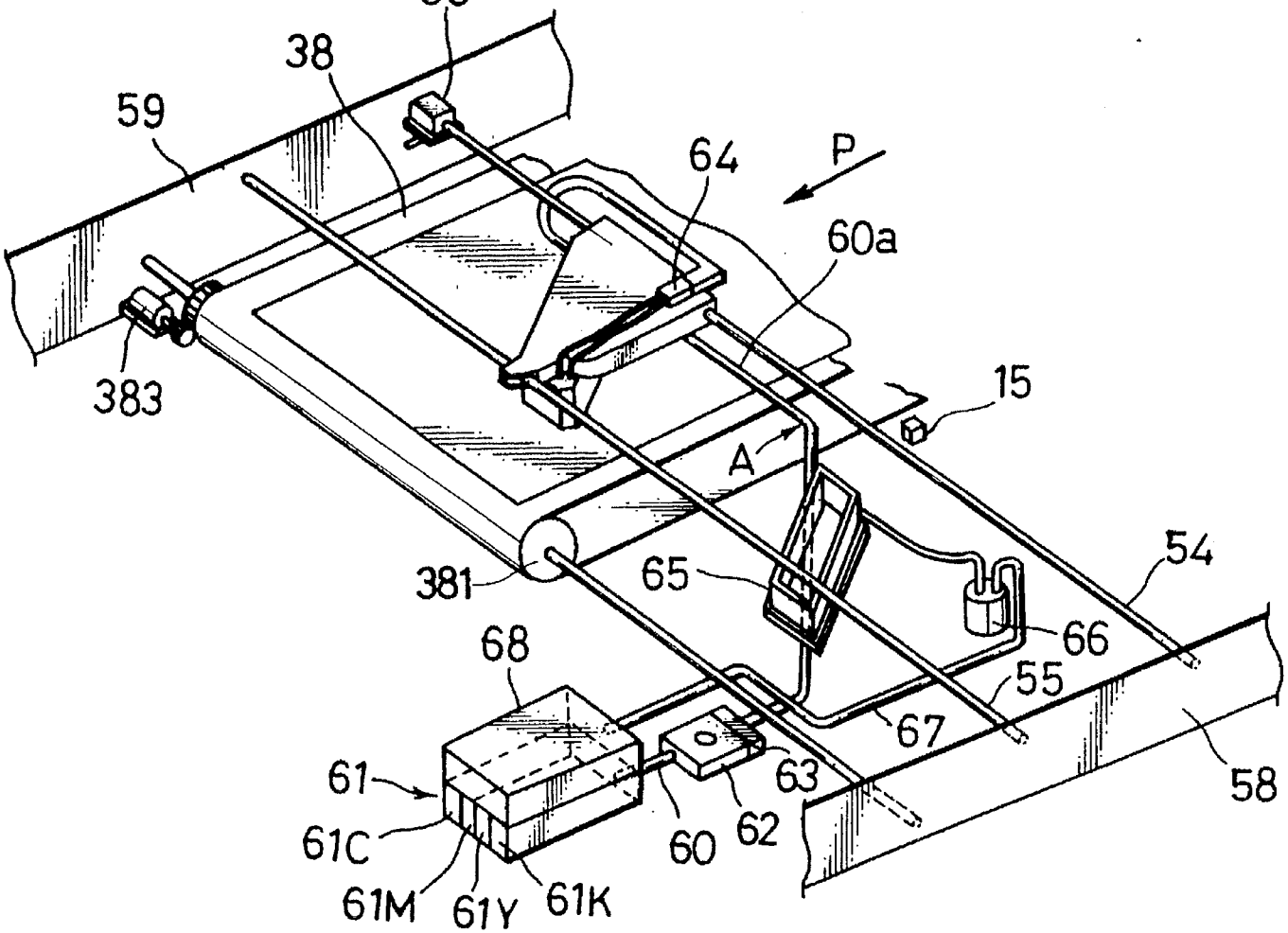
FIG. 38 is a perspective view schematically showing a printing portion of the tenth apparatus.

The ink supply system and the ink pressure stabilizer of this embodiment shown in FIG. 38 are constructed similarly to those of the first embodiment.

Figure 40:
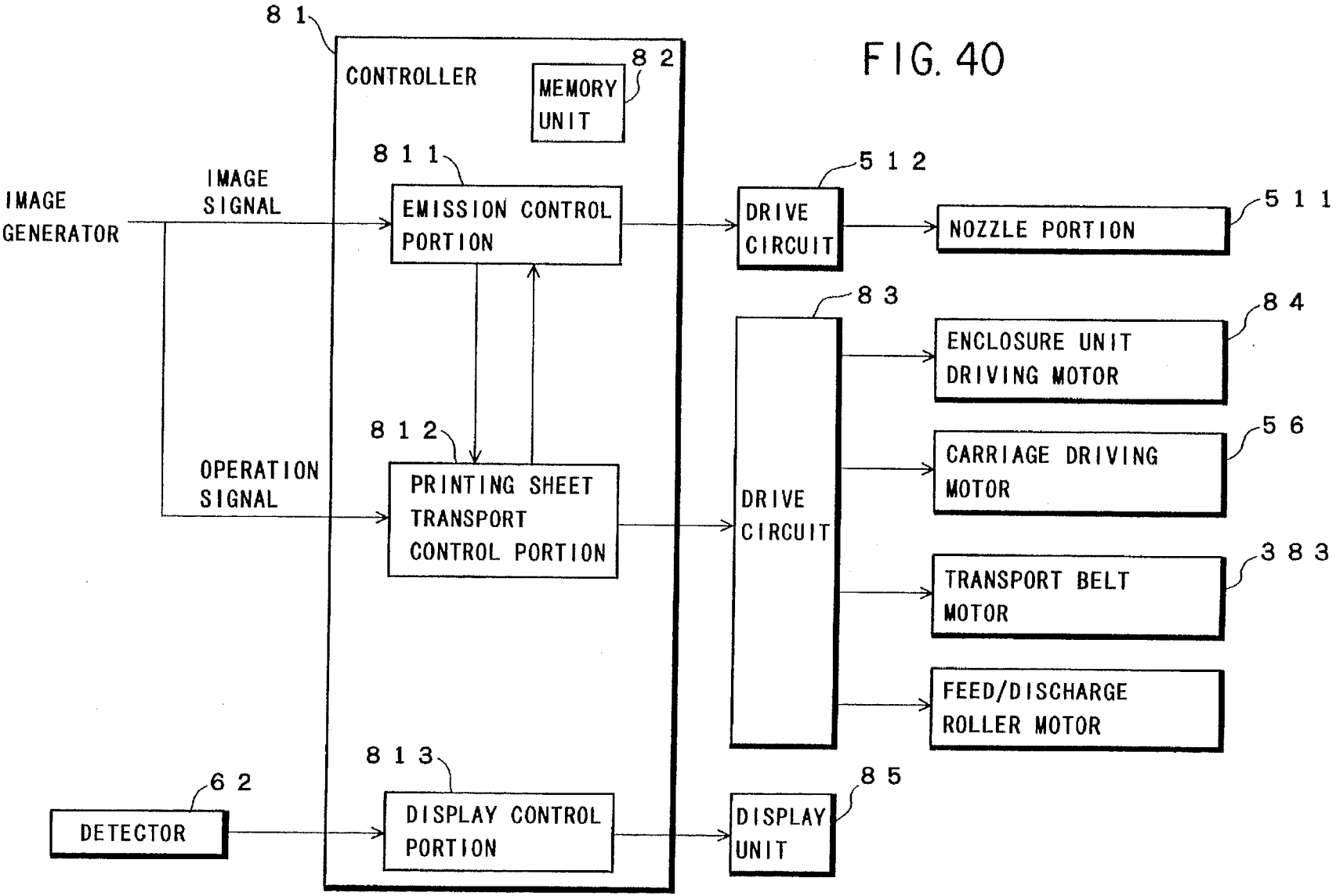
FIG. 40 is a block diagram showing a control system of the tenth apparatus.

Further, a control system of this ink jet printing apparatus shown in a block diagram of FIG. 40 has a similar construction as that of the first embodiment.

When the large-size printing mode is selected, namely, when a printing image has a width larger than the shorter side of A4-size printing sheet, a controller 81 of the ink jet printing apparatus drives a transport belt motor 383 to intermittently transport the printing sheet on the transport belt 38 by a specified distance. In other words, the transporting and staying of the printing sheet are alternately executed at a specified interval. During the time of the printing sheet being stayed, the carriage 52 is moved by a carriage driving motor 56 to execute printing of one-line part of image.

In the large-size printing mode, ink is emitted while the printing head 51 is moved by an emission control portion 811 of the controller 81. Specifically, in FIG. 39A, the emission control portion 811 allows the arrays of nozzle units 51Y, 51M, 51C, 51K to consecutively emit ink from a leading end of the respective nozzles which correspond to a leading end of the printing sheet.

Referring to FIG. 39A, the nozzle portion 511 includes an intermediate nozzle portion N1, a lead end nozzle portion N2, and a trail end nozzle portion N3 with respect to the printing sheet transport direction. The intermediate nozzle portion N1 has a length corresponding to B1 with respect to a printing sheet transport direction; the lead end nozzle portion N2 has a length corresponding to B2 with respect to the printing sheet transport direction; and the trail end nozzle portion N3 has a length corresponding to B2 with respect to the printing sheet transport direction.

At the printing of a first one-line part of image, printing is executed at the intermediate nozzle portion N1 and the trail end nozzle portion N3. At the printing of a second one-line part of image and thereafter, printing is executed at a whole area covering the lead end nozzle portion N2, the intermediate nozzle portion N1, and the trail end nozzle portion N3 while the printing sheet is transported by a distance corresponding to B1 plus B2 plus a nozzle interval when the printing head 51 returned to the start position. It should be appreciated that a nozzle interval corresponds to a distance between centers of the two consecutive nozzles with respect to the printing sheet transport direction. At the printing of a last one-line part of image, printing is executed at the intermediate nozzle portion N1 and the lead end nozzle portion N2.

In other words, the lead end nozzle portion N2 at a presently executed printing and the trail end nozzle portion N3 at a preceding printing print the same area on the printing sheet. In this way, by allowing the lead end nozzle portion N2 at the presently executed printing and the trail end nozzle portion N3 at the preceding printing to print the same area on the printing sheet, colored printing by the arrays of nozzle units 51Y, 51M, 51C, 51K can be executed for a whole area of the printing sheet including an area covered by the intermediate nozzle portion N1.

When the high-speed printing mode is selected, the printing sheet P is transported in the direction shown by the arrow in FIG. 39A while the ink emission control portion 811 driving the nozzle array units 51Y, 51M, 51C, 51K to consecutively emit ink from a trailing end of the nozzles with respect to the printing sheet transport direction. Thereby, printing is executed in an area having a length corresponding to A1 in the widthwise direction of the printing sheet. In this figure, A1 represents the shorter side of A4-size printing sheet.

Figure 41:
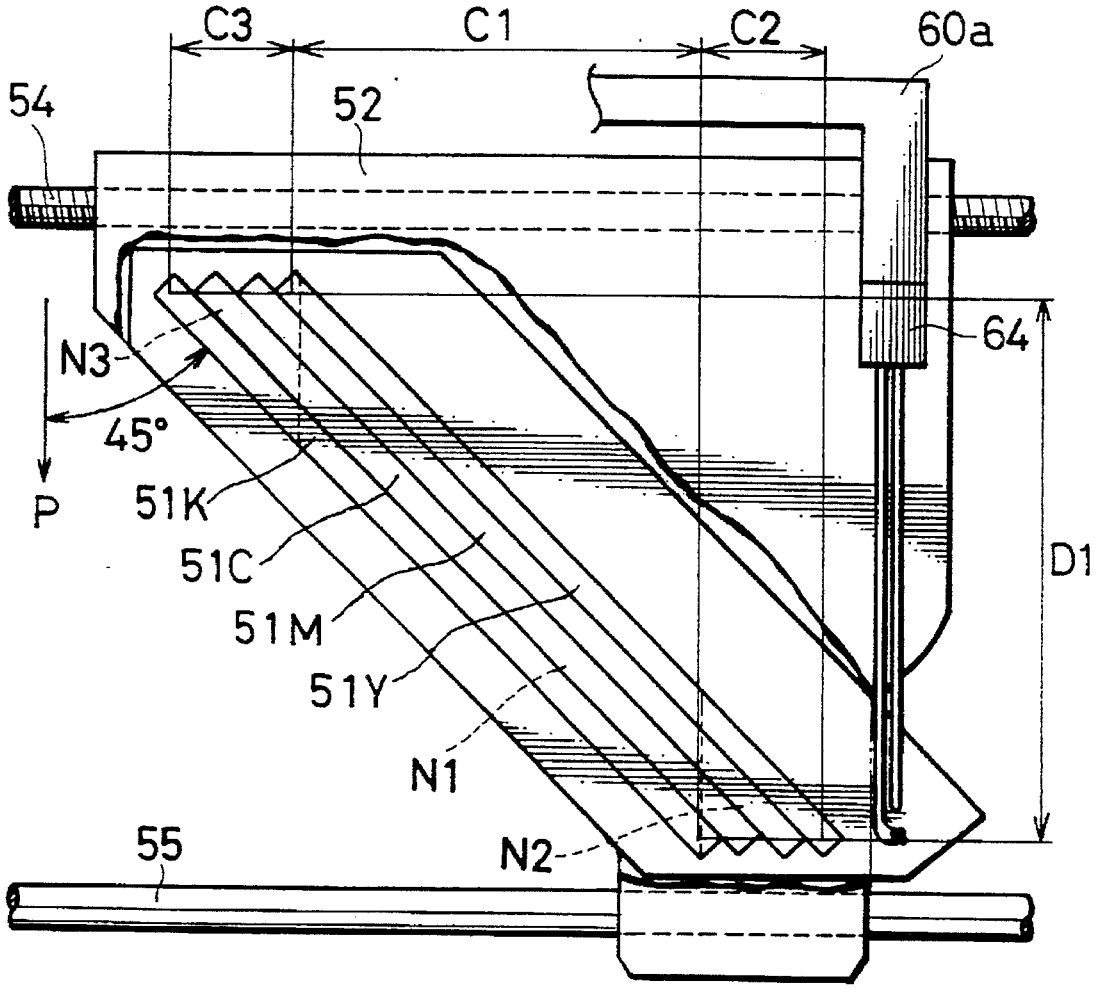
FIG. 41 is a top plan view showing a carriage carrying another printing head.

Alternatively, the nozzle unit arrays 51Y, 51M, 51C, 51K may be arranged as shown in FIG. 41. In this case, the nozzle portion 511 comprises a lead end nozzle portion N2, an intermediate nozzle portion N1, and a trail end nozzle portion N3 with respect to a moving direction of the printing head 51. When the large-size printing mode is selected, printing is executed in a whole area having a length corresponding to D1 with respect to the printing sheet transport direction, namely an area covering N1, N2, and N3.

On the contrary, when the high-speed printing mode is selected, printing is executed only in the intermediate nozzle portion N1 having a length corresponding to C1 with respect to the moving direction of the printing head 51, because in the lead end nozzle portion N2 and the trail end nozzle portion N3, colored-printing using all the four nozzle unit arrays 51Y, 51M, SIC, 51K cannot be realized.

However, in the case where black monochromatic printing in the high-speed printing mode is selected, printing at the lead end nozzle portion N2 and the trail end nozzle portion N3 can be realized as well as printing at the intermediate nozzle portion N1.

Figure 42:
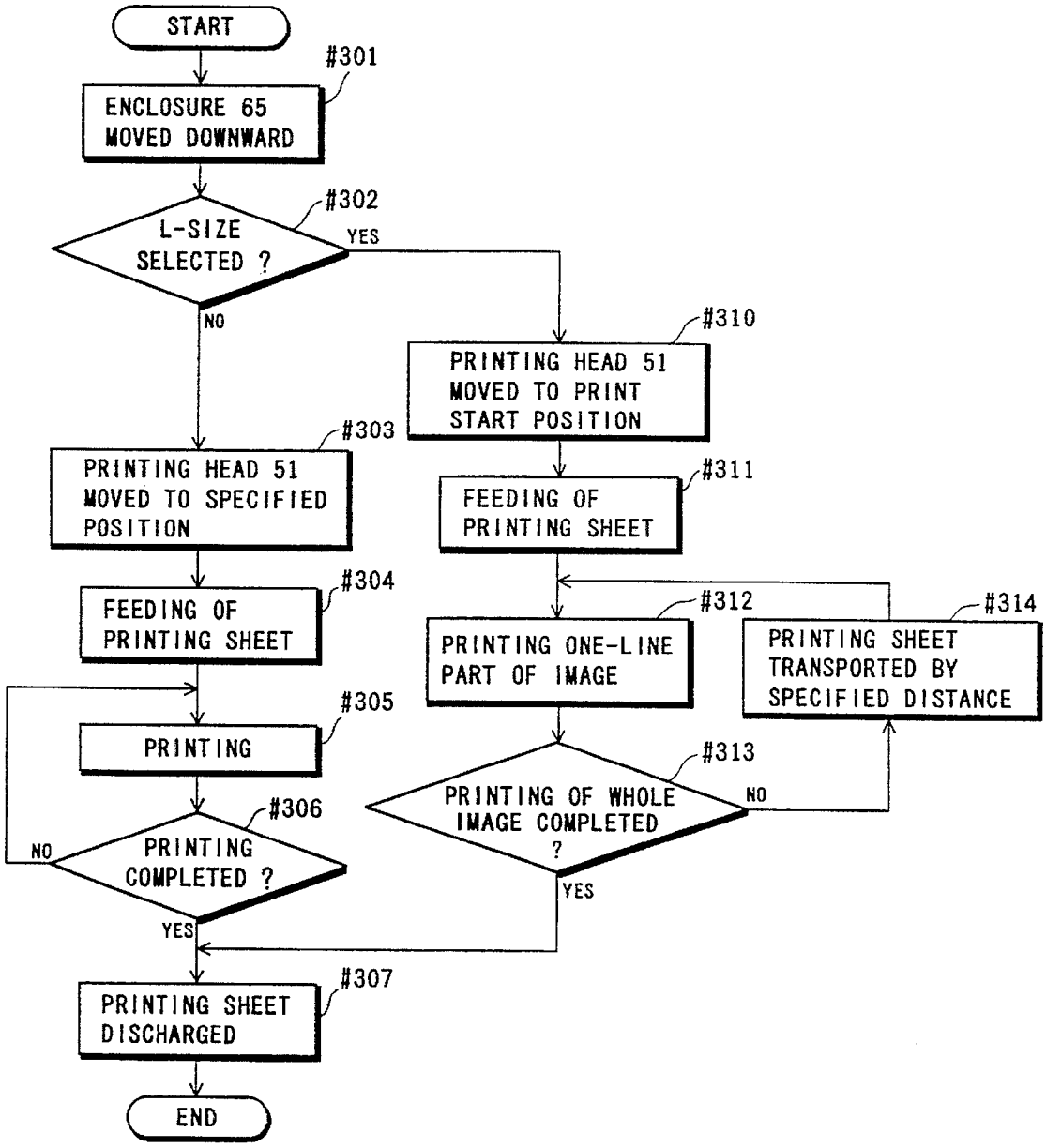
FIG. 42 is a flowchart showing a printing operation of the tenth apparatus.

A printing operation of the ink jet printing apparatus will be described next with reference to a flowchart shown in FIG. 42.

When printing is instructed, an enclosure unit 65 is moved downward and retracted from the printing head 51 (Step #301). Subsequently, a printing mode is selected based on an operation signal sent from the image generator (Step #302). Specifically, in the case that an image is printed on a printing sheet having a width equal to or shorter than the shorter side of A4-size printing sheet, the high-speed printing mode is selected.

On the other hand, in the case that an image is printed on a printing sheet having a width larger than the shorter side of A4-size printing sheet, the large-size printing mode is selected.

In Step #302, when the high-speed printing mode is selected, the printing head 51 is moved to a specified printing position just below which the printing sheet is to be transported (Step #303). After the printing head 51 being set at the specified position, the printing sheet is fed out of the cassette and transported to the transport belt 38 (Step #304). The printing head 51 prints the image on the printing sheet which is being continuously transported at a specified constant speed by the transport belt 38 (Step #305). When the printing is completed (YES in Step #306), the printing sheet is discharged (Step #307). Consequently, this routine ends.

On the contrary, when the large-size printing mode is selected in Step #302, the printing head 51 is moved to a specified printing start position (Step #310).

The printing sheet is fed out of the cassette and transported to the transport belt 38 (Step #311). The transport belt 38 transports the printing sheet to a specified position and stops the transporting to keep the printing sheet at the position. Thereafter, the printing head 51 is moved at a constant speed in the widthwise direction of the printing sheet from the start position while emitting ink in accordance with parallel image signals, consequently printing one-line part of the image (Step #312).

In Step #313, it is judged whether the printing of the whole image is completed. If the printing of the whole image is not finished (NO in Step #313), the printing sheet is transported by a specified distance corresponding to one line part (Step #314). In this time, the printing head 51 is returned to the start position. Thereafter, the printing head 51 is again moved in the widthwise direction while emitting ink in accordance with parallel image signals, to thereby print next one-line part of the image (Step #312). These operations of Steps #312 to #314 are repeated to complete the whole image printing. After the whole image being printed (YES in Step #313), the printing sheet is discharged, and the routine proceeds to Step #307.

As described above, there are the two printing modes which are selectively changeable depending on the size of the printing image or printing sheet. In the case of printing a small-sized image, the high-speed printing mode is selected to print the small-sized image at a high speed. Also, in the case of printing a large-sized image, the large-size printing mode is selected to enable printing of the large-sized image.

Also, the arrays of nozzle units 51Y, 51M, 51C, 51K of the nozzle portion 511 in the printing head 51 are arranged by an inclination of 45° with respect to the printing sheet transport direction and printing is executed by thus inclined nozzle arrays. Accordingly, as far as the nozzle arrays are defined with nozzles having the same nozzle interval with one another, this arrangement makes it possible to attain a printing finish quality having a high resolution compared with a case that printing is executed in a state that a nozzle array is disposed parallel with or perpendicular to the printing sheet transport direction.

In this embodiment, the nozzle arrays are inclined by 45° with respect to the printing sheet transport direction. However, the inclination angle is not limited to 45°.

The relationship between the resolution of printed image and the inclination angle of nozzle arrays with respect to the printing sheet transport direction will be described with reference to FIGS. 43A and 43B.

The resolution of printed image with respect to the inclined nozzle arrays varies according to the nozzle interval. The resolution of printed image with respect to the printing sheet transport direction is determined based on an ink emission frequency and a sheet transport speed. Accordingly, the resolution of printed image with respect to the printing sheet transport direction can be desirably set at an optimum level considering an ink emission frequency and a sheet transport speed provided that the size of ink dots produced on the printing sheet P be negligible. Ink dots are required to have a suitable size to attain an optimum resolution for printed image.

In the foregoing embodiments in which ink emission is conducted by using piezoelectric conversion elements provided in nozzles of the nozzle arrays, the size of ink dot is changeable by changing the voltage applied to the piezoelectric conversion element. Accordingly, the size of ink dot can be optimally set in the foregoing embodiments.

However, it should be appreciated that the ink emission frequency and the transport speed of printing sheet are set at a constant value in this embodiment to explain how the inclination angle of nozzle arrays affects the resolution of printed image.

Figure 43A:
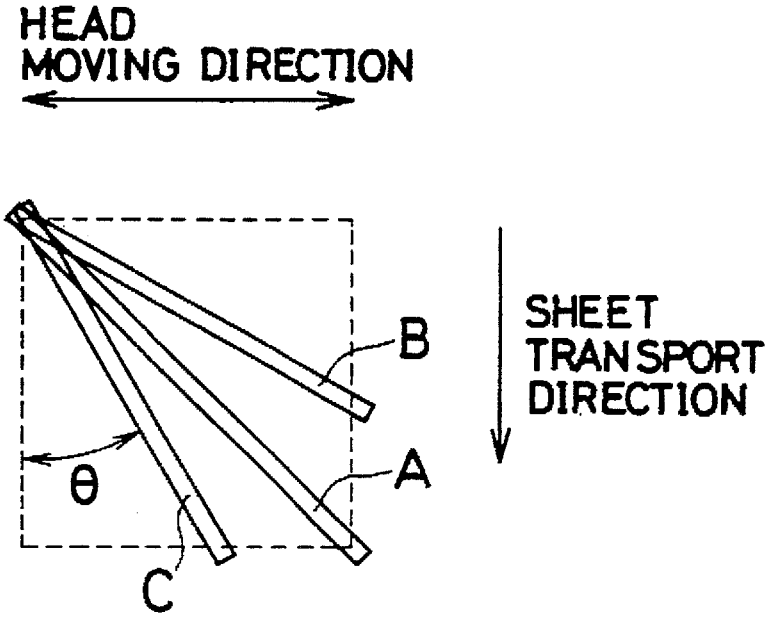
FIGS. 43A and 43B are diagrams showing relationships between inclined nozzle arrays and sheet transport in the tenth apparatus.
Figure 43B:
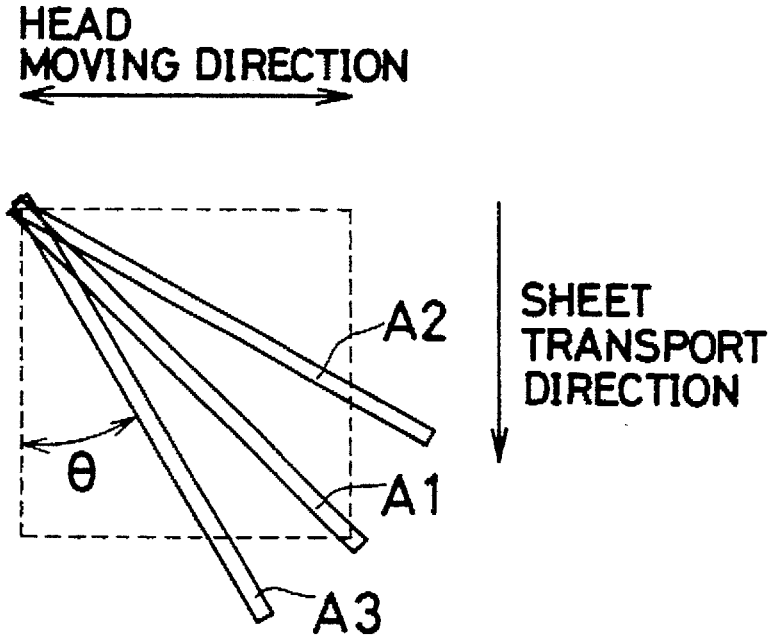

FIGS. 43A and 43B show states that an inclination angle θ of the nozzle array with respect to the printing sheet transport direction is set at various values. In FIG. 43A, nozzle arrays A, B, C having different lengths and provided with the same number of nozzles are used: the nozzle array A having an inclination angle θ=45°; the nozzle array B having an inclination angle θ>45°; and the nozzle array C having an inclination angle θ<45°. In FIG. 43B, the nozzle array A is arranged in three different angular positions A1 (θ=45°), A2 (θ>45°), and A3 (θ<45°).

Comparing the nozzle array A having the inclination angle θ of 45° and the nozzle array B having the inclination angle θ larger than 45° in FIG. 43A, the nozzle arrays A and B are designed to cover the same area with respect to the moving direction of the printing head 51. This is because the nozzle arrays A and B have the same number of nozzles with each other and are inclined by a specified angle so as to attain the same level of resolution with respect to the moving direction of the printing head 51.

With this arrangement, as the inclination angle θ is increased, the resolution with respect to the printing sheet transport direction is improved. However, the one-line part of image to be printed by moving the printing head 51 is reduced in the lengthwise direction of the printing sheet.

On the contrary, comparing the nozzle array A having the inclination angle θ of 45° and the nozzle array C having the inclination angle θ smaller than 45° in FIG. 43A, the nozzle arrays A and C are designed to cover the same area with respect to the printing sheet transport direction. This is because the nozzle arrays A and C have the same number of nozzles with each other and are inclined by a specified angle so as to attain the same level of resolution with respect to the printing sheet transport direction.

With this arrangement, as the inclination angle θ is decreased, the resolution with respect to the moving direction of the printing head 51 is improved. However, as the inclination angle θ is decreased, the printing area with respect to the moving direction of the printing head 51 is reduced. Accordingly, when the high-speed printing mode is selected and the printing head 51 is stopped in a state that the inclination angle is decreased, the size of printing sheet is limited in the widthwise direction.

Referring to FIG. 43B in which the nozzle array A is positioned in three different positions A1, A2, and A3, as the nozzle array A has its position changed from A3 to A1 and from A1 to A2 in this order in such a direction to increase the inclination angle, the resolution with respect to the printing sheet transport direction is improved. However, the one-line part of image to be printed by moving the printing head 51 is reduced in the lengthwise direction of the printing sheet.

On the contrary, as the inclination angle is increased, the resolution with respect to the moving direction of the printing head 51 is deteriorated. However, as the inclination angle is increased, the printing area with respect to the moving direction of the printing head 51 is increased. Accordingly, when the high-speed printing mode is selected and the printing head 51 is stopped in a state that the inclination angle is increased, printing can be performed on a printing sheet having a larger size in the widthwise direction.

For example, when the inclination angle θ is set to 26.57°, a ratio of an area covered by the nozzle array A in the moving direction of the printing head 51 to that in the printing sheet transport direction becomes 1:2. Consequently, the resolution with respect to the moving direction of the printing head 51, that is, with respect to the widthwise direction of printing sheet is improved twice.

In this case, when the resolution with respect to the printing sheet transport direction is desired to be improved twice, it is appropriate to double the ink emission frequency or to decrease the transport speed of printing sheet to one half. In the former case, the printing speed is not changed. In the latter case, the printing speed is decreased to one half.

Figure 44:
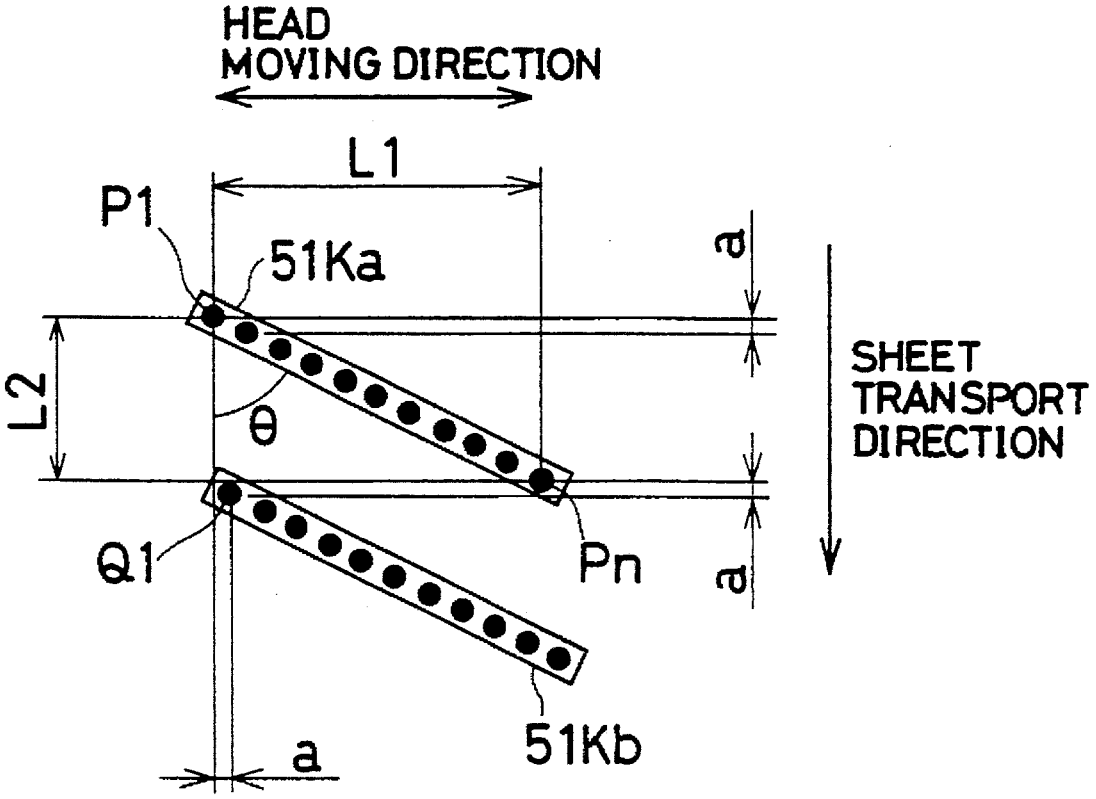
FIG. 44 is a diagram showing another nozzle array arrangement in the ten apparatus.

A modified nozzle array arrangement will be described next with reference to FIG. 44 in which a round mark in solid black represents a nozzle.

In this arrangement, a nozzle portion 511 of a printing head 51 includes a nozzle array 51Ka and a nozzle array 51Kb. The nozzle array 51Kb is arranged at a lead end portion of the nozzle portion 511 with respect to the sheet transport direction, while the nozzle array 51Ka is arranged at a trail end portion thereof. The nozzle arrays 51Ka, 51Kb are disposed parallel with each other and adapted for emitting ink having the black color (K) to execute black monochromatic printing.

The nozzle arrays 51Ka, 51Kb are formed with a number of nozzles (i.e., n nozzles) respectively and are inclined with respect to the printing sheet transport direction having an inclination angle θ=63.43° so that the ratio of a length L1 in a moving direction of the printing head 51 to a length L2 in the printing sheet transport direction is set to 2:1. The respective nozzles of the nozzle arrays 51Ka, 51Kb are spaced apart from one another by an interval corresponding to a distance a with respect to the printing sheet transport direction.

The nozzle array 51Ka has a first nozzle P1 at a trail end thereof in the printing sheet transport direction and an n-th nozzle Pn at a lead end thereof in the printing sheet transport direction. The nozzle array 51Kb has a first nozzle Q1 at a trail end thereof in the printing sheet transport direction. The first nozzle Q1 of the nozzle array 51Kb is shifted from the first nozzle P1 of the nozzle array 51Ka by a distance a in the moving direction of the printing head 51. The first nozzle Q1 is shifted from the n-th nozzle Pn of the nozzle array 51Ka by a distance a in the printing sheet transport direction.

With this arrangement, the same level of resolution with respect to the moving direction of the printing head 51 and with respect to the printing sheet transport direction is obtainable. Further, the nozzle interval for obtaining the same level of resolution can be lengthened compared with the case that the nozzle portion 511 comprises a single nozzle array and the single nozzle array is inclined by 45° with respect to the printing sheet transport direction. Accordingly, the number of nozzles in a nozzle array having the same length can be reduced, thereby facilitating production of the printing head 51.

Alternatively, the nozzle portion 511 may comprise three nozzle arrays arranged parallel with one another and each nozzle array may be inclined having an inclination angle $\theta=71.57°$ with respect to the printing sheet transport direction so as to attain the ratio of L1:L2=3:1.

In this way, by altering the inclination angle $\theta$, the nozzle portion 511 can have a desired number of nozzle arrays.

Further, in order to enable printing of a colored image, a nozzle array 51Y may be arranged at a specified position corresponding to the nozzle array 51Ka, while another nozzle array 51Y may be arranged at a specified position corresponding to the nozzle array 51Kb. Further, a pair of nozzle arrays 51M, 51C, 51K may be positioned parallel with each nozzle array 51Y, thereby the nozzle portion 511 constituting two pairs of nozzle arrays 51Y, 51M, 51C, 51K.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An ink jet printing apparatus comprising:

a printing head operable to emit ink onto a printing sheet, the printing head being moveable along a first direction;

a sheet transporter operable to transport the printing sheet along a second direction perpendicular to the first direction;

a head moving mechanism operable to reciprocally move the printing head along the first direction; and a controller which controls the sheet transporter and the head moving mechanism to execute a first printing mode of moving the printing head while holding the printing sheet in a stationary position and a second printing mode of moving the printing sheet while holding the printing head at a stationary position.

2. An ink jet printing apparatus as defined in claim 1 wherein the printing head is an elongate printing head having a longitudinal axis, said printing head comprising a plurality of ink emission nozzles having leading ends disposed along a nozzle plane, and a head rotating mechanism operable to rotate the printing head about a pivot axis perpendicular to said nozzle plane to a first position corresponding to said first printing mode in which the longitudinal axis is parallel with the second direction and to a second position corresponding to said second printing mode in which the longitudinal axis of said printing head is parallel with the first direction.

3. An ink jet printing apparatus as defined in claim 2 wherein the head moving mechanism includes:

a carriage carrying the printing head;

a support shaft having a longitudinal axis extending along the first direction and operable to support the carriage; and a driver operable to move the carriage along the support shaft.

4. An ink jet printing apparatus as defined in claim 3 wherein:

the carriage is formed with a threaded hole having a longitudinal axis extending along the first direction;

the support shaft is threaded on an outer surface and engages the threaded hole formed in the carriage; and the driver includes a motor operable to rotate the threaded support shaft about its longitudinal axis to move the carriage along the first direction.

5. An ink jet printing apparatus as defined in claim 3 wherein the head rotating mechanism includes:

a stem shaft rotatably supported on the carriage and connected with the printing head, the stem shaft having a longitudinal axis extending along the pivot axis;

a wheel disposed in the carriage and coaxially fixedly attached to the stem shaft; and a motor disposed on the carriage and operable to rotate the wheel.

6. An ink jet printing apparatus as defined in claim 5 further comprising a joint operable to connect the stem shaft with the printing head, the joint including:

a first connecting rod fixedly attached to a terminal end of the stem shaft, the first connecting rod having an axis extending along a direction perpendicular to the longitudinal axis of the stem shaft;

a second connecting rod fixedly attached on an upper portion of the printing head, the second connecting rod having a longitudinal axis extending in a direction perpendicular to the longitudinal axis of the first connecting rod; and a connecting block connecting the first connecting rod with the second connecting rod, the connecting block being rotatable about the first and second connecting rods.

7. An ink jet printing apparatus as defined in claim 3 wherein the head rotating mechanism includes:

a stem shaft rotatably supported in the carriage and connected with the printing head, the stem shaft having a longitudinal axis extending along the pivot axis;

a spring member provided between the carriage and the printing head to urge the printing head to the first position;

said head moving mechanism being operable to reciprocally move said printing head along a reciprocal movement path in the first direction, a guide member provided at a specified position along the reciprocal movement path of the printing head and operable to come into contact with the moving printing head to rotate the printing head from the first position to the second position.

8. An ink jet printing apparatus as defined in claim 7 wherein the guide member includes:

a curved portion operable to come into contact with the moving printing head to rotate the printing head; and a straight portion operable to retain the printing head in the second position.

9. An ink jet printing apparatus as defined in claim 7 further comprising a retainer operable to retain the printing head in the first position, the retainer including:

a presser member provided on the carriage and movable in parallel with the pivot axis;

a spring operable to push the presser member against the printing head to retain the printing head at the first position; and a releasing mechanism operable to release the retaining of the printing head, the releasing mechanism having a contact portion.

10. An ink jet printing apparatus as defined in claim 9 wherein the guide member includes an actuating portion operable to come into contact with the contact portion of the releasing mechanism to actuate the releasing mechanism when the printing head moves in the first direction.

11. An ink jet printing apparatus as defined in claim 3 further comprising a stem shaft supported on the carriage and connected with the printing head to support the printing head, the stem shaft position shown in FIG. 2 extending along the pivot axis; and a spring provided between the carriage and the printing head and around the stem shaft to urge the printing head toward a printing sheet.

12. An ink jet printing apparatus as defined in claim 11 wherein the printing head includes a roller operable to come into contact with a printing sheet to maintain a gap between the printing head and the printing sheet.

13. An ink jet printing apparatus as defined in claim 3 wherein the carriage includes a retainer operable to retain the printing head at the first position or the second position.

14. An ink jet printing apparatus as defined in claim 13 wherein the retainer includes:

a presser member provided on the carriage and movable in parallel with the pivot axis; and a spring operable to push the presser member against the printing head to retain the printing head at the first position or the second position.

15. An ink jet printing apparatus as defined in claim 14 wherein:

the presser member has a terminal end, said pressing member being formed with a slanting surface at the terminal end; and the printing head is formed with a first recess at a position facing the presser member when the printing head is in the first position and a second recess at a position facing the presser member when the printing head is in the second position, the first and second recesses being formed with a slanting surface engageable with the slanting surface formed at the terminal end of the presser member.

16. An ink jet printing apparatus as defined in claim 13 wherein the head moving mechanism is operable to reciprocally move the printing head in the first direction along a reciprocal movement path, the retainer includes:

a first holder provided on the carriage and operable to hold an end of the printing head when the printing head is in the first position; and a second holder provided at an end of the reciprocal movement path of the printing head and operable to hold the end of the printing head when the printing head is in the second position.

17. An ink jet printing apparatus as defined in claim 13 wherein the retainer includes:

a first holder provided on the carriage and operable to hold an end of the printing head when the printing head is in the first position; and a second holder provided on the carriage and operable to hold the end of the printing head when the printing head is in the second position.

18. An ink jet printing apparatus as defined in claim 1 wherein the head moving mechanism is operable to reciprocally move the printing head in the first direction along a reciprocal movement path, the sheet transporter includes:

a single endless belt provided below the reciprocal movement path of the printing head, the single endless belt being rotatable along the second direction and operable to transport both a printing sheet for the first printing mode and a printing sheet for the second printing mode; and a motor operable to drive the single endless belt.

19. An ink jet printing apparatus as defined in claim 18 further comprising an enclosure unit operable to enclose the printing head when is in a non-use state, the enclosure unit being disposed near one side of the single endless belt.

20. An ink jet printing apparatus as defined in claim 1 wherein the head moving mechanism is operable to reciprocally move the printing head in the first direction along a reciprocal movement path, the sheet transporter includes:

a first endless belt provided below the reciprocal movement path of the printing head in the first printing mode, the first endless belt being rotatable along the second direction and operable to transport a printing sheet for the first printing mode;

a second endless belt provided below the printing head when the printing head is in the stationary position, the second endless belt being rotatable along the second direction and operable to transport a printing sheet during the second printing mode; and a motor operable to drive the first and second endless belts.

21. An ink jet printing apparatus as defined in claim 20 further comprising an enclosure unit operable to enclose the printing head when is in a non-use state, the enclosure unit being disposed between the first and second endless belts.

22. An ink jet printing apparatus as defined in claim 1 wherein the head moving mechanism is operable to move the printing head along a reciprocal movement path in the first direction, further comprising a sheet storage portion, the sheet storage portion including:

a first storing unit arranged below the reciprocal movement path of the printing head and operable to store printing sheets having short width;

a second storing unit arranged at the same level as the first storing unit and operable to store printing sheet having an intermediate width; and a third storing unit arranged above or below the first and second storing units and operable to store printing sheet having a long width.

23. An ink jet printing apparatus as defined in claim 1 wherein the head moving mechanism is operable to move the printing head along a reciprocal movement path in the first direction wherein:

the printing head is provided with an ink emission nozzle array consisting of a plurality of nozzles;

the sheet transporter includes:

a first endless belt provided below the reciprocal movement path of the printing head in the first printing mode, the first endless belt being rotatable along the second direction and being operable to transport a printing sheet for the first printing mode;

a second endless belt provided below the printing head when the printing head is in the stationary position, the second endless belt being rotatable along the first direction and being operable to transport a printing sheet for the second printing mode;

a first motor operable to drive the first endless belt;

a second motor operable to drive the second endless belt;

the head moving mechanism includes:

a carriage fixedly carrying the printing head with the ink emission nozzle array along the second direction;

a support shaft having an axis extending along the first direction over the first and second endless belts and operable to support the carriage; and a driver operable to move the carriage along the support shaft.

24. An ink jet printing apparatus as defined in claim 23 further comprising a sheet storage portion, the sheet storage portion including:

a first storing unit arranged below the first endless belt and operable to store printing sheets having a long width; and a second storing unit arranged below the second endless belt and operable to store printing sheets having a short width.

25. An ink jet printing apparatus as defined in claim 24 wherein the second storing unit includes:

a first cassette operable to store printing sheets having a short width;

a second cassette operable to store printing sheet having a short width, the second cassette being arranged below the first cassette.

26. An ink jet printing apparatus as defined in claim 24 further comprising:

a main support frame carrying the printing head, the head moving mechanism, the controller, the first endless belt, and the first storing unit;

a secondary support frame carrying the second endless belt and the second storing unit; and detachable connecting means for detachably connecting the secondary support frame to the main support frame.

27. An ink jet printing apparatus as defined in claim 26 wherein the detachable connecting means includes a hook member on a side of the printing head; and a hanger member on the secondary support frame near a side of the second endless belt;

the hanger member being:

movable in a height direction relative to the second endless belt;

the hanger member being engageable with the hook member when the printing head is placed in the stationary position; and the hanger member being attached with a rod having a longitudinal axis extending along a width of the second endless belt and between upper and lower stretches of the second endless belt;

whereby the rod is moved up to push up the upper stretch of the second endless belt and retain a gap between the printing head and the second endless belt when the hook member engages the hanger member.

28. An ink jet printing apparatus as defined in claim 23 further comprising a sheet storage portion, the sheet storage portion including:

a first storing unit arranged below the first endless belt and operable to store printing sheets having an intermediate width;

a second storing unit arranged below the first endless belt and operable to store printing sheets having a shorter width; and a third storing unit arranged above or below the first and second storing unit and operable to store printing sheets having a longer width.

29. An ink jet printing apparatus as defined in claim 23 further comprising a dryer operable to dry up ink emitted on a printing sheet.

30. An ink jet printing apparatus as defined in claim 29 wherein the dryer includes:

an air current directing member attached on the carriage, the air current directing member having an inlet opening and an outlet opening facing a printing sheet; and a fan provided in the air current directing member to enhance the air flow.

31. An ink jet printing apparatus as defined in claim 30 further comprising:

a fan driver operable to rotate the fan; and a fan controller operable to control the fan driver to rotate the fan only when the second printing mode is executed.

32. An ink jet printing apparatus as defined in claim 30 further comprising:

an air deflector provided near the inlet opening and covering a half of the inlet opening, the air deflector being operable to introduce into the air current directing member a relative air flow caused by the reciprocal movement of the carriage.

33. An ink jet printing apparatus as defined in claim 32 wherein the air deflector is pivotally shiftable by the relative air flow.

34. An ink jet printing apparatus as defined in claim 30 further comprising a heater provided in the air current directing member.

35. An ink jet printing apparatus as defined in claim 34 further comprising a heater controller operable to control the heater to generate more heat in the second printing mode than in the first printing mode.

36. An ink jet printing apparatus as defined in claim 34 further comprising a fixed deflecting plate member provided near the stationary position of the printing head during the second printing mode and operable to deflect the air flowed from the air current directing member to a printing sheet.

37. An ink jet printing apparatus as defined in claim 29 wherein the dryer includes:

a heat reflecting member provided near the stationary position of the printing head during the second printing mode and over the sheet transporter, the heater reflector member having an opening facing a printing sheet; and a heater provided in the heat reflecting member.

38. An ink jet printing apparatus as defined in claim 37 further comprising an air current directing member attached on the carriage, the air current directing member having an inlet opening and an outlet opening facing a printing sheet, the air current directing member being operable to direct air to a printing sheet.

39. An ink jet printing apparatus as defined in claim 38 further comprising a communication pipe operable to communicate the heat reflecting member and the air current directing member, and a fan provided in the communication pipe.

40. An ink jet printing apparatus as defined in claim 1 wherein:

the printing head is provided with an ink emission nozzle array consisting of a plurality of nozzles, the ink emission nozzle array being inclined with respect to the second direction; and the head moving mechanism includes:

a carriage fixedly carrying the printing head; and a support shaft extending along the first direction and operable to support the carriage.

41. An ink jet printing apparatus as defined in claim 40 wherein the ink emission nozzle array is inclined at 45° with respect to the second direction.

42. An ink jet printing apparatus as defined in claim 40 wherein the printing head is provided with a plurality of ink emission nozzle arrays each of, the plurality of ink emission nozzle arrays comprising:

first to n-th nozzles arranged along the first direction, one nozzle being spaced from another by a first specified distance along the second direction;

the nozzles being arranged in parallel with one another with respect to the second direction;

being the nozzles inclined with respect to the second direction at an included angle greater than 45°;

the nozzles of one array being shifted from those of another array by a second specified distance along the first direction; and the n-th nozzle of one array being spaced from the first nozzle of next array by the first specified distance along the second direction.

43. An ink jet printing apparatus as defined in claim 40 wherein the printing head is provided with a plurality of ink emission nozzle arrays, each of the plurality of ink emission nozzle arrays comprising:

first to n-th nozzles arranged along the second direction, one nozzle being spaced from another by a first specified distance along the first direction;

the nozzles being arranged in parallel with one another with respect to the first direction;

the nozzles being inclined with respect to the first direction at an included angle greater than 45°;

the nozzles of one array the nozzles being shifted from those of another array by a second specified distance along the second direction; and the n-th nozzle of one array being spaced from the first nozzle of next array by the first specified distance along the first direction.

44. An ink jet printing apparatus as defined in claim 1 wherein: the printing head includes:

an ink emission nozzle array comprising a plurality of nozzles; and a nozzle driver operable to drive the plurality of nozzles;

the controller includes:

a nozzle driver controlling portion to control the nozzle driver to emit ink at a shorter period in the second printing mode than in the first printing mode.

45. An ink jet printing apparatus as defined in claim 1 wherein the first printing mode is executed for a printing sheet having a wide width and the second printing mode is executed for a printing sheet having a narrow width.

46. An ink jet printing apparatus as defined in claim 1 wherein said controller controls the sheet transporter and the head moving mechanism to execute said first printing mode by moving said printing head in said first direction while holding the printing sheet in a stationary position, said controller controlling the sheet transporter and the head moving mechanism to execute said second printing mode by moving said printing sheet in said second direction while holding the printing head in a stationary position, said first direction being substantially perpendicular to said second direction.

47. An ink jet printing apparatus as defined in claim 1 wherein said controller upon executing said first printing mode is operable to control the sheet transporter to execute said first printing mode in two sub-operations wherein in one sub-operation the printing sheet is in one stationary position and in another sub-operation the printing sheet is in another stationary position.

48. An ink jet printing apparatus as defined in claim 47 wherein said controller upon executing said first printing mode is operable to control said sheet transporter to move said printing sheet from said one stationary position to said other stationary position.

49. An ink jet printing apparatus as defined in claim 47 wherein said controller upon executing said first printing mode is operable to control said head moving mechanism to move said printing head along a reciprocable path, said reciprocable path having one end which is a home position, said controller upon executing said first printing mode being operable to control said head moving mechanism to move said printing head to said home position prior to executing said first sub-operation and prior to executing said second sub-operation.

50. An ink jet printing apparatus as defined in claim 47 wherein the ink jet printing apparatus is operable to print an image generated from an image generator, said image having a width, said printing head having a longitudinal length less than said width, said controller upon executing said one sub-operation being operable to execute printing of one part of said image on one part of said printing sheet, said controller upon executing said other sub-operation being operable to execute printing of another part of said image on another part of said printing sheet.

51. An ink jet printing apparatus as defined in claim 1 wherein said printing head comprises an elongated ink emission nozzle structure having an elongate axis, said printing head further comprising a carriage, and pivot means pivoting said nozzle structure relative to said carriage structure about a pivot axis which is perpendicular to said elongate axis.

52. An ink jet printing apparatus as defined in claim 51 wherein said nozzle structure is pivotal about said pivot axis to a first pivotal position in which said elongate axis of said nozzle structure is perpendicular to said first direction when said controller executes said first printing mode, said nozzle structure being pivoted about said pivot axis to a second pivotal position in which said elongate axis of said nozzle structure is perpendicular to said second direction when said controller executes said second printing mode.

53. An ink jet printing apparatus as defined in claim 1 comprising an elongated guide means on which said printer head is movably guided, said elongated guide means having a longitudinal axis parallel to said first direction, said head moving mechanism being operable to move said printing head along said guide means when said controller executes said first printing mode, said controller precluding movement of said printing head along said guide means when said controller executes said second printing mode.

54. An ink jet printing apparatus as defined in claim 1 wherein said printing head is an elongate printing head having a longitudinal axis, said longitudinal axis being disposed at an acute angle relative to said first direction during said first printing mode, said longitudinal axis being disposed at an acute angle relative to said second direction during said second printing mode.

55. An ink jet printing apparatus as defined in claim 54 wherein said acute angles are equal to one another.

56. An ink jet printing apparatus comprising:

a printing head operable to emit ink onto a printing sheet, the printing head being moveable along a first direction;

a sheet transporter operable to transport the printing sheet along a second direction perpendicular to the first direction;

a head moving mechanism operable to reciprocally move the printing head along the first direction; and a controller which controls the sheet transporter and the head moving mechanism to execute a first printing mode of moving the printing head while holding the printing sheet in a first stationary position, moving the printing sheet to a second stationary position, and moving the printing head while holding the printing sheet in said second stationary position, said controller being operable to control the sheet transporter and the head moving mechanism to execute a second printing mode of moving the printing sheet while holding the printing head at a stationary position.

* * * * *